US011814834B2

(12) United States Patent
Gupta et al.

(10) Patent No.: US 11,814,834 B2
(45) **Date of Patent: *Nov. 14, 2023**

(54) BIDET WASHING APPARATUS WITH DISINFECTANT WASH FEATURE

(71) Applicants: Anjum Gupta, San Diego, CA (US); Bowen Zhang, San Diego, CA (US)

(72) Inventors: Anjum Gupta, San Diego, CA (US); Bowen Zhang, San Diego, CA (US)

(73) Assignee: 2Go Products, LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/738,469

(22) Filed: May 6, 2022

(65) Prior Publication Data

US 2022/0298771 A1 Sep. 22, 2022

Related U.S. Application Data

(63) Continuation-in-part of application No. 17/555,879, filed on Dec. 20, 2021, now Pat. No. 11,692,337, which is a continuation-in-part of application No. 17/473,211, filed on Sep. 13, 2021, which is a continuation of application No. 16/567,107, filed on Sep. 11, 2019, now Pat. No. 11,155,987, which is a continuation-in-part of application No. 16/374,970, filed on Apr. 4, 2019, now Pat. No. 10,844,586.

(51) Int. Cl.

| | |
|---|---|
| ***E03D 9/08*** | (2006.01) |
| ***E03D 9/00*** | (2006.01) |
| ***B05B 15/55*** | (2018.01) |
| ***B05B 9/03*** | (2006.01) |

(52) U.S. Cl.
CPC ..... *E03D 9/08* (2013.01); *B05B 9/03* (2013.01); *B05B 15/55* (2018.02); *E03D 9/005* (2013.01)

(58) Field of Classification Search
CPC ..... E03D 9/08; E03D 9/005
USPC ..... 4/443, 447–448, 420.4
See application file for complete search history.

(56) References Cited

U.S. PATENT DOCUMENTS

| | | | | |
|---|---|---|---|---|
| 2020/0208390 | A1* | 7/2020 | Liao | E03D 9/002 |
| 2020/0318335 | A1* | 10/2020 | Gupta | B05B 9/03 |
| 2022/0039610 | A1* | 2/2022 | Nowotarski | B05B 7/2464 |
| 2022/0162843 | A1* | 5/2022 | Gupta | B05B 9/03 |
| 2022/0274771 | A1* | 9/2022 | Sylvia | B05B 15/70 |
| 2022/0341146 | A1* | 10/2022 | Gupta | B05B 9/03 |

* cited by examiner

*Primary Examiner* — Lori L Baker
(74) *Attorney, Agent, or Firm* — Edward D. Robinson

(57) ABSTRACT

A reservoir dispenser for a bidet apparatus includes a housing unit having a first chamber and a second chamber, wherein the first chamber is capable of holding a liquid wash solution separate from the second chamber. A side check valve between a hollow barrel and the first chamber; and a bottom check valve between the first chamber and the second chamber allows for controlled release of the liquid wash solution from the first chamber to the second chamber.

22 Claims, 45 Drawing Sheets

BIDET WASHING APPARATUS WITH DISINFECTANT WASH FEATURE

CROSS-REFERENCE TO RELATED APPLICATIONS

This application is a continuation-in-part of and claims the benefit of priority under 37 USC § 120 to U.S. patent application Ser. No. 17/555,879, titled: "BIDET WASHING APPARATUS WITH DISINFECTANT WASH FEATURE," filed on Dec. 20, 2021, which is a continuation-in-part of U.S. patent application Ser. No. 17/473,211, titled: BIDET WASHING APPARATUS WITH DISINFECTANT WASH FEATURE," filed on Sep. 13, 2021, which is a continuation of and claims the benefit of priority to U.S. patent application Ser. No. 16/567,107, titled: BIDET WASHING APPARATUS WITH DISINFECTANT WASH FEATURE," filed on Sep. 11, 2019, now U.S. Pat. No. 11,155,987, which is a continuation-in-part of and claims the benefit of priority to U.S. patent application Ser. No. 16/374,970, titled: "BIDET WASHING APPARATUS WITH DISINFECTANT WASH FEATURE," filed on Apr. 4, 2019, now U.S. Pat. No. 10,844,586, the disclosure of each of which is hereby incorporated by reference in their entireties for all purposes.

FIELD OF THE INVENTION

The disclosure generally relates to a bidet washing apparatus, and more particularly to a bidet washing apparatus having a disinfectant wash feature that can store and dispense a cleaning disinfectant with a bidet washing stream.

BACKGROUND OF THE INVENTION

A bidet apparatus for washing and cleaning body parts were initially developed in the form of a bidet that provided a single spray of water and was permanently built into the toilet bowl. However, such bidets were expensive, and a new generation of bidets was developed that was attachable to the toilet and included a plurality of nozzles for multiple water sprays. Such bidets can be attached to the seat of an existing toilet bowl for washing the private parts of a person.

Various bidet designs have addressed some of the desired effects, such as washing, washing with temperature-regulated water, and drying, However, existing bidets tail to address all concerns related to the designs and functions in the general field of bidets. For example, pollution of the outer surface of the nozzles, the bidet, and the toilet during utilization is a common problem and causes aesthetic and hygienic issues. This is particularly important in bidets used, for example, by infirm or sick people who have to be especially cautious about maintaining hygiene and preventing infections.

Currently, there aren't any bidets that include a disinfectant wash feature. Many bidets have a feature to clean the nozzle of the bidet, however, cleaning the nozzle with water causes problems as it could leave behind hard water deposits and not provide adequate cleaning. Hard water deposits on the nozzle could affect the flow of the bidet as it blocks the nozzle holes and not adequately cleaning the bidet raises sanitary concerns. Consumers may also feel that normal water may not provide adequate washing of their body parts. Therefore, there remains a need to provide bidets with a disinfectant wash feature.

SUMMARY OF THE INVENTION

The disclosed embodiments are directed to solving one or more of the problems presented in the prior art, described above, as well as providing additional features that will become readily apparent by reference to the following detailed description when taken in conjunction with the accompanying drawings.

In an embodiment, the disclosure provides a reservoir dispenser for a bidet apparatus, which includes a housing unit having a first chamber and a second chamber, wherein the first chamber is capable of holding a liquid wash solution separate from the second chamber; a water inlet and a water outlet connectable to the second chamber; a lid attachable to the first chamber; an activator having a stem and a stem endpiece; a hollow barrel surrounding the stem and stem endpiece; a side check valve between the hollow barrel and the first chamber; and a bottom check valve between the first chamber and the second chamber.

In one aspect, the disclosure provides a reservoir dispenser for a bidet apparatus, wherein the lid includes an opening therein, and the activator is within the opening of the lid.

In another aspect, the disclosure provides a reservoir dispenser for a bidet apparatus, wherein the activator is a push-button, a twist-button, a pull up and push down button, a slide button, a plunger button, a lever, or a knob.

In another aspect, the disclosure provides a reservoir dispenser for a bidet apparatus, wherein the side check valve and the bottom check valve are each independently a spring-loaded check valve, a ball and seat check valve, a diaphragm check valve, an umbrella check valve, or a duckbill check valve.

In another aspect, the disclosure provides a reservoir dispenser for a bidet apparatus, wherein the lid includes a lid base having an inner wall, and outer wall, and a space therebetween in which the activator can move down and up within when engaging and disengaging the activator, respectively.

In another aspect, the disclosure provides a reservoir dispenser for a bidet apparatus, wherein the side check valve includes a side check valve body including a check valve seat; a ball for engaging within the seat; an inner opening into the barrel; an outer opening into the first chamber; and one or more O-rings encircling the side check valve body.

In another aspect, the disclosure provides a reservoir dispenser for a bidet apparatus, wherein the bottom check valve includes a bottom check valve body including sidewalls of the middle region and/or lower region of the barrel; a check valve disc; a check valve spring; and a check valve guide having one or more openings there through.

In another aspect, the disclosure provides a reservoir dispenser for a bidet apparatus, wherein engaging the activator blocks transfer of liquid wash solution from the first chamber to the hollow barrel through the side check valve; and allows transfer of the liquid wash solution from the first chamber to the second chamber through the bottom check valve.

In another aspect, the disclosure provides a reservoir dispenser for a bidet apparatus, wherein disengaging the activator allows transfer of liquid wash solution from the first chamber to the hollow barrel through the side check valve; and blocks transfer of the liquid wash solution from the first chamber to the second chamber through the bottom check valve.

In another embodiment, the disclosure provides a reservoir dispenser for a bidet apparatus, which includes a housing unit having a first chamber and a second chamber, wherein the first chamber is capable of holding a liquid wash solution separate from the second chamber; a water inlet and a water outlet connectable to the second chamber; a lid attachable to the first chamber; an activator having an upper tube and an inlet tube, wherein the activator, the upper tube, and the inlet tube are within the first chamber; an outlet chamber having an upper first tube and a lower second tube, wherein the outlet chamber and upper first chamber are within the first chamber, and wherein the lower second tube is secured at a base of the first chamber and is connectable to the second chamber; a pump chamber having a pump chamber lid and a pump chamber receptacle, wherein the pump chamber, the pump chamber lid and the pump chamber receptacle are within the first chamber, wherein the pump chamber lid is connectable to the upper tube of the activator, wherein the pump chamber receptacle is connectable to the upper first tube of the outlet chamber, and wherein the pump chamber lid and the pump chamber receptacle form a reversibly compressible pump chamber.

In one aspect, the disclosure provides a reservoir dispenser for a bidet apparatus, wherein the lid includes an opening therein, and the activator is within the opening of the lid.

In another aspect, the disclosure provides a reservoir dispenser for a bidet apparatus, wherein the activator is a push-button, a twist-button, a pull up and push down button, a slide button, a plunger button, a lever, or a knob.

In another aspect, the disclosure provides a reservoir dispenser for a bidet apparatus, wherein the pump chamber includes a spring and a first ball between a support base of the pump chamber receptacle and the pump chamber lid, respectively; and wherein the outlet chamber includes a second ball between the upper first tube and the lower second tube.

In another aspect, the disclosure provides a reservoir dispenser for a bidet apparatus, wherein engaging the activator allows transfer of the liquid wash solution from the first chamber to the second chamber by compressing the pump chamber and forcing any liquid wash solution present in the pump chamber through the outlet chamber and into the second chamber.

In another aspect, the disclosure provides a reservoir dispenser for a bidet apparatus, wherein engaging the activator compresses the pump chamber and spring, thereby forcing the first ball against the upper tube of the activator closing off the first chamber to the pump chamber; and forcing the second ball downwards away from the lower second tube of the outlet chamber and forcing any liquid wash solution present in the pump chamber through the upper first tube, the outlet chamber, the lower second tube and into the second chamber.

In another aspect, the disclosure provides a reservoir dispenser for a bidet apparatus, wherein disengaging the activator blocks transfer of liquid wash solution from the first chamber to the second chamber by elongating the pump chamber and relieving the pressure on the liquid wash solution present in the pump chamber.

In another aspect, the disclosure provides a reservoir dispenser for a bidet apparatus, wherein disengaging the activator elongates the pump chamber and spring, thereby releasing the first ball against the upper tube of the activator and opening the first chamber to the pump chamber; and forcing the second ball upwards against the upper first tube and closing off the second chamber to the pump chamber.

In another embodiment, the disclosure provides a reservoir dispenser for a bidet apparatus, which includes a housing unit having a first chamber and a second chamber, wherein the first chamber is capable of holding a liquid wash solution separate from the second chamber; a water inlet and a water outlet connectable to the second chamber; a lid attachable to the first chamber; a support holder between the first chamber and the second chamber, wherein the support holder includes a support holder base and a support holder chamber; a pump holder on a base of the first chamber, wherein the pump holder includes an inner wall, an outer wall, and a space therebetween for tracking upon the support holder chamber; an activator including the lid and the first chamber, wherein the activator tracks upon the support holder and support holder chamber; and a pump housing unit having an inlet tube and an outlet tube, wherein the inlet tube is in the first chamber, and the outlet tube enters the second chamber, wherein the outlet tube is closed at one end and includes a grooved region having a proximal end with at least one opening and a distal end; and a piston surrounding the grooved region of the outlet tube, wherein the piston can travel between the proximal end to cover the at least one opening in the grooved region, to the distal end to uncover the at least one opening in the grooved region.

In one aspect, the disclosure provides a reservoir dispenser for a bidet apparatus, wherein the activator is a push-button, a twist-button, a pull up and push down button, a slide button, a plunger button, a lever, or a knob.

In another aspect, the disclosure provides a reservoir dispenser for a bidet apparatus, wherein the pump housing unit further includes a spring and a ball between the outlet tube and the inlet tube.

In another aspect, the disclosure provides a reservoir dispenser for a bidet apparatus, wherein engaging the activator allows transfer of the liquid wash solution from the first chamber to the second chamber by compressing the pump housing unit and moving the piston from the proximal end to the distal end of the outlet tube thereby uncovering the opening in the proximal end and forcing any liquid wash solution present in the pump housing unit through the opening and into the second chamber.

In another aspect, the disclosure provides a reservoir dispenser for a bidet apparatus, wherein disengaging the activator blocks the transfer of the liquid wash solution from the first chamber to the second chamber by elongating the pump housing unit and moving the piston from the distal end to the proximal end of the outlet tube thereby covering the opening in the proximal end and blocking any liquid wash solution present in the pump housing unit from entering the second chamber.

Further features and advantages of the disclosure, as well as the structure and operation of various embodiments of the disclosure, are described in detail below concerning the accompanying drawings.

BRIEF DESCRIPTION OF THE DRAWINGS

The disclosure, by one or more various embodiments, is described in detail concerning the following figures, The drawings are provided for purposes of illustration only and merely depict exemplary embodiments of the disclosure. These drawings are provided to facilitate the reader's understanding of the disclosure and should not be considered limiting the breadth, scope, or applicability of the disclosure. It should be noted that for clarity and ease of illustration these drawings are not necessarily made to scale.

DETAILED DESCRIPTION OF EXEMPLARY EMBODIMENTS

Figure 1:
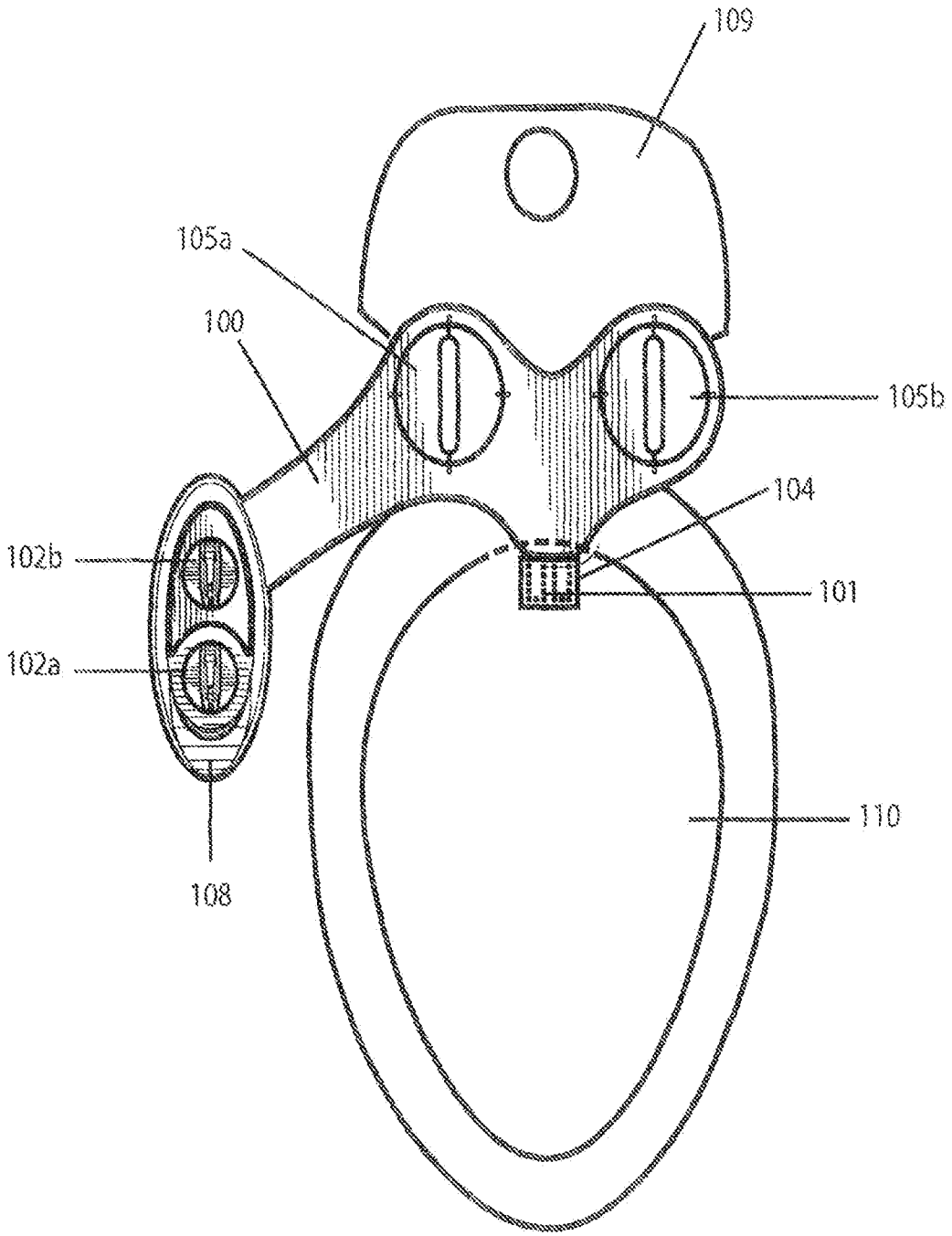
FIG. 1 illustrates an embodiment of a perspective view of an exemplary bidet washing apparatus installed on an existing toilet seat, with the seat cover-up.

The following description is presented to enable a person of ordinary skill in the art to make and use embodiments described herein. Descriptions of specific devices, techniques. and applications are provided only as examples. Various modifications to the examples described herein will be readily apparent to those of ordinary skill in the art, and the general principles defined herein may be applied to other examples and applications without departing from the spirit and scope of the disclosure. Thus, the disclosure is not intended to be limited to the examples described herein and shown but is to be accorded the scope consistent with the claims.

The word "exemplary" is used herein to mean "serving as an example illustration," Any aspect or design described herein as "exemplary" is not necessarily to be construed as preferred or advantageous over other aspects or designs.

Reference will now be made in detail to aspects of the subject technology, examples of which are illustrated in the accompanying drawings, wherein reference numerals refer to like elements throughout.

It should be understood that the specific order or hierarchy of steps in the process disclosed herein is an example of exemplary approaches. Based upon design preferences, it is understood that the specific order or hierarchy of steps in the processes can be rearranged while remaining within the scope of the disclosure. Any accompanying method claims present elements of the various steps in, a sample order, and are not meant to be limited to the specific order or hierarchy presented.

The embodiments disclosed herein describe a new, clean and hygienic washing bidet. The various embodiments include one or a plurality of water inlets, a control means housing one or a plurality of control valves to control the flow of water from the water inlets to one or a plurality of water tubes, one or a plurality of washing nozzles, a protective shield gate, and securing unit configured to securing the sanitary washing device to the toilet seat.

The disclosed embodiments directed to clean and hygienic bidet washing apparatus 100 attachable to an existing toilet, for cleaning the body parts of the user sitting on or near the toilet.

As described herein, a "bidet" is a toilet attachment for cleaning the body parts of the user.

As described herein, the term "water inlet" means any structure that may provide water to the bidet washing apparatus.

As described herein, a "control unit" (aka "control panel") is the housing which has "control switch(s)" thereon controlling the various functionalities of the bidet, including but, not limited to, the flow of water, adjusting the angle of the nozzles, and opening and closing the protective shield gate.

As described herein, "control valves" are, controller parts located inside the control panel housing which control the flow of water or other fluids from the water inlet(s) to one or more "water tubes" by opening, closing, or partially obstructing various passageways.

As described herein, "water tubes" are channels that connect the control valves to a "nozzle assembly," wherein, the "nozzle assembly" includes a single nozzle or a collection of nozzles including at least one "washing nozzle."

As described herein, a "nozzle" is a device designed to eject water or other fluids into the surrounding medium as a coherently controlled spray.

As described herein, the "washing nozzle" is the nozzle that can be used to wash the body parts of a user.

As described herein, the "nozzle assembly" may also have other types of nozzles such as a "self-cleaning nozzle," which is used to clean the nozzle assembly itself, a "toilet cleaning nozzle," which is used to clean the bidet and/or the toilet, and a "shield cleaning nozzle," which is used for cleaning the "protective shield gate."

As described herein, the "protective shield gate" is a structure placed at least partially in front of the nozzle assembly (e.g., between the user and the nozzle assembly) to protect the nozzle assembly from pollutants.

As described herein, the "protective shield gate" ran has a "hinged" edge. The term "hinged" here means a joint that allows the turning or pivoting of the gate, by any conventional turning or pivoting mechanism.

As described herein, the term "fluidically coupled" means a connection or a passageway that allows fluid to flow therethrough.

As described herein, the term "reservoir" means a fluid holding tank.

Accordingly, in one embodiment the disclosure provides a bidet washing apparatus attachable to a toilet bowl for cleaning one or more body parts of a user. The apparatus can include one or more water inlets configured to supply water, and a control unit, housing one or more valves fluidically connected to the one or more water inlets, including one or more control switches configured to operate the one or more valves. As such, one or more valves can control water flow from one or more water inlets. The apparatus can further include a nozzle assembly including at least one washing nozzle, fluidically connected to at least one of the one or more valves with one or more water tubes. At least one washing nozzle can be positioned for directing water to one or more body parts of the user. The apparatus can also include a protective shield gate covering at least a portion of at least one washing nozzle, where the protective shield gate is rotatably coupled to the bidet washing apparatus.

According to various embodiments, the protective shield gate can be rotatably coupled to the apparatus along a side or top edge via a hinge, for example, to allow for the manual or electrical opening and closing of the protective shield gate. In this matter, the nozzle(s) are easily accessible for cleaning, removal, replacement, or another adjustment while the protective shield gate is open. In an alternative embodiment, the protective shield gate can be completely removed to similarly provide access to the nozzle(s).

According to another embodiment, the water inlet(s) can be fluidically connected to one or more valves via a single-body connector without any intervening parts or joints, which results in a more robust, long-lasting, bidet washing apparatus, since leaks or other damage to the fluidic couplings are less likely to occur.

Figure 2:
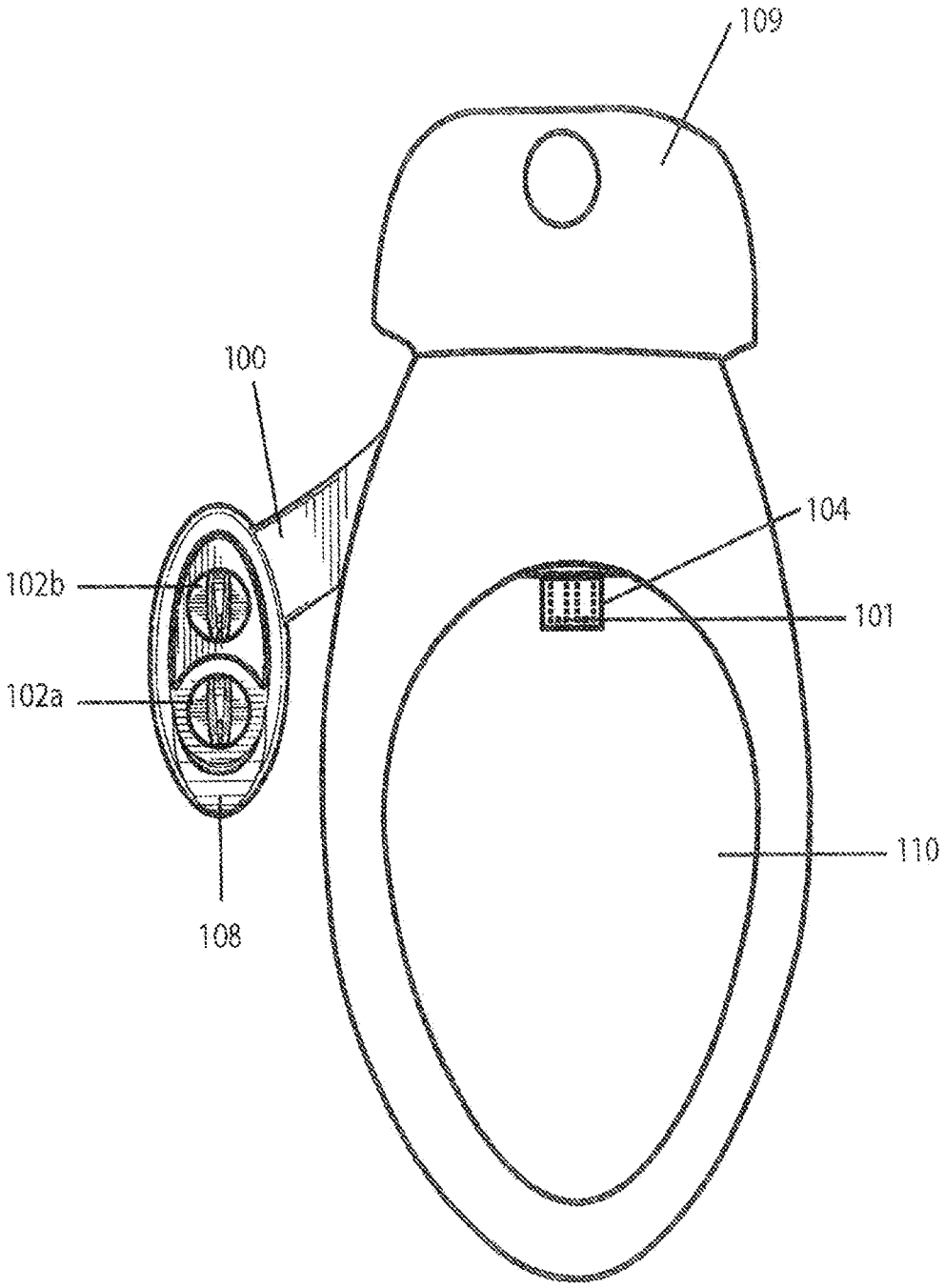
FIG. 2 illustrates an embodiment of a perspective view of a bidet washing apparatus installed on an existing toilet seat, with the seat cover down.

Referring to FIG. 1 and FIG. 2, the bidet washing apparatus 100 of the disclosure can be mounted on a toilet bowl 110 using securing mechanisms 105*a* and 105*b*. Any conventional securing unit can be implemented, e.g., one or more screws. A toilet seat 112 can pivot around and can be connected to a rear portion of the toilet bowl 110. On the rear portion of the toilet bowl, 110 can be mounted a refillable toilet tank 109, in which an amount of water can be stored. In certain embodiments, toilet tank 109 can be used as the water source for the bidet washing apparatus 100 by a fluidic connection. On the bidet washing apparatus, 100 can be mounted a nozzle assembly 101, which includes at least one washing nozzle (not shown) for washing the body parts of the user sitting on or near the toilet bowl 110. The body of the bidet washing apparatus can be made of any suitable material, including but not limited to, plastics, polymers, reinforced polymeric materials, wood, metal and the like, and any combination thereof.

Figure 3:
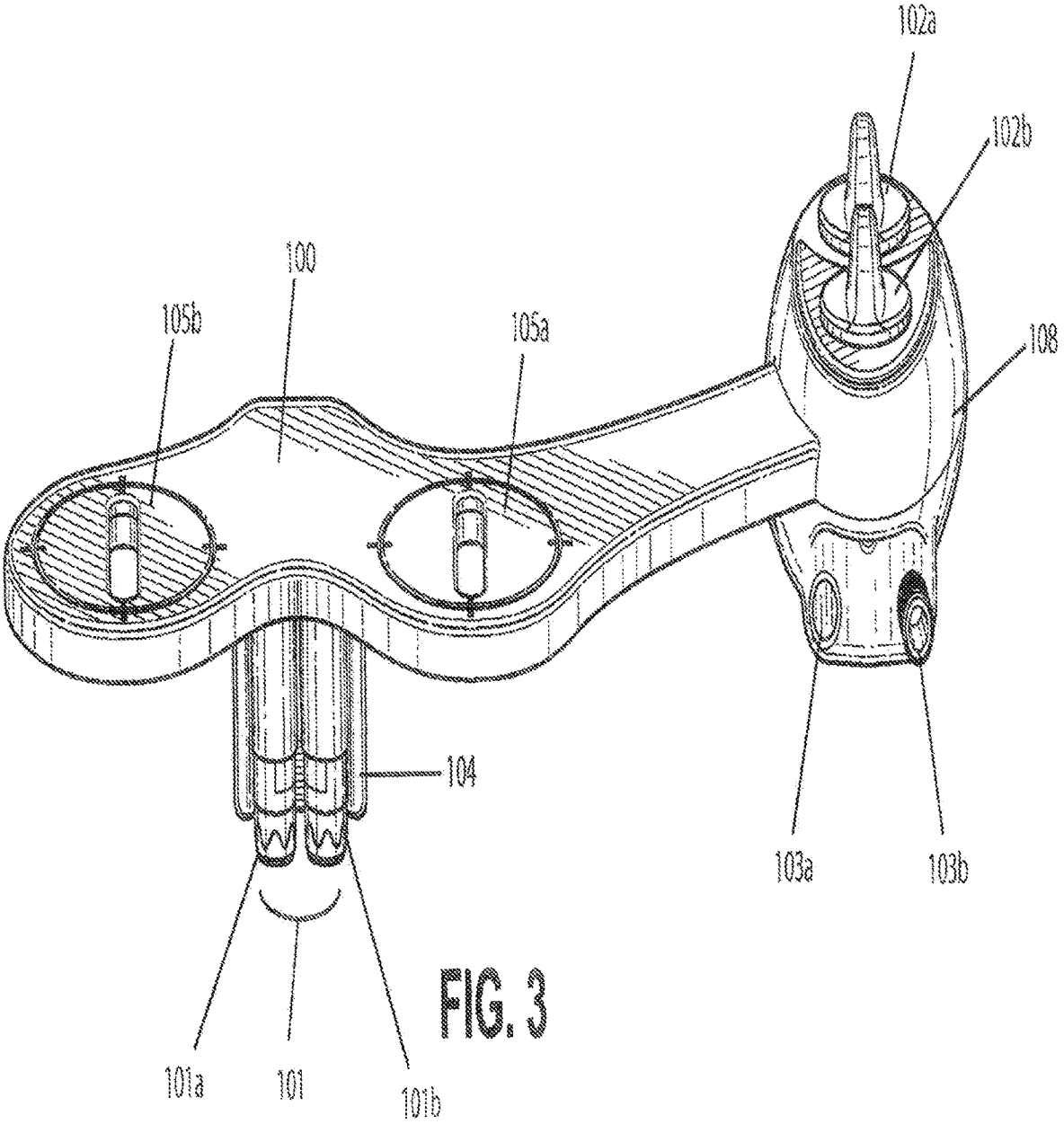
FIG. 3 illustrates an embodiment of a perspective view of an exemplary bidet washing apparatus.

FIG. 3 shows one exemplary embodiment of a bidet washing apparatus 100 with two washing nozzles 101*a* and 101*b*, respectively. However, in an installation, a lesser or greater number of nozzles can be used. Each washing nozzle can spray a stream of water upwardly and inwardly, according to various embodiments.

As shown in FIG. 2 and FIG. 3, a control unit 108 can be provided the easy access for the user, and houses control switches 102*a* and 102*b* for providing operational instructions to the bidet washing apparatus 100. The depicted example shows two switches 102*a* and 102*b*; however, one of ordinary skill in the art would realize that any number of switches can be provided for performing various operations without departing from the scope of the disclosure. Some examples of operational instructions include, but are not limited to, controlling the flow of water from the water inlet, changing the angle of the washing nozzles, and opening and closing the protective shield gate (described in further detail below). The type of control switches can be selected from a group including knobs, dials, levers, depressible buttons, or any conventional control mechanism, An installation may have all similar control switches where both control switches 102*a* and 102*b* are knobs.

Figure 9:
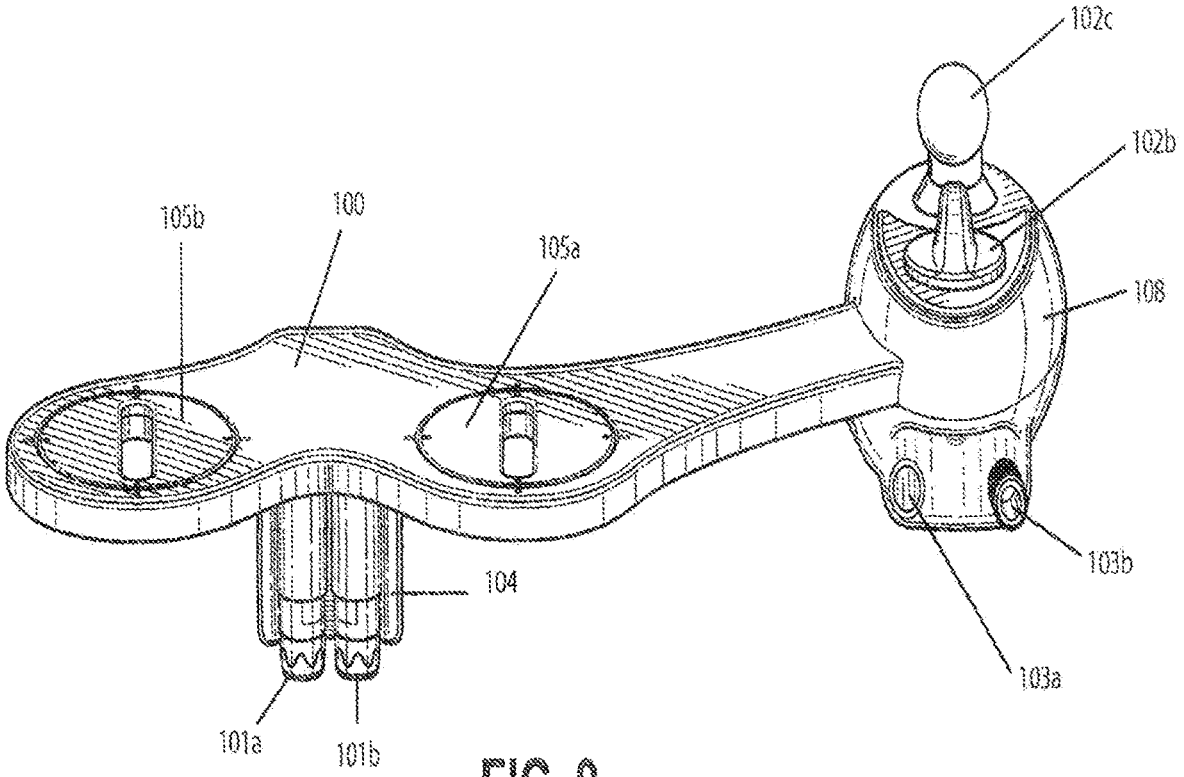
FIG. 9 illustrates an embodiment of a perspective view of an exemplary bidet washing apparatus.

On the other hand, FIG. 9 shows an embodiment of the disclosure where one of the control switches 102*b* is a knob and the other control switch 102*c* is a lever.

Furthermore, as shown in FIG. 1 and FIG. 2, the nozzle assembly 101 can have a protective shield gate 104 substantially or partially in front of it. The position of the protective shield gate 104 is such that it can act as a shield between the user's body and/or water in the toilet bowl 110 and the nozzle assembly 101 thus protecting the nozzle assembly 101 from pollutants during use.

Certain aspects of the bidet washing apparatus will be detailed hereinafter concerning FIGS. 3-9.

FIG. 3 shows a front perspective view of one embodiment described herein. Referring to FIG. 3, the bidet washing apparatus 100 includes the water inlets 103*a* and 103*b* to feed water into the bidet. The water inlet can be controlled by the user using the control switches 102*a* and 102*b* situated on the control unit 108. The water from the water inlets 103*a* and 103*b* can be ultimately provided to the nozzle assembly 101 via tubes (as described in greater detail concerning FIG. 7, for example). The nozzle assembly shown in this aspect of the disclosure has two washing nozzles 101*a* and 101*b*. The protective shield gate 104 protects the nozzle assembly 101 from excrement and pollutants as described above. In this example, the protective shield gate 104 is positioned in front of the nozzle assembly 101 of the bidet such that it is between the user sitting on the toilet seat, for example, and the nozzle assembly. Hence, when the user is using, the toilet, the nozzles are shielded behind the protective shield gate 104 and do not become polluted.

Figure 5:
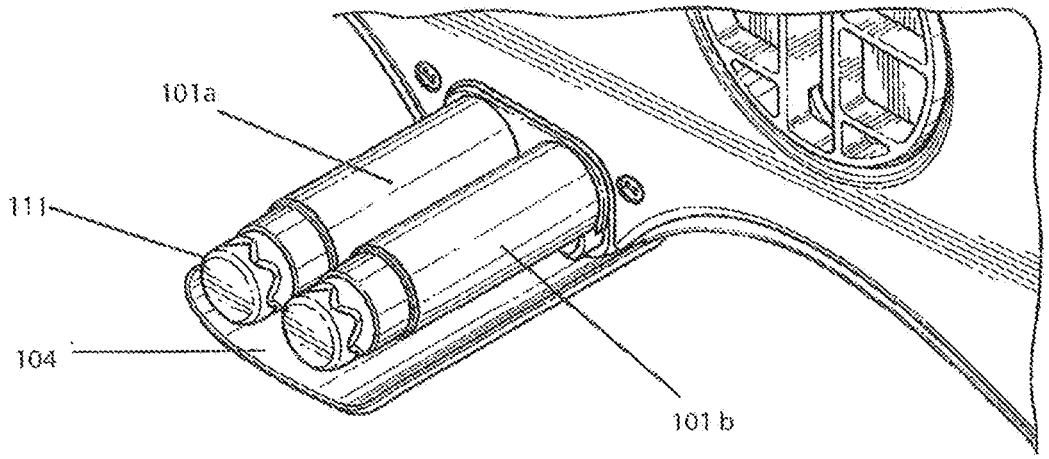
FIG. 5 illustrates an embodiment of a fragmentary view of an exemplary bidet washing apparatus illustrating the gate shield protecting the nozzle assembly in a closed position.
Figure 6:
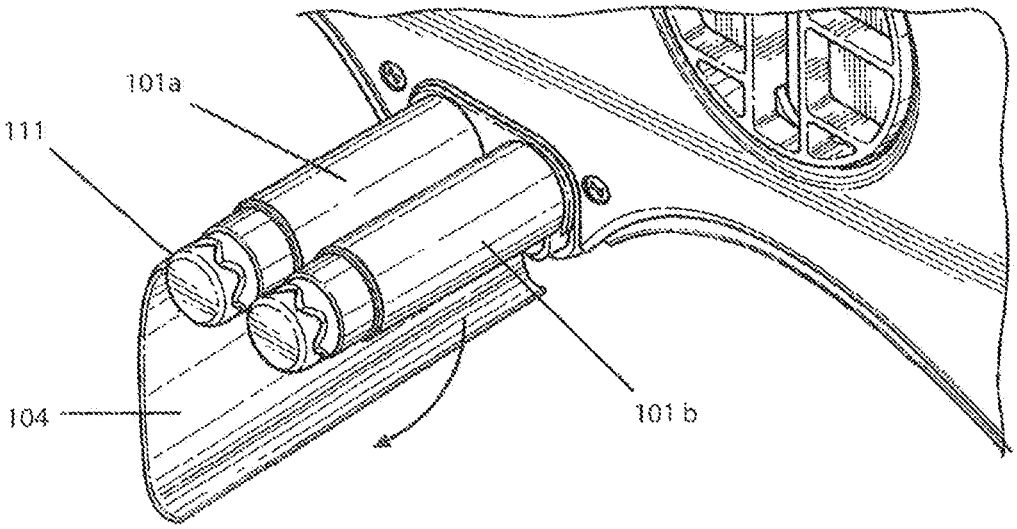
FIG. 6 illustrates an embodiment of a fragmentary view of an exemplary bidet washing apparatus illustrating the shield gate protecting the nozzle assembly in an open position.

Referring to FIGS. 5-6, the protective shield gate 104 can be movable along a hinged edge 111 to provide for further hygiene. The protective shield gate 104 rotates and thus can be manual, for example, opened (FIG. 6) and closed (FIG. 5), after using the toilet to clean any minute leftover pollutants on the outer covering of the nozzle assembly to ensure complete cleanliness. In the embodiment, the user can open and close the gate manually and, thus, the gate can stay in the opened or closed position that the user places the gate. In certain embodiments, the gate can be opened and closed by an electrical signal using a control switch located on the control unit 108, which can allow the gate to remain open until the user closes the gate via the control switch, so the user can clean the nozzle. In other embodiments, the hinged edge 111 is on the top of the protective shield gate 104, and not, on the side edge as shown in the illustrative FIGS. 5-6. hi. yet other embodiments, the user may be able to completely remove the protective shield gate 104 for cleaning the nozzle(s) and reattach it after cleaning. Of course, one of ordinary skill in the art would understand that the hinged edge could comprise any rotatable joint mechanism that allows for, the rotation of the protective shield gate 104 to provide efficient access to the nozzle(s). If the protective shield gate 104 is completely removable, a grooved and slideable mechanism can be employed so that the protective shield gate 104 can slide in and out to be attached and removed. Of course, other mechanisms can be utilized for removably attaching the protective shield gate 104, e.g., a magnet or a snap structure.

In certain embodiments, the protective shield gate 104 has a flap portion perpendicular to the protective shield gate 104 such that it covers the bottom of the nozzle assembly 101. Additionally, the flap can have a spring mechanism such that it is pushed out and aligns with the protective shield gate 104 by the force of the water stream when water flows out of the nozzle assembly 101. When the water flow stops, the flap can spring hack into its original position perpendicular to the shield gate 101.

The protective shield gate 104 of the disclosure can be made from a material selected from plastic, metal, a material having anti-microbial properties, and material with increased pollutant repellant properties.

In certain embodiments, the angle of the washing nozzles can be adjusted using a control switch located on the control unit 108. Thus, when a user wants to clean certain body parts, water can be sprayed on the desired body part by adjusting the angle of the washing nozzle(s). As shown in FIG. 3, the height of the protective shield gate is such that it allows for an uninterrupted spray of water from the nozzle assembly 101, since the nozzle assembly 101 can extend beyond the bottom edge of the protective shield gate 104.

Figure 4:
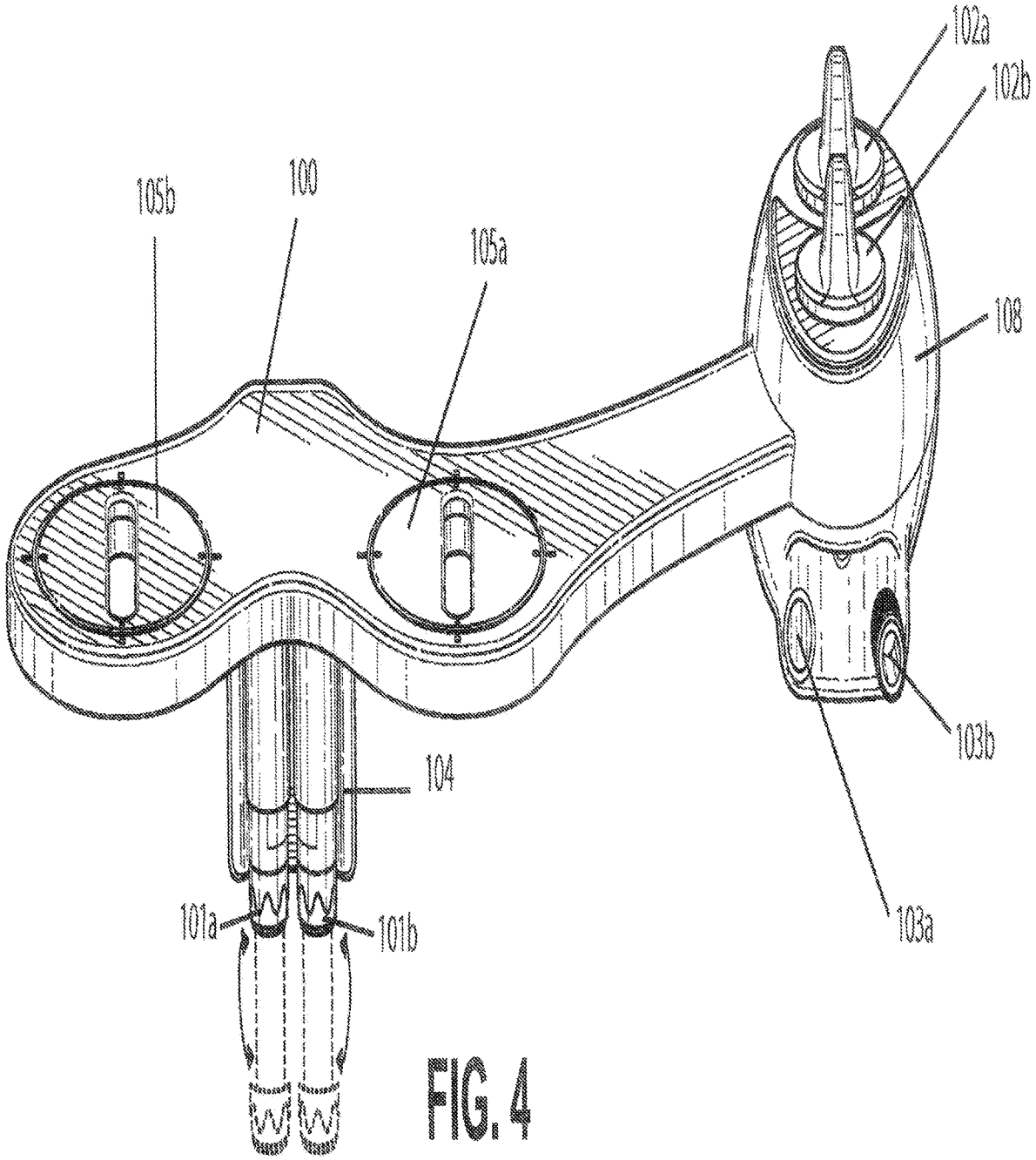
FIG. 4 illustrates an embodiment of a perspective view of an exemplary bidet washing apparatus, with the dotted lines showing the nozzles extended outwards.

FIG. 4 shows another embodiment wherein the height of the protective shield gate is equal to or greater than that of the washing nozzles 101*a* and 101*b*. Here, the washing nozzles 101*a* and 101*b* are housed within an outer covering including a spring mechanism for pushing the washing nozzles out when water flows through the washing nozzles such that the water flow is not interrupted by the protective shield gate 104. Each washing nozzle includes an outer covering and an inner nozzle operated slidably hack and firth with hydraulic pressure of the supplied washing water by an instruction from the control unit 108. During the use of the washing nozzles, the nozzles are extended from their outer covering below the length of the shield gate by the hydraulic force of the washing water, and water is sprayed on the user for cleaning purposes. After use, when the water flow is stopped, the nozzles are retracted in their outer covering which is hidden behind the shield gate. In certain other embodiments, the user may control the movement of the washing nozzle by using the control unit 108, instead of the hydraulic pressure. When an instruction of a washing operation is given by the control unit 108, a washing nozzle driving unit is activated to advance the nozzle. The washing nozzle angle can also be adjusted by an instruction given by the control unit 108 to position the nozzle for cleaning. Thus, the washing nozzle can reach the user's desired washing position by the combined advancement of the nozzle and/or the angular positioning.

According to the embodiment, nozzle assembly 101 includes at least one washing nozzle in yet another embodiment, the bidet washing apparatus 100 further includes a self-cleaning cleaning nozzle for cleaning the nozzle assembly itself. The self-cleaning nozzle can be positioned to spray water onto the nozzle assembly 101 and/or washing nozzle(s) before and/or after the usage for additional hygiene. The self-cleaning nozzle can be adapted to be controlled by the control unit 108, and thus provides an additional hygiene level.

Another embodiment includes a toilet cleaning nozzle for cleaning the toilet and the bidet before and after use of the toilet. The toilet cleaning nozzle can be positioned to spray water on the toilet bowl 110 and/or the bidet washing apparatus 100 and can be controlled by the control unit to provide additional hygiene. Yet, another embodiment includes a shield cleaning nozzle for cleaning the protective shield gate 104. The shield cleaning nozzle can be similarly controlled by the control unit 108. Additionally, the shield cleaning nozzle can be positioned to clean the protective shield gate 104 in an open and/or closed position.

Any or all of the washing nozzles can be connected to the nozzle assembly 101 via a ball joint, for example. which could allow the user to manually swivel a washing nozzle around 360 degrees, to direct the spray of water in a desired and precise direction. Of course, other types of joints and connectors could be implemented to allow for the manual swivel or direction correction, as desired by the user to spray water to the desired body part, for example.

Moreover, according to an exemplary embodiment, e or more of the washing nozzle(s) 101*a* and 101*b* can be connected to the nozzle assembly 101 by a mechanism allowing for the easy removal of the nozzle(s) 101*a* and 101*b*. For example, the washing nozzle(s) 101*a* and 101*b* can slide into place via a grooved portion of the nozzle assembly 101 or could otherwise snap into place. Any conventional mechanism of removably attaching the nozzle (s) 101*a* and 101*b* can be implemented, so that the user can swap the nozzle(s) 101*a* and 101*b* with other nozzles or increase or reduce the number of washing nozzle(s) 101*a* and 101*b* connected to the nozzle assembly 101.

Figure 7:
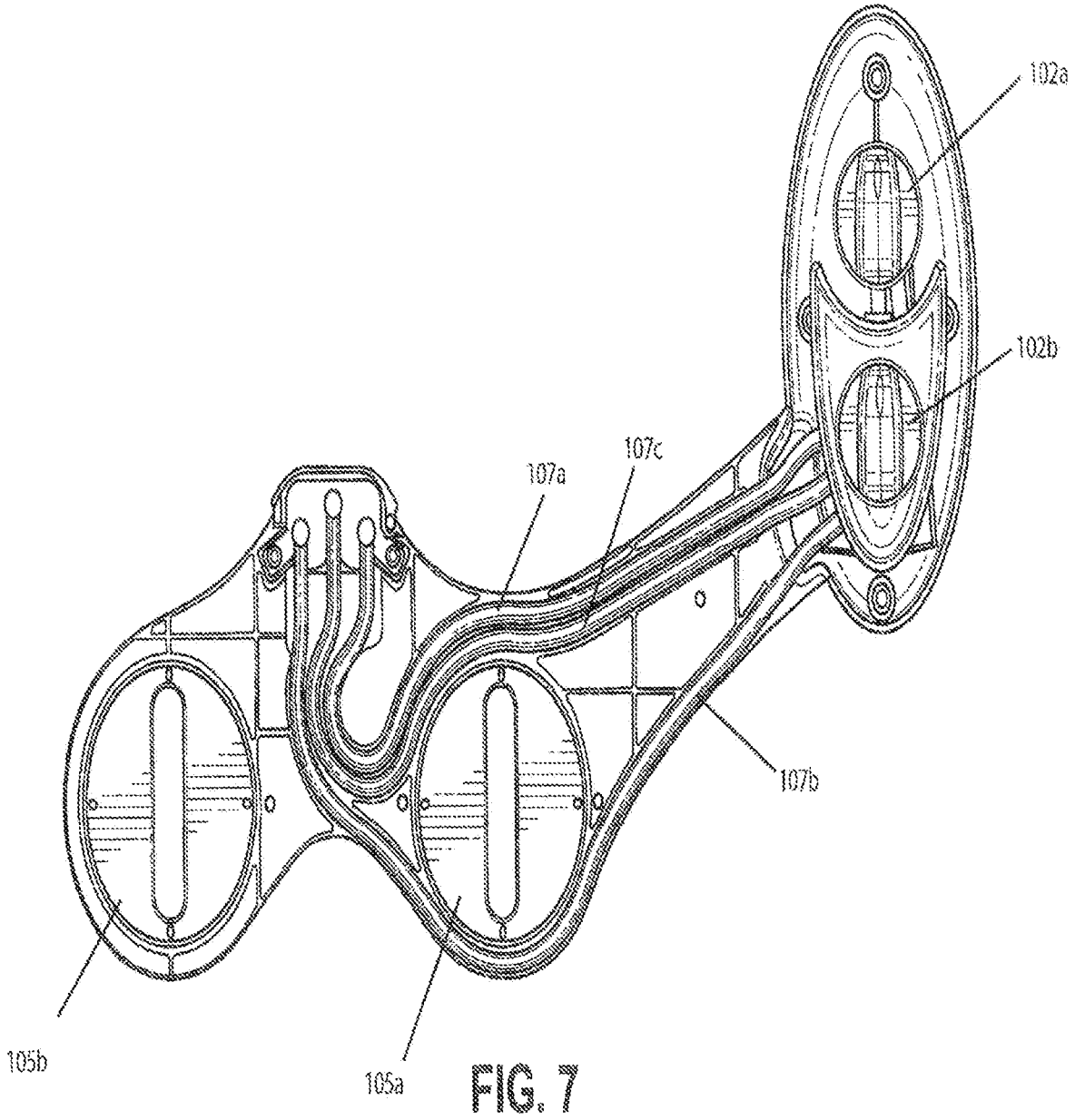
FIG. 7 illustrates an embodiment of a top plan view of the exemplary embodiment.
Figure 8:
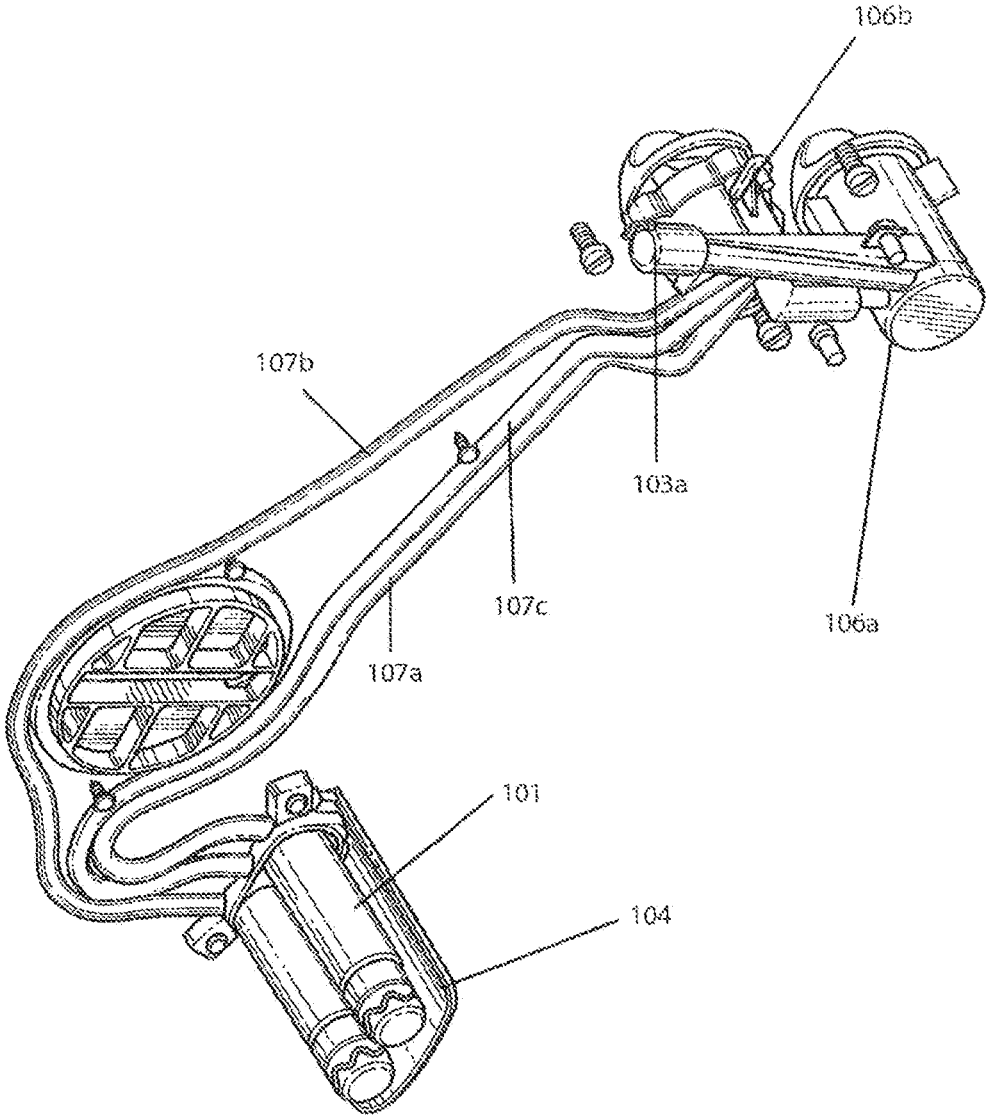
FIG. 8 illustrates an embodiment of a bottom plan view of a perspective view of a bidet washing apparatus.

An exemplary water supply system to the nozzle assembly 101 will be detailed hereinafter concerning FIGS. 7-8. The control unit 108 can house the control valves 106*a* and 106*b* (as shown in FIG. 8), to control the flow of water to the water tubes and has the control switches 102*a* and 102*b*, for giving instructions to the control valves. Two control valves and control switches are depicted for exemplary purposes, but it should be understood that any number of control valves and corresponding switches can be employed.

The control valves 106*a* and 106*b* can be situated at the entrance to the water tubes 107*a*, 107*b*, and 107*c* in this example. The control valves 106*a* and 106*b* are designed to open, close, or partially obstruct the water inlet 103*a* opening into the water tubes 107*a*, 107*b*, and 107*c*, such that the volume of the water flowing through any tube at any given time can be easily controlled by the user by giving simple instructions through the control switches. The water tubes 107*a*, 107*b*, and 107*c* connect the control valves 106*a* and 106*b* at one end to the nozzle assembly 101 at the other end. Thus, the control valves 106*a* and 106*b* can effectively control the volume of water flowing to the nozzle assembly 101. In the embodiment, one water tube 107*b* passes through the back of the bidet washing apparatus 100, and two water tubes 107*a* and 107*c* pass through the front of the bidet washing apparatus 100. However, it is to be noted that in an embodiment, more than one water tube could pass through the back of the bidet washing apparatus 100, and the number of water tubes passing through the front of the bidet washing apparatus 100 could be more or less than two.

According to an embodiment, the bidet washing apparatus 100 can include a vacuum breaker (not depicted), which can be situated at various locations within the bidet washing apparatus 100. The vacuum breaker can be located anywhere between the water supply (e.g., the water tank supplying water to the toilet bowl) and the washing nozzle(s) e.g., 101*a* and 101*b*) output. The vacuum breaker can be intended to halt the flow of water that is not expelled by the washing nozzle(s) back into the water supply. According to one exemplary embodiment, the vacuum breaker(s) can be housed within the control unit 108, located between a valve 106*a* and 106*b* and the nozzle assembly 101; however, one of ordinary skill in the art would realize that various locations of one or more vacuum breakers can be implemented within the scope of this disclosure to perform the desired function.

Figure 10:
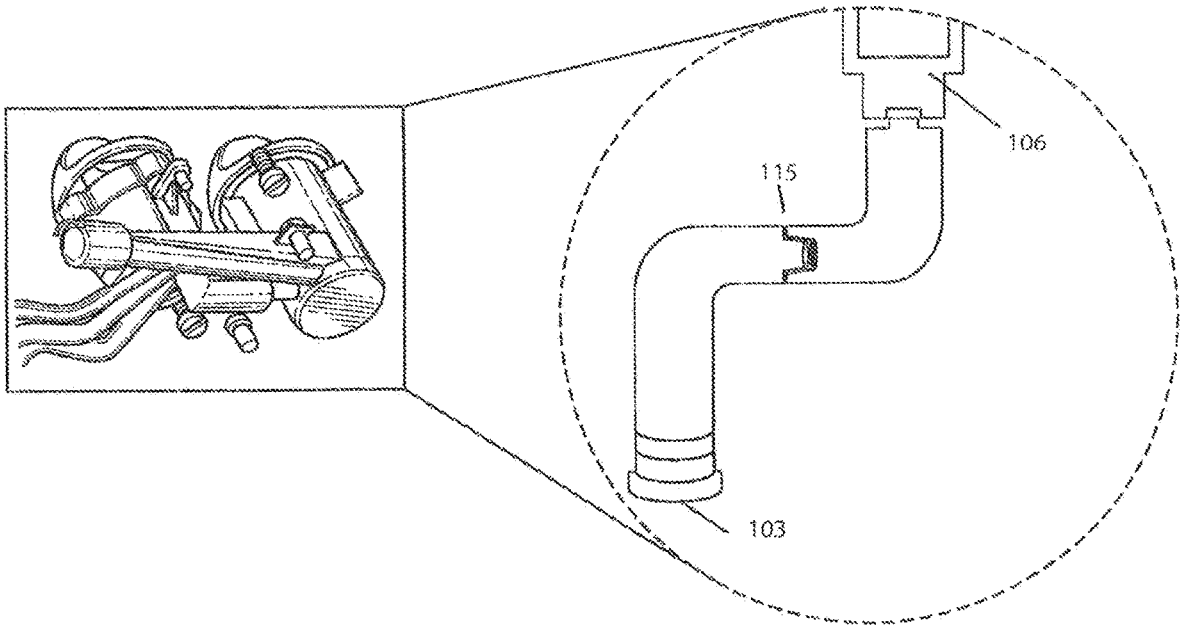
FIG. 10 illustrates an embodiment of a schematic showing a single connection between a water inlet and a control valve inside a control, panel.

In one exemplary embodiment, each water inlet 103*a* and 103*b* is connected to a control valve 106*a* and 106*b* by a single, non-jointed, connection 115 (see FIG. 10) thereby removing any intervening parts and extra connections, which can considerably increase the durability and lifetime of the bidet system. Of course, multiple water inlets 103*a* and 103*b* could be connected to a single control valve; however, each connection between the water inlets 103*a* and 103*b* and the single control valve can be a single-body structure, according to one embodiment.

In an embodiment, the washing nozzle can be replaced with a nozzle that is configured to hold materials such as soap, disinfectant, or any cleaning or medicinal, a substance that can be expelled along with water as it flows through the nozzle. For example, such materials could be in a solid, semi-solid, or liquid form, which dissolves at a predetermined and desired rate, as the water flows through the nozzle and is carried out of the nozzle by the spraying water.

In another embodiment, the bidet washing apparatus can contain one or more reservoir dispensers or chambers, which can be configured to hold materials such as soap, disinfectant, or any cleaning or medicinal substance that can be expelled along with water through one or more water tubes to the nozzle assembly and car be carried out of one or more nozzles by the spraying water. As before, the above-mentioned materials are provided merely for exemplary purposes and are not intended to limit the disclosure in any way. Other known substances and/or materials could be held and/or stored in a nozzle or reservoir dispenser to be expelled with water through the nozzle.

Figure 11:
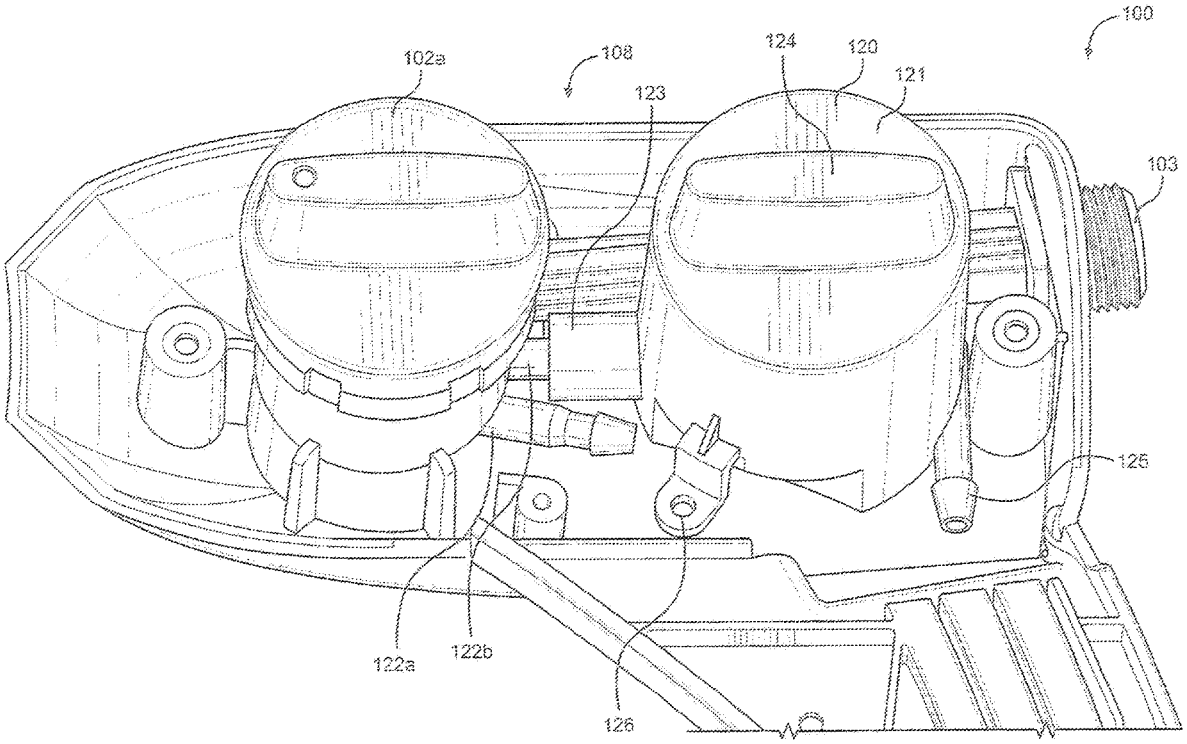
FIG. 11 illustrates a cut-away view fan embodiment of a top view of a bidet washing apparatus.

FIG. 11 illustrates a cut-away view of an embodiment of a top view of a bidet washing apparatus 100, i.e., without showing the entire body of the apparatus. In this figure, the apparatus includes water inlet 103*a*, which is fluidically connected to control unit 108 to supply water. The control unit includes control unit switch 102*a*, which is configured to operate one or more control unit valves or openings (not shown) for controlling water flow from the water inlet and control unit outlets 122*a* and 122*b*.

As shown, the apparatus also includes a reservoir dispenser 120 having one or more compartments (not shown) with a removable lid 121 for holding soap and/or disinfectant. The control unit outlets, 122*a* and 122*b* allow for the transfer of water from the control unit to the nozzle assembly 101 via water tube 107*a* and/or 107*c* (see FIGS. 3-9); and to the reservoir dispenser 120 via reservoir dispenser inlet 123, respectively.

The reservoir dispenser 120 allows for mixing of the transferred water with the soap and/or disinfectant present in the one or more compartments of the dispenser to provide a soapy and/or disinfectant solution or mixture. The reservoir dispenser 120 includes reservoir dispenser switch 124, which is configured to operate one or more reservoir dispenser valves or openings (not shown) for controlling water flow from the control unit and/or from reservoir dispenser outlet 125.

Once mixed, the solution or mixture in the one or more compartments of the reservoir dispenser 120 can be transferred through the reservoir dispenser outlet 125 to the nozzle assembly 101 via water tube 107*a*, 107*b*, or 107*c* (see FIG. 9), and provide the solution or mixture for washing and cleaning the nozzle assembly and shield gate.

Also shown in this figure is a plurality of tabs with openings 126, which can be used as a securing mechanism for securing the control unit and reservoir dispenser to the body of the apparatus using screws, bolts, snaps, and the like.

Figure 12:
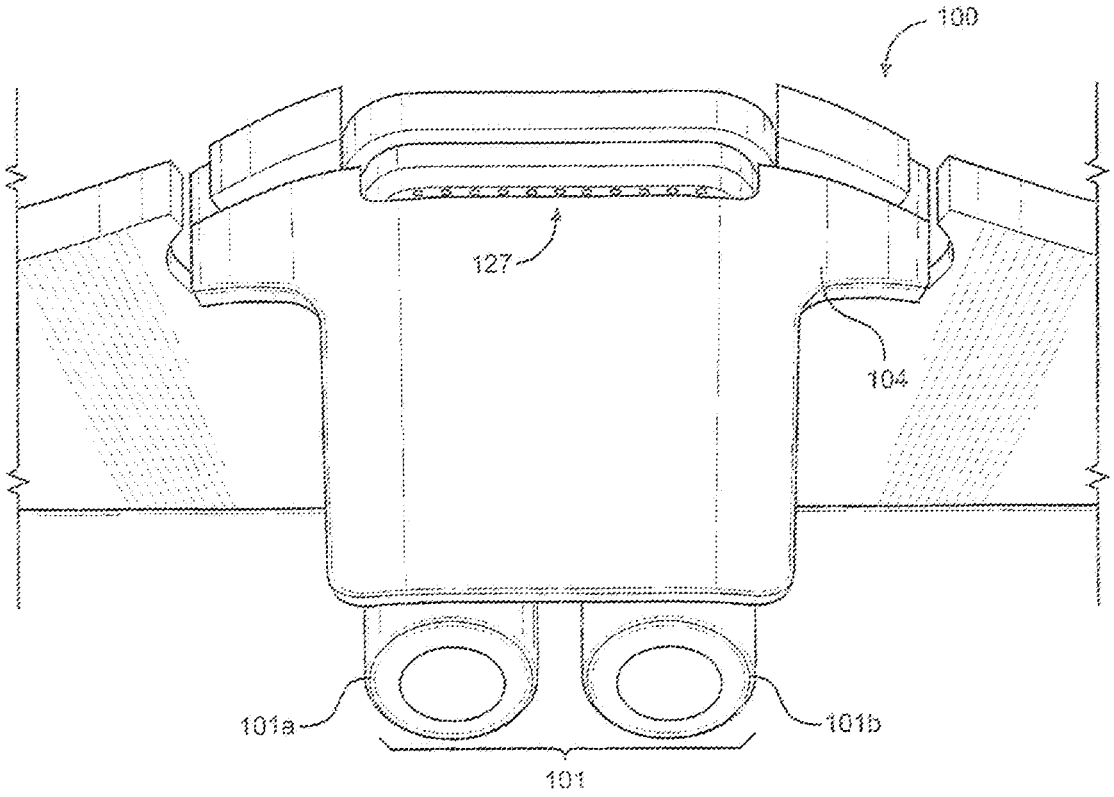
FIG. 12 illustrates a cut-away view of an embodiment of a bottom view of a bidet washing apparatus, showing nozzle assembly including washing nozzles and a shield gate.

FIG. 12 illustrates a cut-away view of an embodiment of a bottom view of a bidet washing apparatus 100, showing nozzle assembly 101 including washing nozzles 101*a* and 101*b*, and protective shield gate 104. This figure also illustrates one or more water openings 127 located above the nozzle assembly, which allow the solution or mixture transferred through water tube 107*a*, 107*b*, or 107*c* to wash and/or clean the nozzle assembly and shield gate.

Figure 13A:
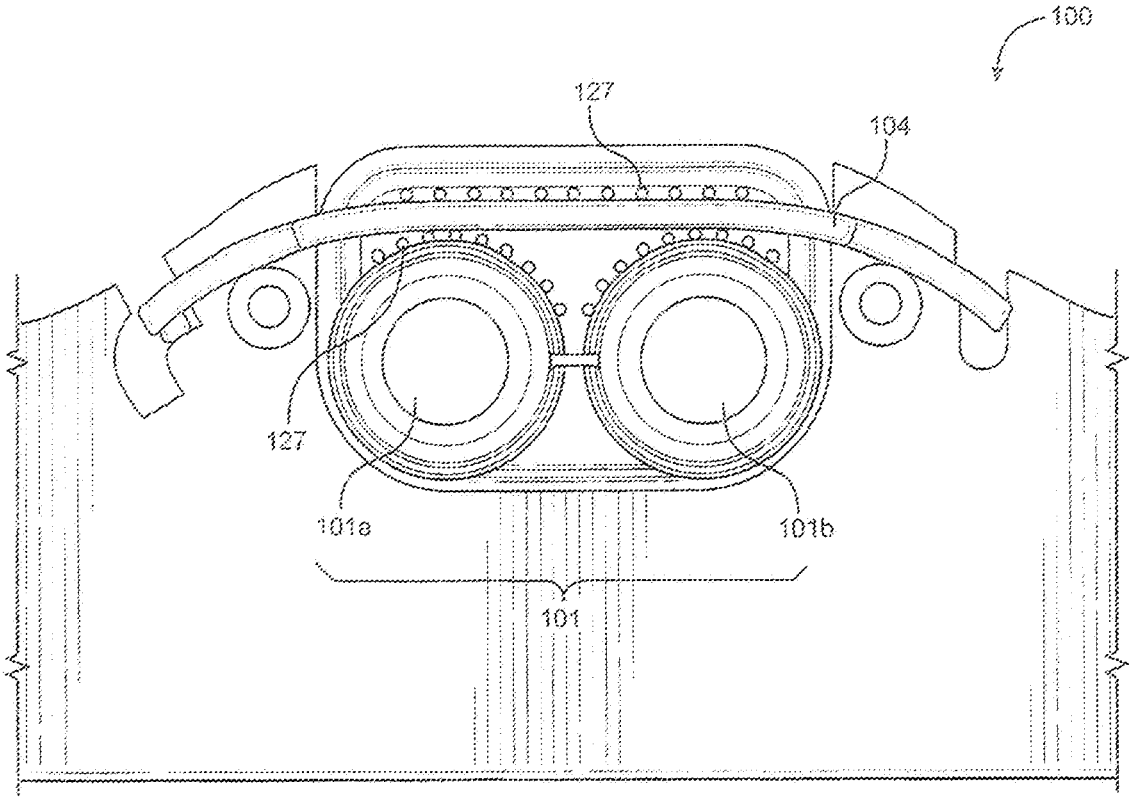
FIGS. 13*a* and 13*b* illustrate a cut-away view of an embodiment of a bottom view of the nozzle assembly, washing nozzles, and the one or more openings with and without a shield gate.
Figure 13B:
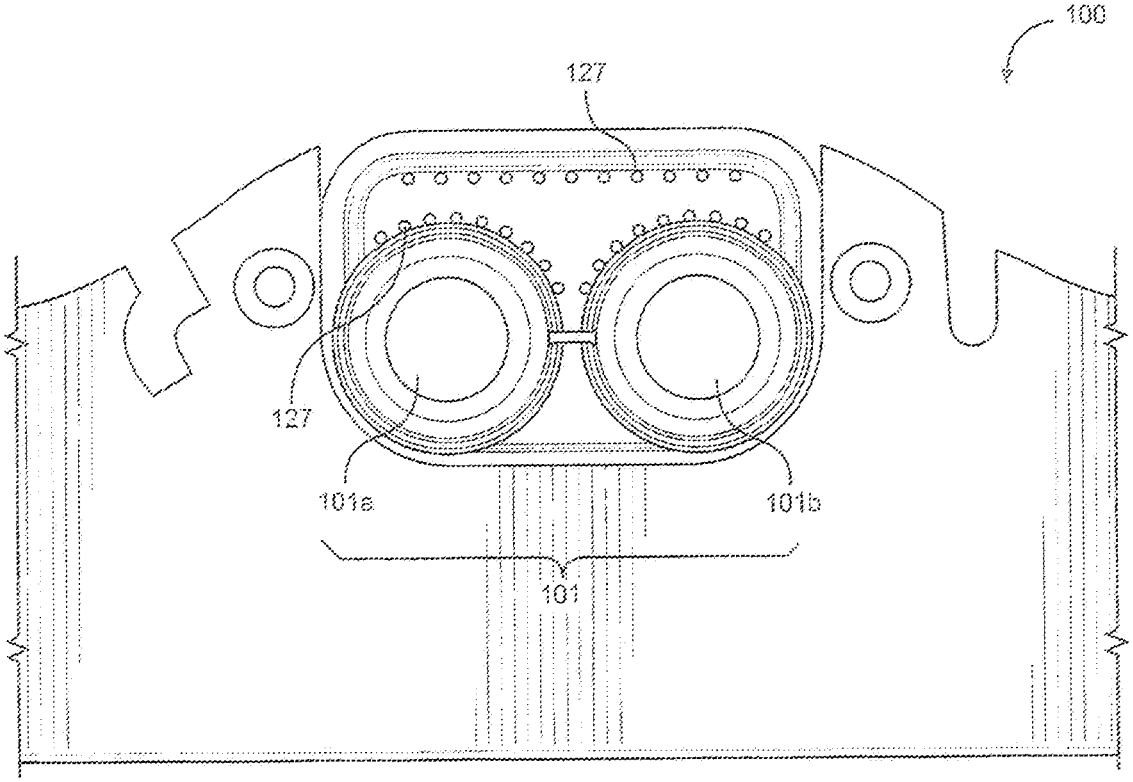

FIGS. 13*a* and 13*b* illustrate a cut-away view of an embodiment of a bottom view of the nozzle assembly 101, washing nozzles 101*a* and 101*b*, and the one or more water openings 127 with and without the protective shield gate 104, respectively. As shown in these figures, one or more openings can be configured to wash one or both sides of the shield gate.

Figure 14:
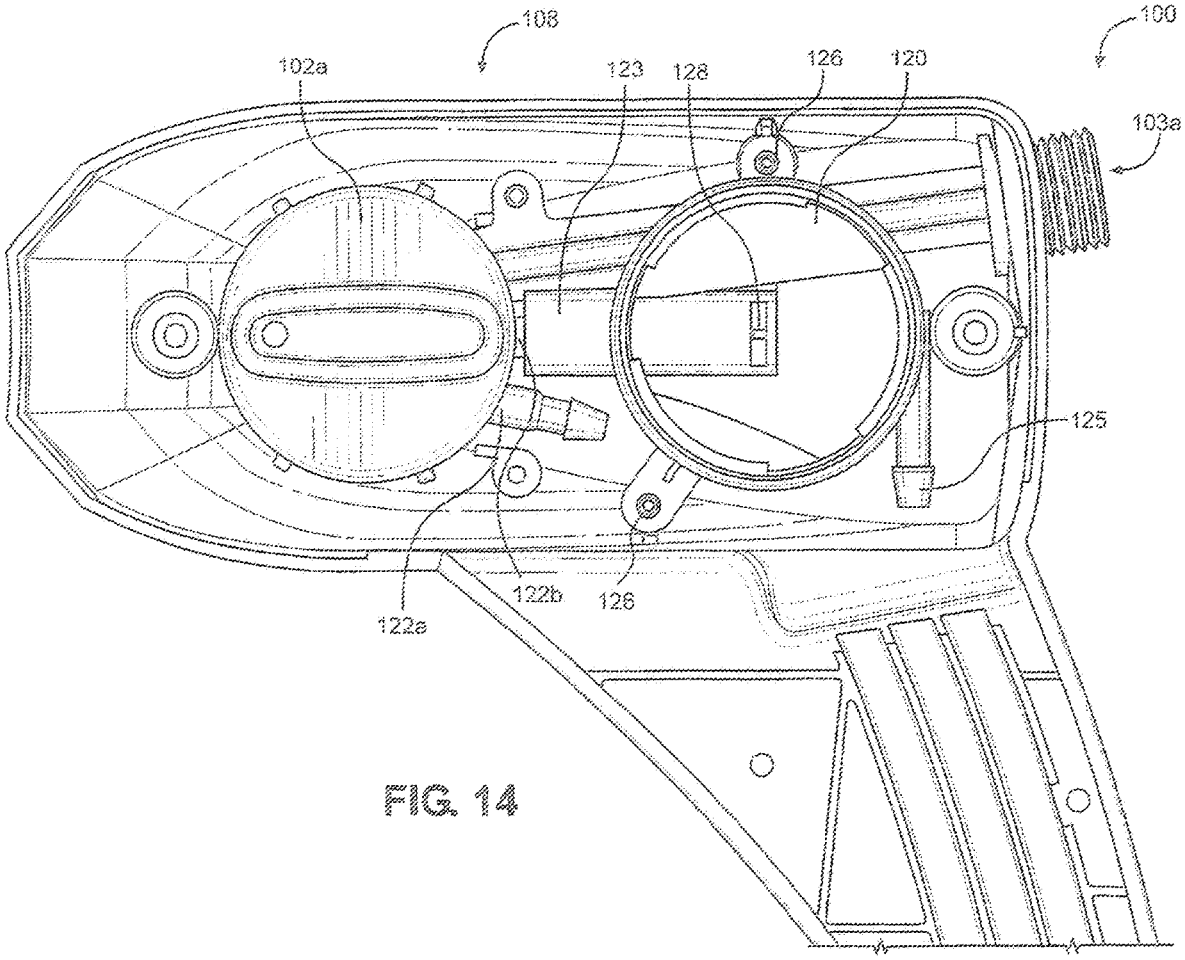
FIG. 14 illustrates a cut-away view of an embodiment of a top view of a bidet washing apparatus, showing a one compartment reservoir dispenser with the lid removed.

FIG. 14 illustrates a cut-away view of an embodiment of a top view of a bidet washing apparatus 100, showing a one compartment reservoir dispenser 120 with the lid removed.

As shown, inside the reservoir dispenser 120 is an opening 128 in the reservoir dispenser inlet 123, which allows for the flow of water from the control unit switch 102*a* into the compartment of the reservoir dispenser.

Also shown in this figure are the water inlet 103*a*, control unit 108, control unit outlets 122*a* and 122*b*, reservoir dispenser inlet 123 reservoir dispenser outlet 125, and securing mechanisms 126.

Figure 15:
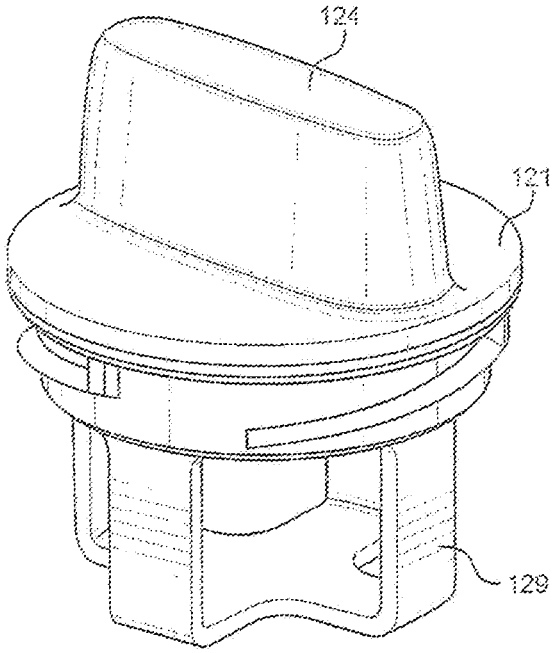
FIG. 15 illustrates a view of the lid, which can be removably attached to the reservoir dispenser.

FIG. 15 illustrates a view of lid 121, which can be removably attached to the reservoir dispenser. The lid 121 can include the reservoir dispenser switch 124 and a lower securing gate 129 for securing cleaning and/or disinfection materials in solid or tablet form. Alternatively, the lower securing gate can include one or more filters or screens for securing the cleaning material, which can allow water to flow over the cleaning and/or disinfection materials to provide the desired solution.

The reservoir dispenser and lid can be of any type of complementary securing device to make up the dispenser, e.g. a threaded dispenser and screw-on lid, a dispenser with a snap-on lid, etc. In addition, the dispenser and or lid can include one or more washers or O-rings (not shown), or any other similar type of device for securing a water-tight seal between the dispenser and lid.

Figure 16:
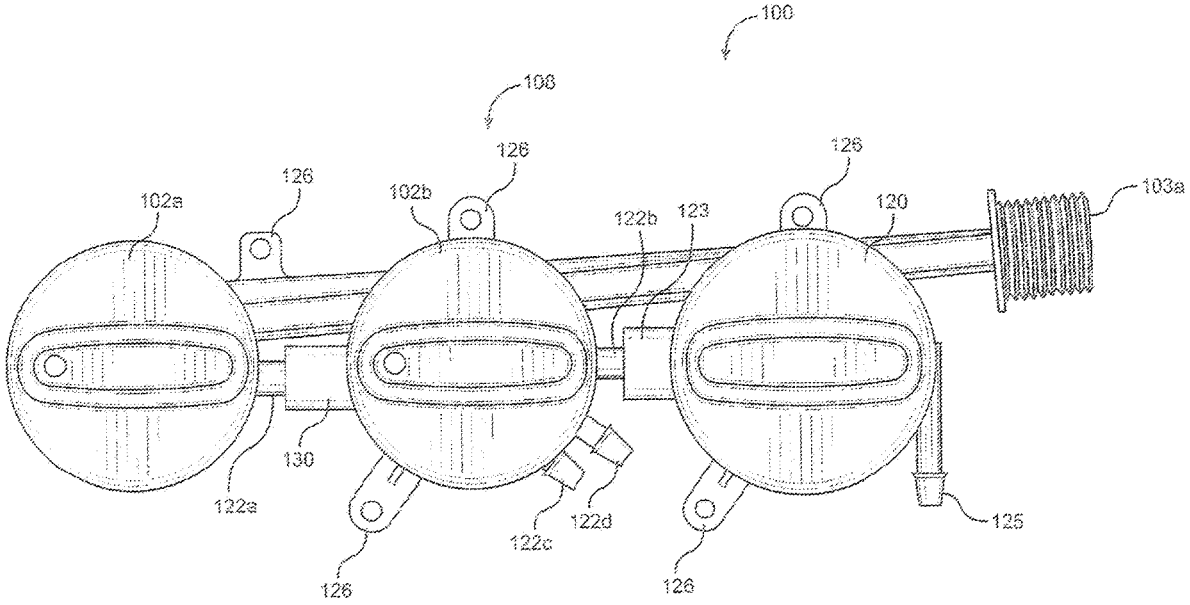
FIG. 16 illustrates a cut-away view of an embodiment of a bidet washing apparatus with a reservoir dispenser and, a removable lid.

FIG. 16 illustrates a cut-away view of an embodiment of a bidet washing apparatus 100 with a reservoir dispenser 120 and a removable lid 121. In this figure, the apparatus includes water inlet 103*a* connected to control unit 108 having control switch 102*a*. The first control switch can act as an on/off switch for the incoming and outgoing water. In the on position, water can be transferred from the first control switch to control switch 102*b* via control unit outlet 122*a* and control unit inlet 130. The control switch 102*b* includes two water outlets 122*c* and 122*d* for transferring water to the nozzle assembly 101 via water tubes 107*a*, 107*b*, or 107*c*. The control switch 102*b* also includes a water outlet 122*b* (not shown) for transferring water to the reservoir dispenser 120 via reservoir dispenser inlet 123. Ultimately, the resulting solution or mixture in the reservoir dispenser can be transferred, to nozzle assembly 101 for cleaning purposes via reservoir dispenser outlet 125 and water tube 107*a*, 107*b*, or 107*c* (not shown).

Figure 17:
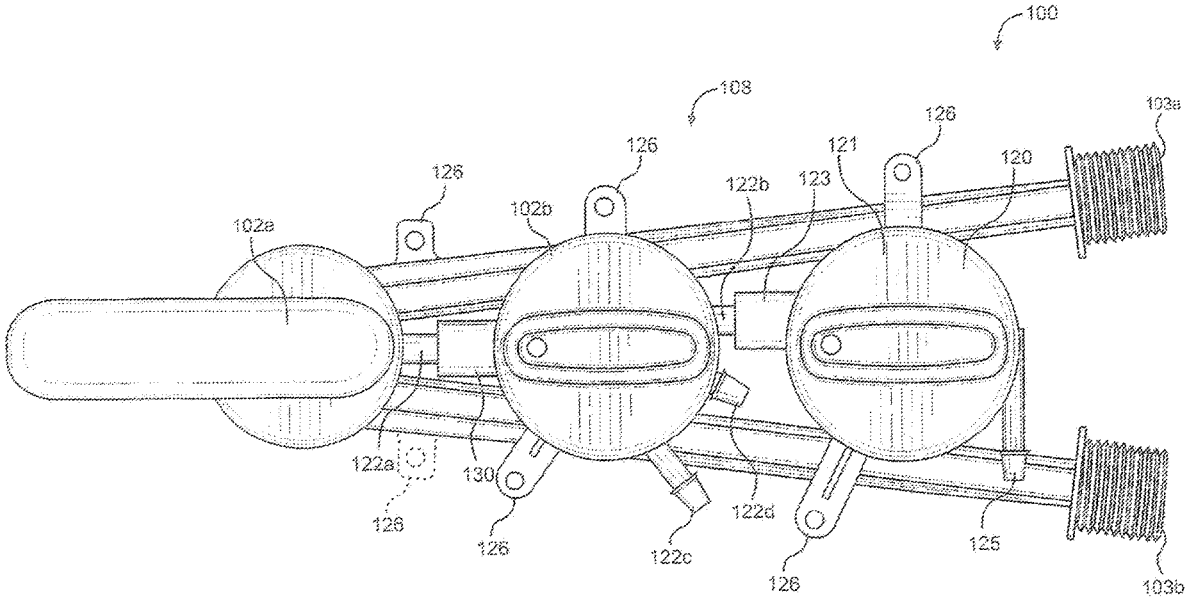
FIG. 17 illustrates a cut-away view of an embodiment of a bidet washing apparatus with a reservoir dispenser and a removable lid.

FIG. 17 illustrates a cut-away view of an embodiment of a bidet washing apparatus 100 with a reservoir dispenser 120 and a removable lid 121. In this figure, the apparatus includes separate water inlets 103*a* and 103*b*, which can be used for transporting cold and/or hot water to the control switch 102*a*. The apparatus also includes water inlet 103*a* connected to control unit 108 having control switch 102*a*, which can be configured as a handle or lever. As before, the first control switch can act as an on/off switch for the incoming and outgoing water. In the on position, water can be transferred from the first control switch to control switch 102*b* via water outlet 127*a* and water inlet 130. The control switch 102*b* includes two water outlets 122*c* and 122*d* for transferring water to the nozzle assembly 101 via water tubes 107*a*, 107*b*, or 107*c*. The control switch 102*b* also includes a water outlet 122*b* (not shown) for transferring water to the reservoir dispenser 120 via reservoir dispenser inlet 123. Ultimately, the resulting solution or mixture in the reservoir dispenser can be transferred to nozzle assembly 101 for cleaning purposes via reservoir dispenser outlet 125 and water tube 107*a*, 107*b*, or 107*c* (not shown).

Figure 18:
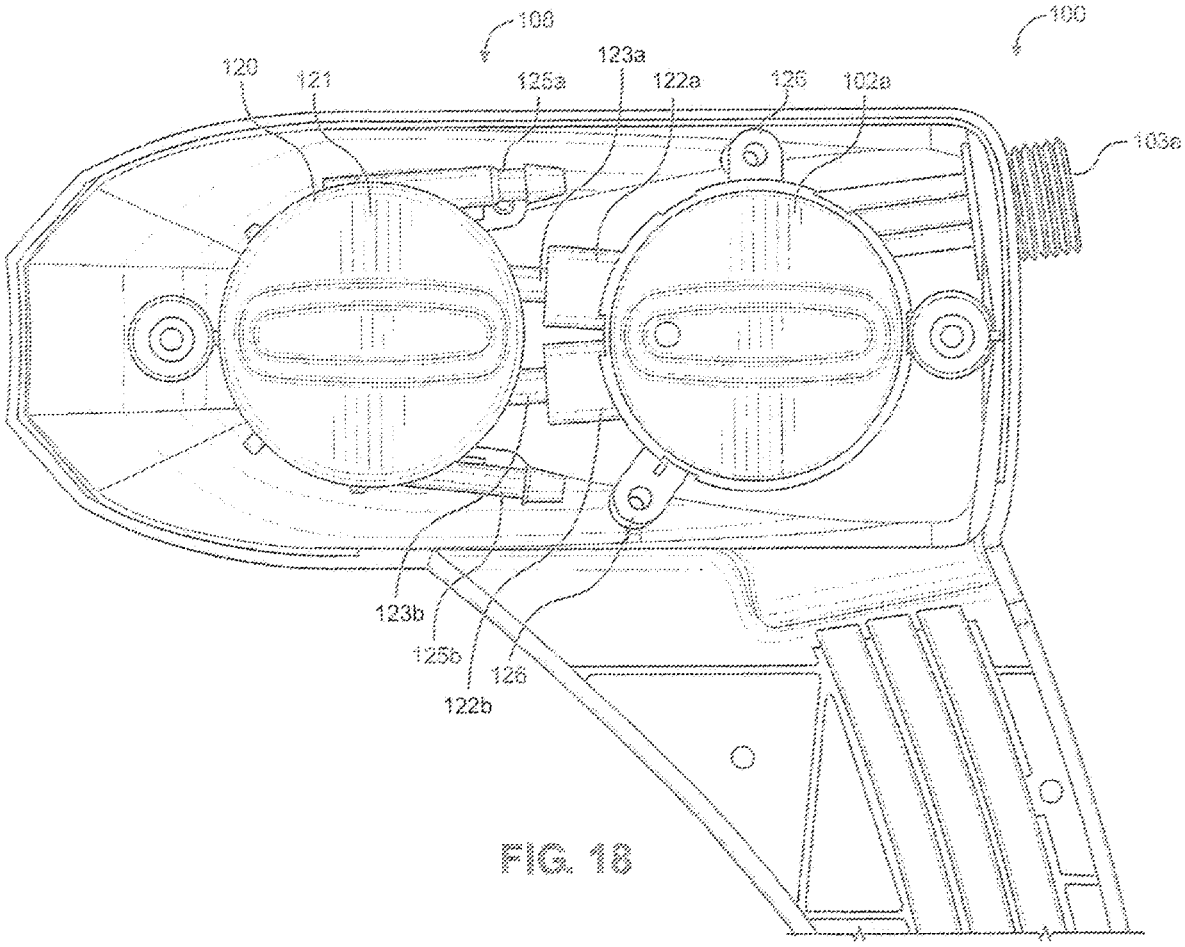
FIG. 18 illustrates, a cut-away view of an embodiment of a bidet washing apparatus with a reservoir dispenser and a removable lid.

FIG. 18 illustrates a cut-away view of an embodiment of a bidet washing apparatus 100 with, a reservoir dispenser 120 and a removable lid 121. In this figure, the apparatus includes water inlet 103*a* or 103*b* connected to control unit 108 with control switch 102*a*. In the on position, water can be independently transferred from control unit 108 to the reservoir dispenser 120 via first water outlets 122*a* and 122*b* (now shown) and reservoir dispenser inlets 123*a* and 123*b*, respectively. Here, the reservoir dispenser 120 includes two separate compartments 120*a* and 120*b* (see, FIG. 19), in which each compartment can independently contain soap and/or disinfectant. The resulting solution and mixture in each of these compartments can be transferred to nozzle assembly 101 for cleaning purposes via the reservoir dispenser switch 124, reservoir dispenser outlets 125*a* and 125*b*, and water tubes 107*c* and 107*d* (not shown), respectively.

Figure 19:
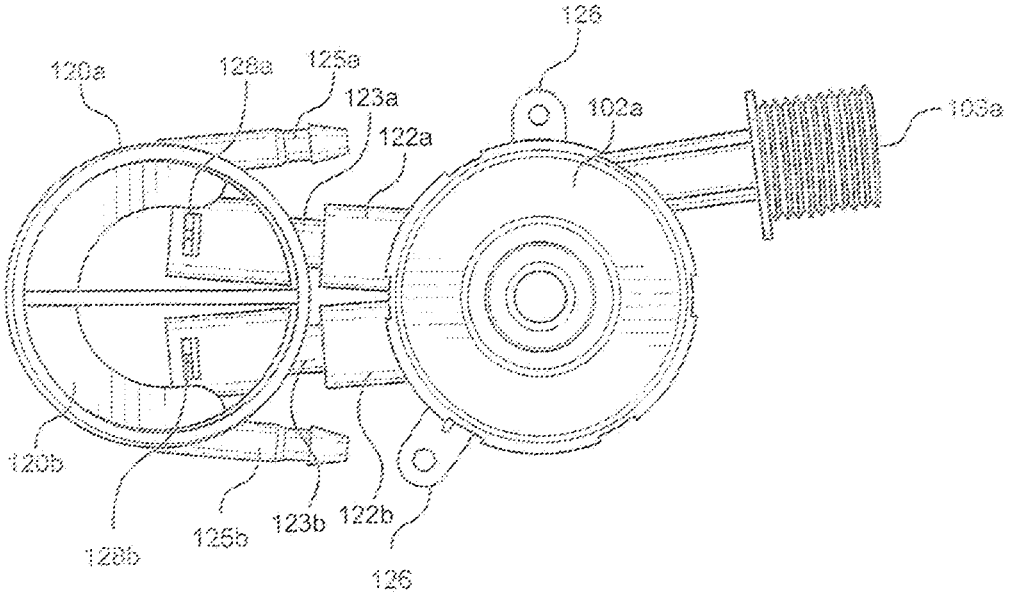
FIG. 19 illustrates a cut-away view of an embodiment of a bidet washing apparatus with a reservoir dispenser without the removable lid.

FIG. 19 illustrates a cut-away view of an embodiment of a bidet washing apparatus 100 with a reservoir dispenser 120 the removable lid removed. In this figure, the apparatus includes water inlet 103*a* or 103*b* connected to control unit 108 with control switch 102*a*, in the on position, water can be independently transferred from control unit 108 to the reservoir dispenser 120 via first water outlets 122*a* and 122*b* (now shown) and reservoir dispenser inlets 123*a* and 123*b*, respectively. Here, the reservoir dispenser 120 includes two separate compartments 121*a* and 121*b*, in which each compartment can independently contain soap and/or disinfectant. The resulting solution or mixture in each of these compartments can be transferred to nozzle assembly 101 for cleaning purposes via the reservoir dispenser switch 124, reservoir dispenser outlets 125*a* and 125*b*, and water tubes 107*e* and 107*d* (not shown), respectively.

Figure 20:
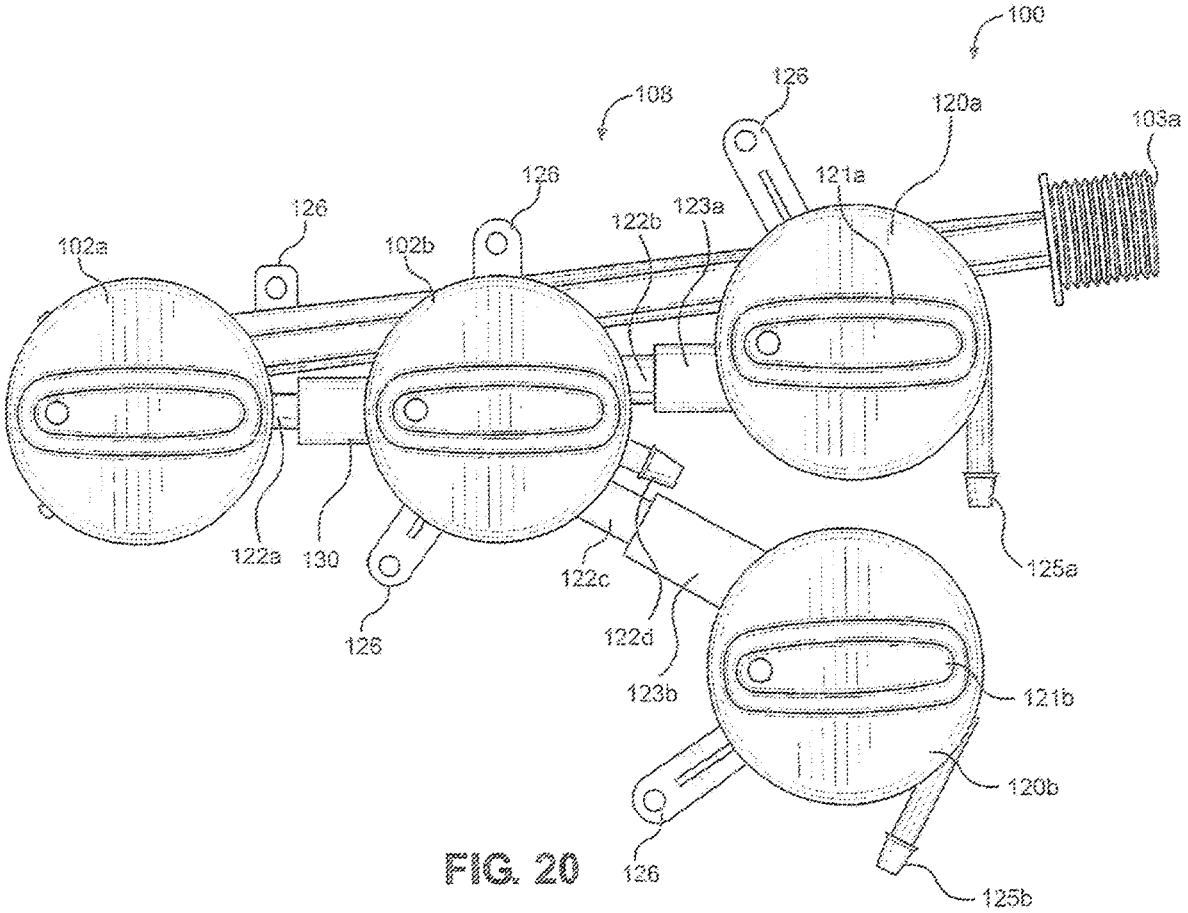
FIG. 20 illustrates a cut-away view of an embodiment of a bidet washing apparatus with two reservoir dispensers with removable lids.

FIG. 20 illustrates a cut-away view of an embodiment of a bidet washing apparatus 100 with reservoir dispensers 120*a* and 120*b* with a removable lid 122*a* and 120*b*, respectively. In this figure, the apparatus includes water inlet 103*a* connected to control unit 108 with control switch 102*a*. Control switch 102*a* can act as an on/off switch for the incoming and outgoing water. In the on position, water can be transferred from control switch 102*a* to control switch 102*b* via water outlet 122*a* and water inlet 130. The control switch 102*b* includes water outlet 122*b* for transferring water to the reservoir dispenser 120 via reservoir dispenser inlet 123*a*. The control switch 102*b* further includes water outlet 122*c* liar transferring water to the reservoir dispenser 120*b* via reservoir dispenser inlet 123*b*. Ultimately, the resulting solution or mixture in the reservoir dispensers can be transferred to nozzle assembly 101 for cleaning purposes via reservoir dispenser outlets 125*a* and/or 125*d*. Finally, the control switch 102*b* also includes water outlet 122*d*, which can transfer water to the nozzle assembly directly.

Figure 21:
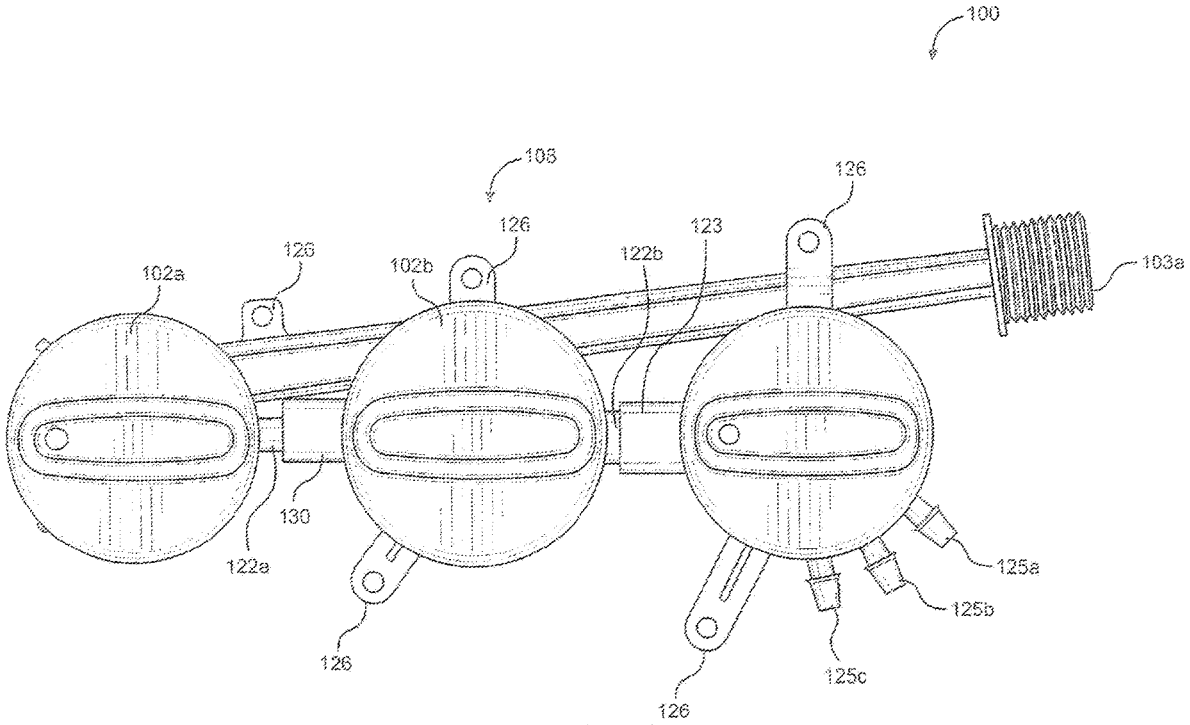
FIG. 21 illustrates a cut-away view of an embodiment of a bidet washing apparatus with a reservoir dispenser with a removable lid.

FIG. 21 illustrates a cut-away view of an embodiment of a bidet washing apparatus 100 with a reservoir dispenser 120 with a removable lid 121. In this figure, the apparatus includes water inlet 103*a* connected to control unit 108 with control switch 102*a*. Control switch 102*a* can act as an on/off switch for the incoming and outgoing water. In the on position, water can be transferred from control switch 102*a* to control switch 102*b* via water outlet 122*a* and water inlet 130. The control switch 102*b* includes water outlet 122*b* for transferring water to the reservoir dispenser 120 via reservoir dispenser inlet 123. Ultimately, the resulting solution or mixture in the reservoir dispenser can be transferred to nozzle assembly 101 for cleaning purposes via reservoir dispenser outlets 125*a*, 125*b*, and/or 125*c*.

Figure 22:
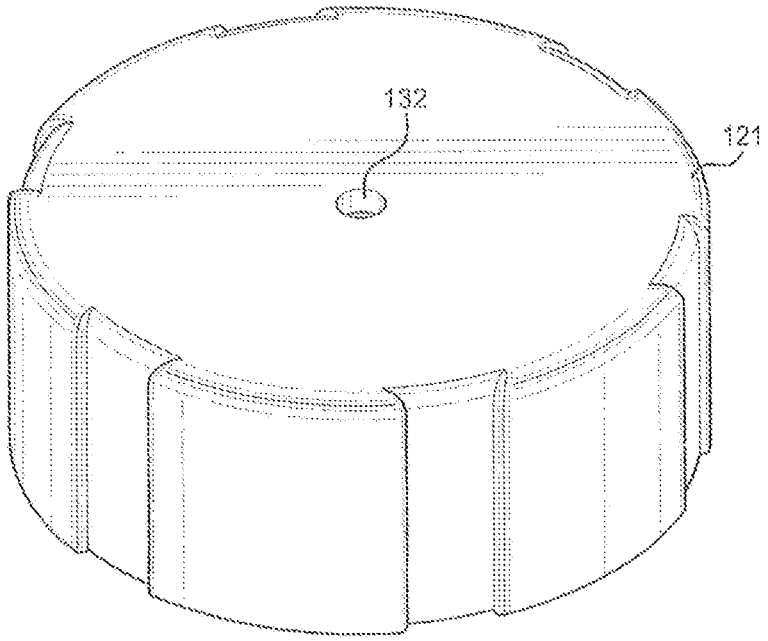
FIG. 22 illustrates an embodiment of a reservoir dispenser lid with a built-in check valve and air vent for securing the reservoir dispenser of a bidet washing apparatus.

FIG. 22 illustrates an embodiment of a reservoir dispenser lid with a built-in check valve system 131 and air vent 132 for securing the reservoir dispenser of a bidet washing apparatus.

A check valve (clack valve, non-return valve, reflux valve, retention valve, or a one-way valve) is a valve that normally allows fluid to flow through it in only one direction. Check valves are two-port valves, meaning they have two openings in the body, one for air or fluid to enter and the other for air or fluid to leave. Check valves work automatically and are not controlled by a person or any external control; accordingly, most check valves do not have any valve handle or stem. The bodies (external shells) of most check valves are typically made of plastic or metal but can be made of any suitable material.

A reservoir dispenser lid with a built-in check valve allows the reservoir dispenser system described herein to vent when the bidet washing apparatus is not in use. A check valve allows the flow of air or liquid in one direction but not in the other direction. In this case, the lid allows air into the lid (venting the disinfectant/soap reservoir) when the bidet is not in use. When the bidet is in use, the reservoir will be pressurized with water, but no liquid can flow out of the lid. This allows the water-filled in the disinfectant/soap reservoir to be flushed out at the end of each use. It is necessary to flush the water in the reservoir because the chemical ingredients of the disinfectant/soap can grow mold and/or dissolve if water is present in the reservoir for a prolonged period.

An important concept in check valves is the cracking pressure (unseating head pressure or opening pressure), which is the minimum differential upstream pressure inlet and at which the valve will operate. Typically, the check valve is designed for and can be specified for a specific cracking pressure. Reseal pressure (sealing pressure, seating pressure, seating head pressure, or closing pressure) refers to the pressure differential between the inlet and outlet of the valve during the closing process of the check valve, at which there is no visible leak rate. Backpressure refers to a pressure higher at the outlet of a fitting than that at the inlet or a point upstream.

A ball check valve in the open position allows forward flow and the closed position, allows the device to block reverse flow. A ball check valve is a check valve in which the closing member, the movable part to block the flow, is a ball. In some ball check valves, the ball can be spring-loaded to help keep it shut. For those designs without a spring, reverse flow is required to move the ball toward the seat and create a seal. The interior surface of the main seats of ball check valves is more or less conically tapered to guide the ball into the seat and form a positive seal when stopping reverse flow.

By contrast, a diaphragm check valve uses a flexing rubber diaphragm positioned to create a normally closed valve. Pressure on the upstream side must be greater than the pressure on the downstream side by a certain amount known as the pressure differential, for the check valve to open allowing flow. Once positive pressure stops, the diaphragm automatically flexes back to its original closed position.

Figure 23:
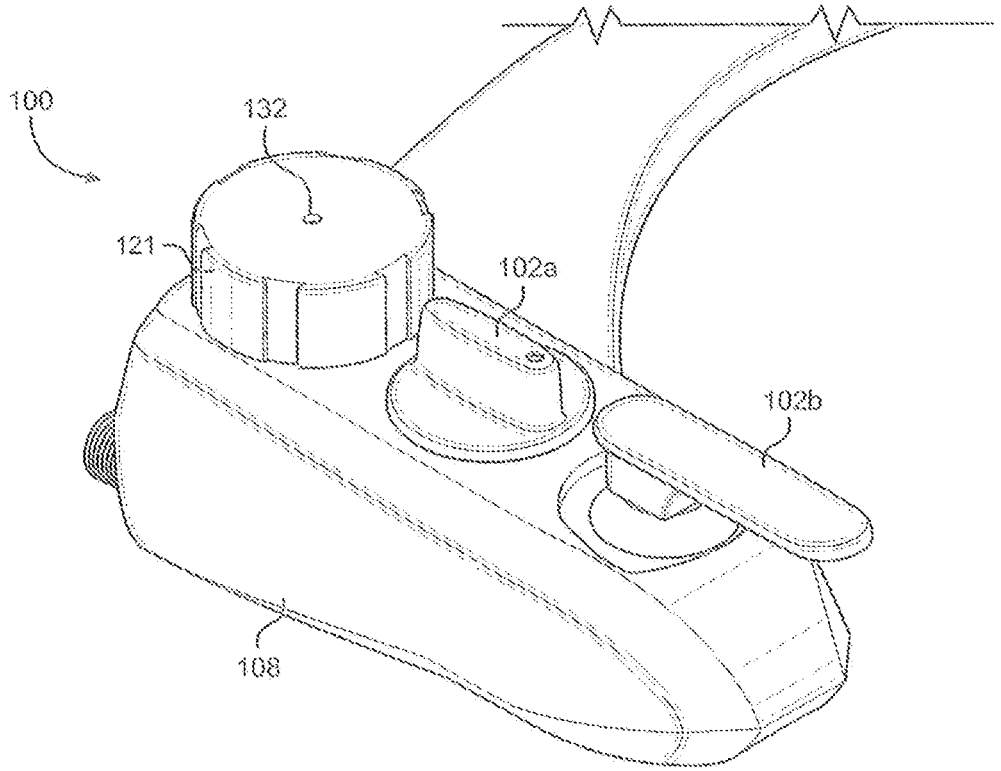
FIG. 23 illustrates an embodiment of a bidet washing apparatus having a reservoir dispenser lid with a built-in check valve and air vent for securing to the reservoir dispenser, the control unit, and control switches of a bidet washing apparatus.

FIG. 23 illustrates an embodiment of reservoir dispenser lid with a built-in check valve system 131 and air vent 132 for securing to the reservoir dispenser 120, the control unit 108, control switches 102*a* and 102*b* of a bidet washing apparatus 100. The soap container (not shown) in the reservoir dispenser can be secured within the control panel using screws. As shown, the lid with the built-in check valve system 131 can be exposed for easy removal.

Figure 24:
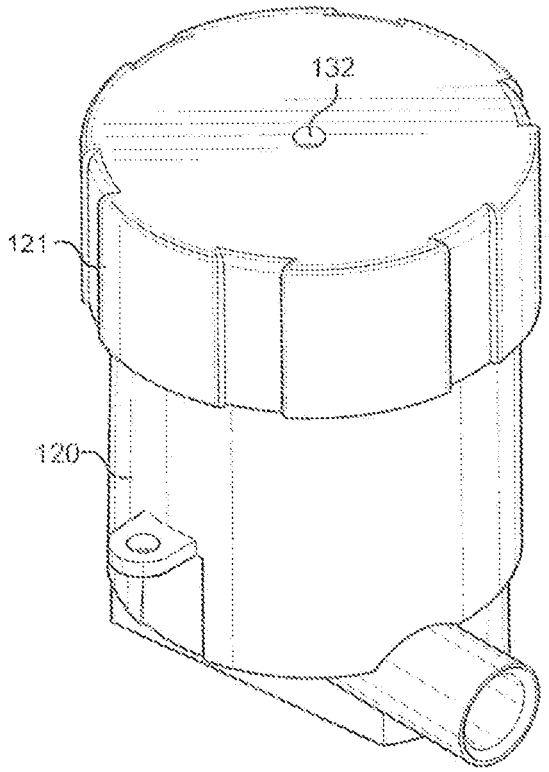
FIG. 24 illustrates an embodiment of a reservoir dispenser lid with a built-in check valve and air vent secured to the reservoir dispenser by being screwed onto or attached to the dispenser.

FIG. 24 illustrates an embodiment of a reservoir dispenser lid 121 with a built-in check valve system 131 and air vent 132 secured to the reservoir dispenser 120 by being screwed onto or attached to the dispenser, i.e., the lid and dispenser can be threaded together, and the lid and dispenser can be snapped together.

Figure 25A:
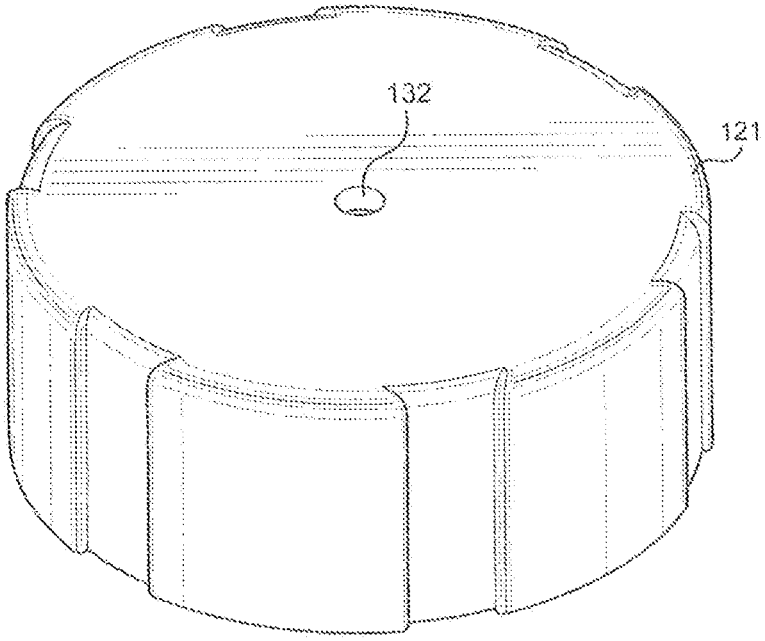
FIG. 25A illustrates an embodiment of the exterior view of the reservoir dispenser lid with a built-in check valve and air vent.
Figure 25B:
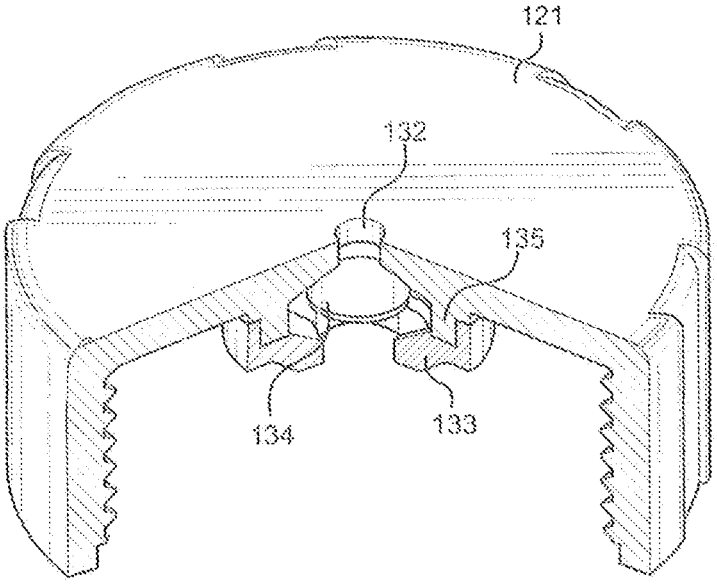
FIG. 25B illustrates an embodiment of a cut-away view of the lid and air vent.

FIG. 25A illustrates an embodiment of the exterior view of the reservoir dispenser lid 121 with a built-in check valve system 131 and air vent 132; and FIG. 25B illustrates an embodiment of a cut-away view of the reservoir dispenser lid 121 and air vent 132. As shown, the inside top of the reservoir dispenser lid 121 can include a check valve 133 and a moveable rubber disk 134, which can be secured to the reservoir dispenser lid 121 via a complementary lip 135.

Figure 26:
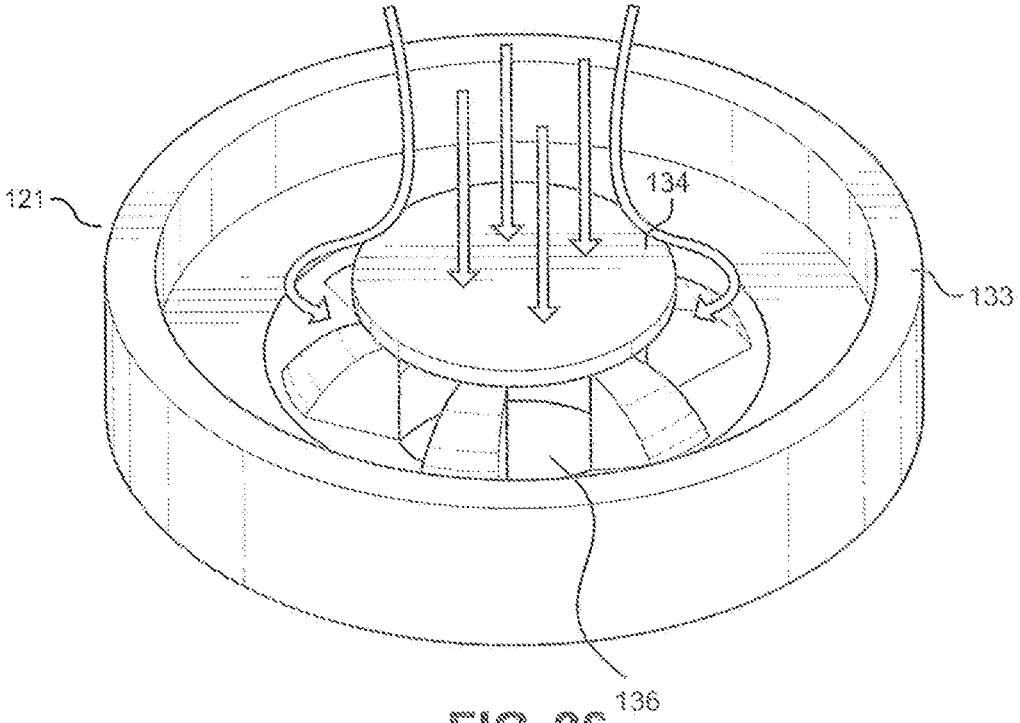
FIG. 26 illustrates an embodiment of the built-in check valve having a moveable rubber disk.

FIG. 26 illustrates an embodiment of the reservoir dispenser lid 121 with a built-in check valve 133 having moveable rubber disk 134. As shown in this figure, air can flow through the valve via air vent openings 136.

Figure 27:
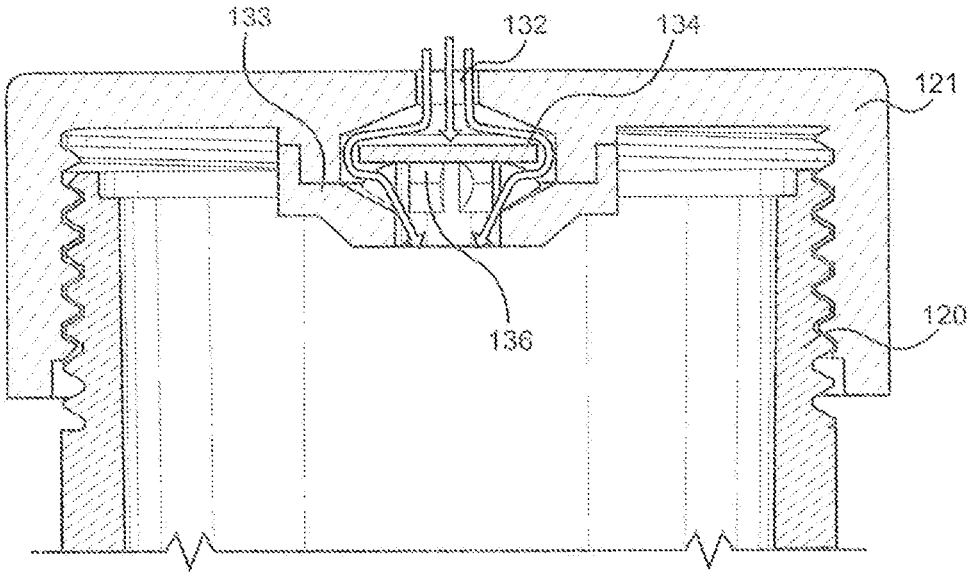
FIG. 27 illustrates an embodiment of a cut-away cross-sectional view of a reservoir dispenser lid with a built-in check valve and air vent with the valve in the opened position.

FIG. 27 illustrates an embodiment of a cut-away cross-sectional view of a reservoir dispenser lid with a built-in check valve system 131 and air vent 132. As shown, air can flow into the lid and the reservoir dispenser 120 through air vent 132 and air vent openings 136. That is the movable rubber disk 134 of the check valve 133 is in the open position, which allows air to enter the reservoir dispenser through the air vent of the lid.

Figure 28:
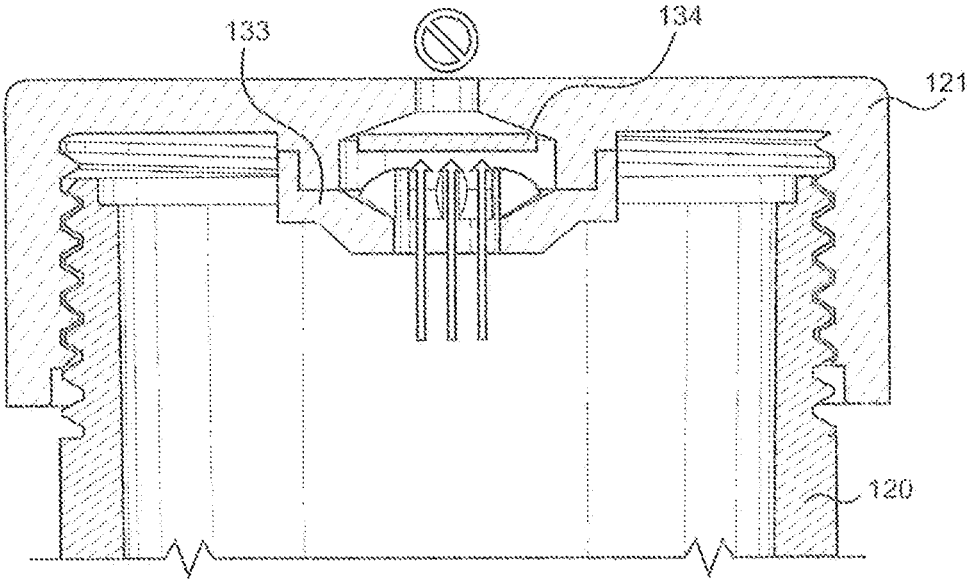
FIG. 28 illustrates an embodiment of a cut-away cross-sectional view of a reservoir dispenser lid with a built-in check valve and air vent with the valve in the closed position.

FIG. 28 illustrates an embodiment of a cut-away cross-sectional view of a reservoir dispenser lid with a built-in check valve system 131 and air vent 132. As shown, air cannot flow into the lid and, into the reservoir dispenser 120 through air vent 132 because it is blocked by the movable rubber disk 134. That is, the movable rubber disk 134 of the check valve 133 is in the closed position due to the high internal pressure of the water pushing up against the rubber disk, which prevents air from entering the reservoir dispenser through the air vent of, the lid and prevents, any liquid from escaping.

In other embodiments, the disclosure provides a reservoir dispenser for a bidet washing apparatus having a plurality of chambers, wherein a first chamber holds a liquid wash solution, and a second chamber holds water for flow through the apparatus. In these embodiments, the liquid wash solution from the first chamber can be added to the water present in the second chamber and mixed therein, in a controlled, measured manner without backflow of water into the first chamber.

It is understood by those of skill in the art that the phrase "liquid wash solution" is meant in a non-limiting sense and can include any combination of soap or detergent in a solution of water along with other additives. Additives in this type of solution can include but are not limited to disinfectants, antibacterial, anti-inflammatory, moisturizing, antiseptic, anti-fungal, germicidal, soothing, detoxifying, cooling, antipruritic, hydrating, antiviral, cleansing, cleaning, and deodorizing additives, or a combination thereof.

Figure 29:
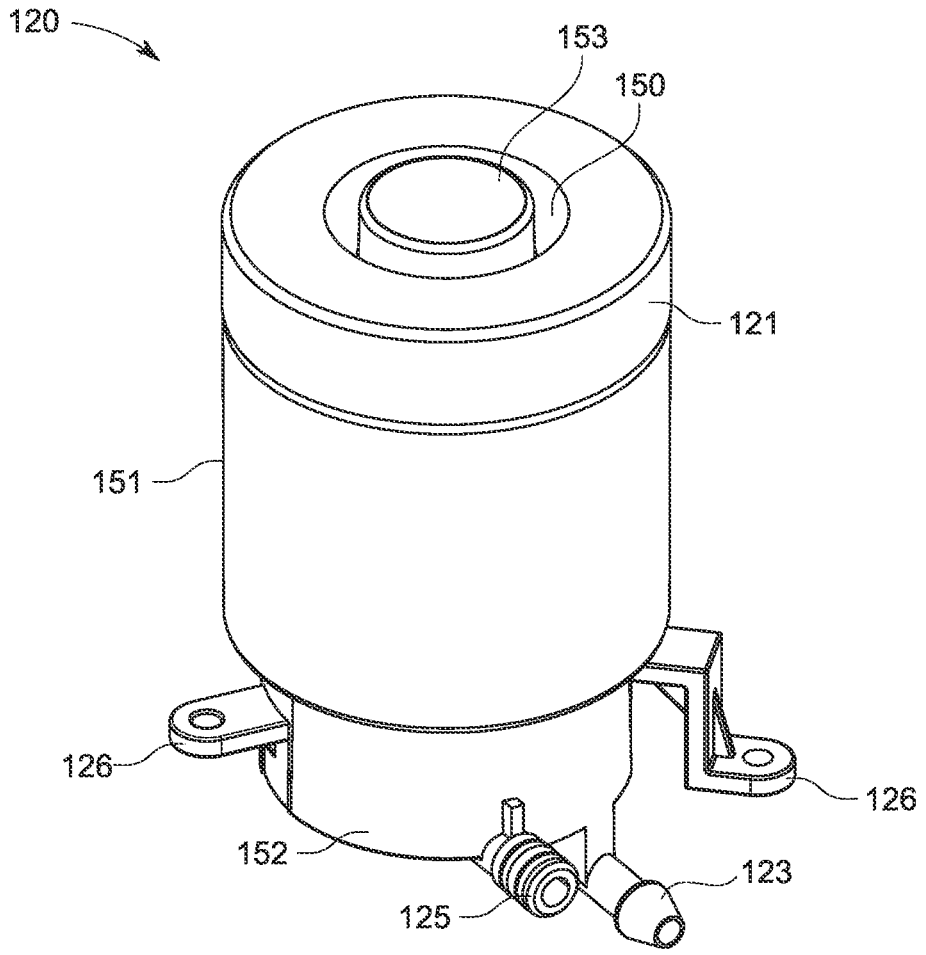
FIG. 29 illustrates an embodiment of a front view of a reservoir dispenser with a bottom check valve and a side check valve.

FIG. 29 illustrates an embodiment of such a reservoir dispenser 120, which uses a bottom check valve (not shown) between the first chamber 151 and the second chamber 152 and a side check valve (not shown) present in the first chamber for control of a liquid wash solution without backflow.

In some embodiments, the reservoir dispenser 120 can include a lid 121, which can be attached to the first chamber 151. In embodiments, the lid can be permanently or reversibly attachable to the first chamber. Included within the lid 121 is an opening 150, in which a means for activation such as an activator 153 can fill and protrude therethrough. In some embodiments, the opening 150 can be centrally located within the lid 121.

As used herein, an "activator" includes but is not limited to a push-button, twist-button, pull up and push down button, a slide button, a plunger button, a lever, a knob, or other similar devices.

In embodiments, the activator 153 can be engaged by manually pushing it downwards to allow for the introduction of the liquid wash solution present in the first chamber 151 to pass through the bottom check valve and into the second chamber 152.

Also shown in this figure is a securing mechanism or tab 126 for attaching the reservoir dispenser to a bidet washing apparatus (not shown); and a water inlet 123 and water outlet 125 for the second chamber 152, which allows water to flow into and out of the second chamber, respectively.

Figure 30:
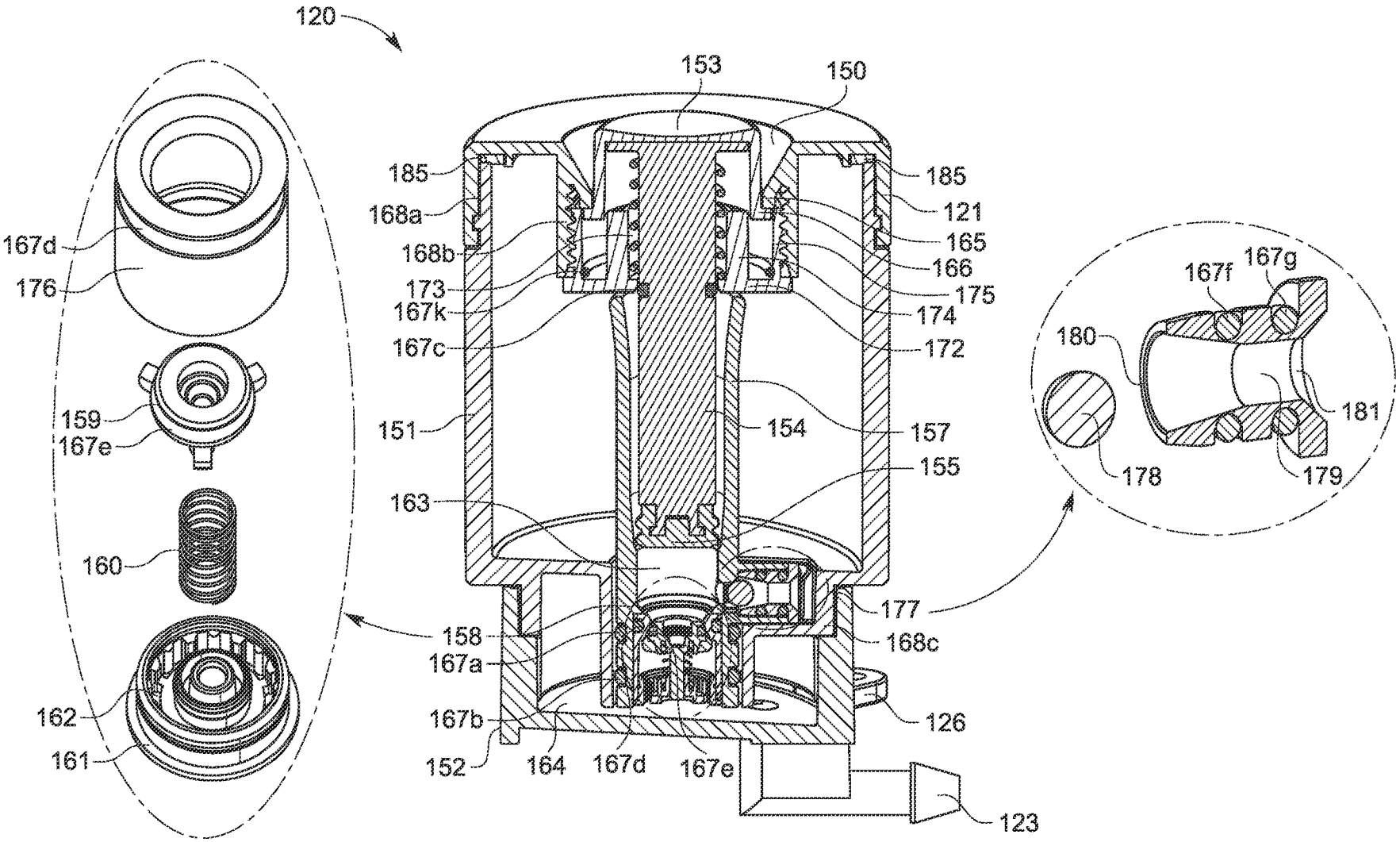
FIG. 30 illustrates an embodiment of a side cut-away view of a reservoir dispenser with a bottom check valve and a side check valve.

FIG. 30 illustrates an embodiment of a side cut-away view of the reservoir dispenser 120 as per FIG. 29. As shown in this figure, the reservoir dispenser 120 includes the first chamber 151 and the second chamber 152, wherein the first chamber extends down into the second chamber. As shown, the second chamber 152 includes a base platform 164, which can secure a hollow barrel 157 that extends from the base platform 164 in the second chamber to the base of the lid (lid base) 172 in the first chamber 151. At the lower end of the barrel in the second chamber, the barrel 157 includes two O-rings 167*a* and 167*b*, which act to seal these chambers. The activator 153 is present within the opening 150 of the lid 121 and extends down into the first chamber 151 through a stem 154 and a distal stem endpiece 155. The barrel 157 surrounds stem 154 and stem endpiece 155 and runs between the first chamber 151 and the second chamber 152. Surrounding a mid to upper region of the stem 154 is one or more O-rings 167*c*, which acts to seal the stem 154 against the lid base 172 when the activator 153 is in the inactivated position, i.e., the up position. Also shown are the water inlet 123 and the securing mechanism 126, which are connected to the second chamber 152.

As shown in this figure, lid 121 can include a lid lip 165, which surrounds the opening 150, and is designed to engage with and secure the activator 153 through a complimentary activator lip 166. The lid base 172 separates the lid 121 from the first chamber 151 and acts to support a spring 173 for resistance to the activator 153. The activator 153 and the activator lip 166 are designed to move up and down within the space between the inner wall 174 and outer wall 175 of the lid base 172.

The first chamber 151 can be reversibly connected to the lid 121 through a screw-on, threaded type mechanism 168*a*, or can be snapped on, or can be secured permanently or reversibly or by any other means known in the art. In addition, a gasket 185 can be used between the first chamber 151 and the lid 121, which prevents leakage of the liquid wash solution present in the first chamber 151.

The lid base 172 can also be reversibly connected to the lid 121 through a screw-on, threaded type mechanism 168*b*, or can be snapped on, or can be secured permanently or reversibly or by any other means known in the art.

Further, the second chamber 152 can be reversibly connected to the first chamber 151 through a screw-on, threaded type mechanism 168*c*, or can be snapped on, or can be secured permanently or reversibly or by any other means known in the art. In addition, an O-ring (not shown) can be used between the second chamber 152 and the first chamber 151, which prevents leakage of the water present in the second chamber 152.

As described herein, the bottom check valve 158 can be an inline-type check valve, which includes a check valve housing unit 176 that is surrounded by an O-ring 167*d*. Included within the housing unit is a check valve disc 159 and O-ring 167*e*, a check valve spring 160, and a check valve guide 161 having one or more openings 162 therethrough. The additional components of the bottom check valve 158 are made up of the stem endpiece 155 and inner sidewalls 163 of the barrel 157.

Also shown in this figure is the side check valve 177, which can be a ball-type check valve, and can be located on the lower side of barrel 157 in the first chamber 151. The additional components of the side check valve 177 include a ball 178, a seat 179, one or more O-rings 167*f* and 167*g*, an opening 180 into the barrel 157, and an opening 181 to the first chamber 151.

Figure 31:
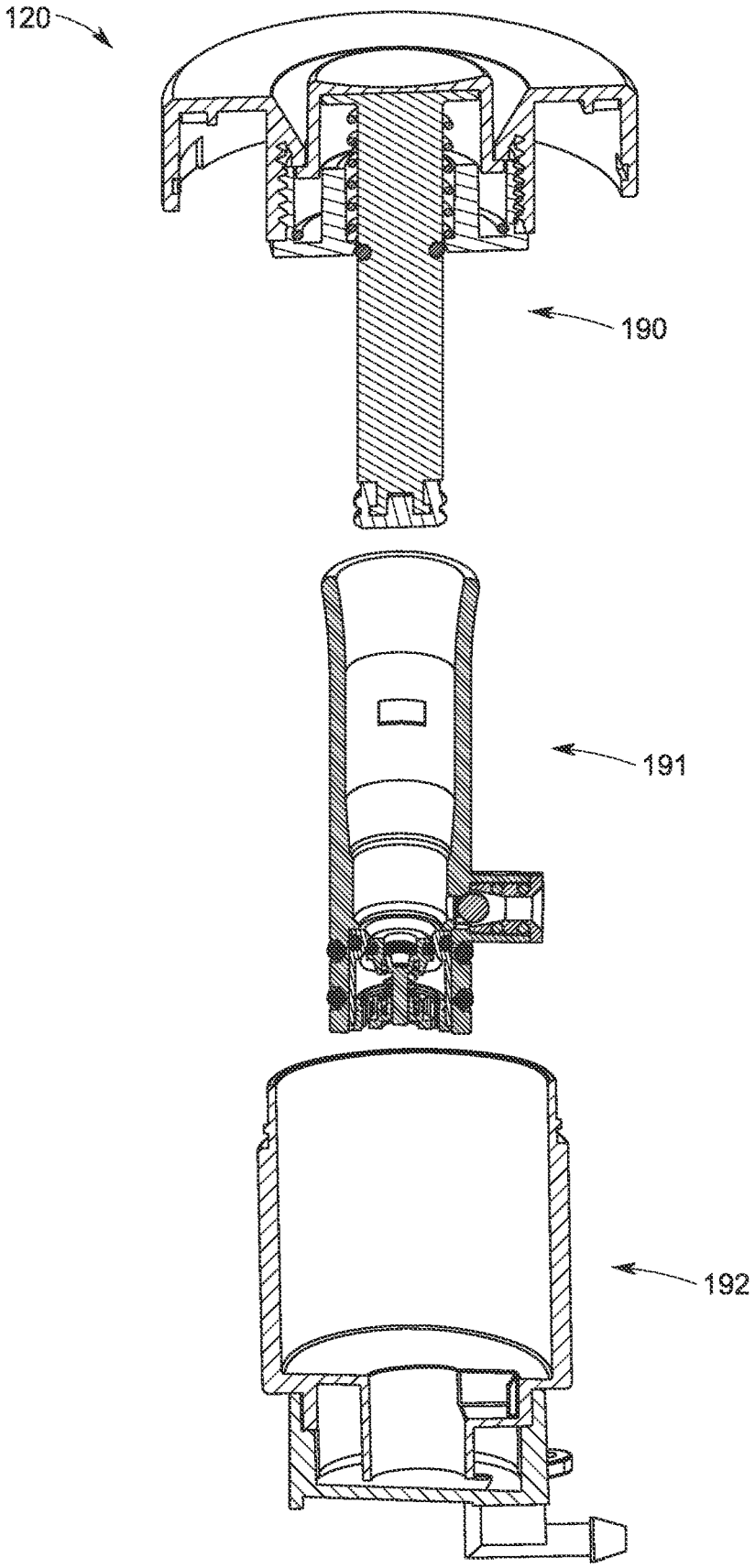
FIG. 31 illustrates an embodiment of an exploded cut-away side view of the reservoir dispenser with a bottom check valve and a side check valve.

FIG. 31 illustrates an embodiment of an exploded cut-away side view of the reservoir dispenser 120. As shown in this figure, the dispenser includes a lid assembly 190, a barrel assembly 191, and a housing assembly 192.

Figure 32:
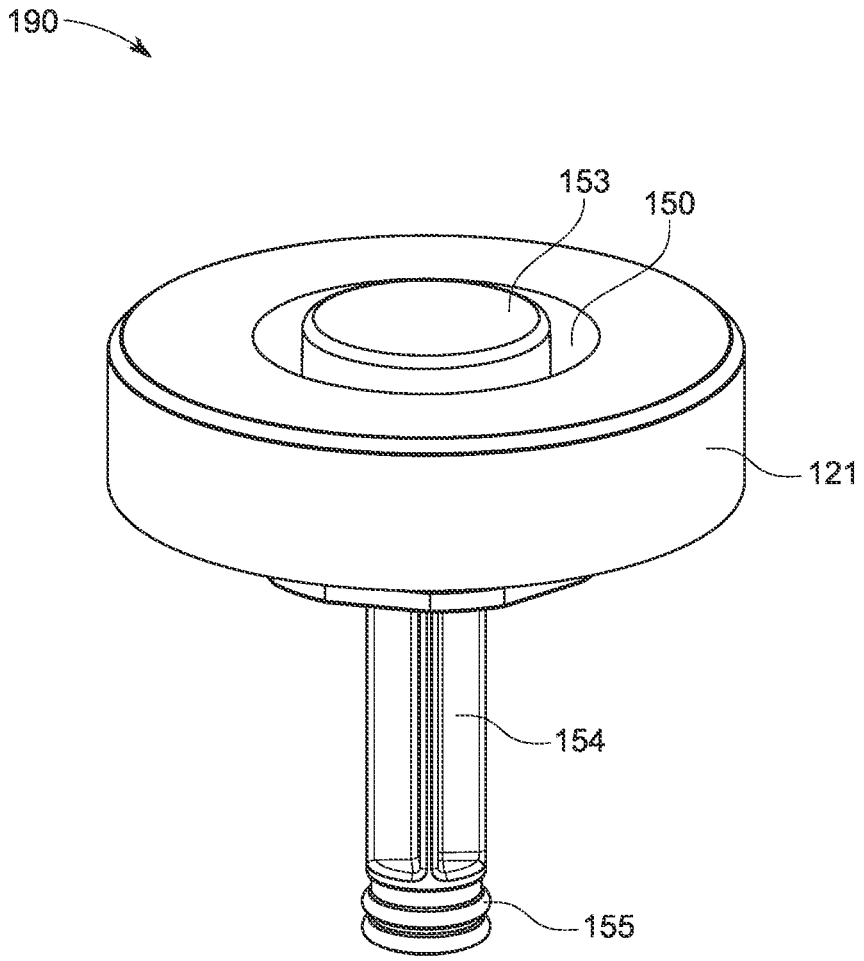
FIG. 32 illustrates an embodiment of a side view of a lid assembly for the reservoir dispenser with a bottom check valve and a side check valve.

FIG. 32 illustrates an embodiment of a side view of the lid assembly 190. As shown in this figure, assembly 190 includes the lid 121 and opening 150, activator 153, which is connected to the stem 154, and a distal stem endpiece 155.

Figure 33:
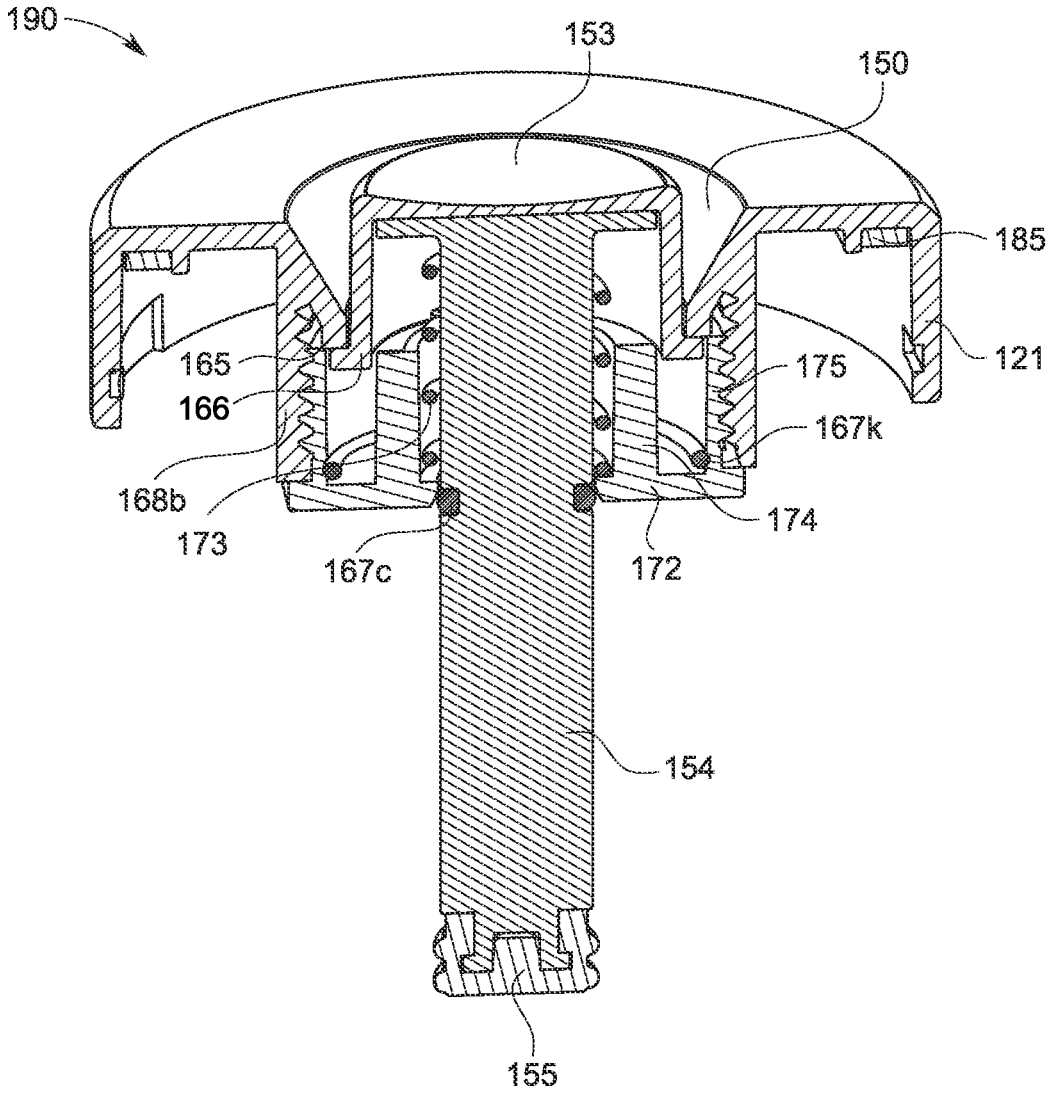
FIG. 33 illustrates an embodiment of a cut-away side view of the lid assembly for the reservoir dispenser with a bottom check valve and a side check valve.

FIG. 33 illustrates an embodiment of a cut-away side view of the lid assembly 190. As shown in this figure, the lid assembly 190 includes the lid 121 and lid opening 150, and the activator 153. The lid 121 includes a lid base 172, which separates the lid 121 from the first chamber 151 (not shown) and acts to support the spring 173 for resistance of the activator 153. In embodiments, the activator 153 includes the stem 154 and the distal stem endpiece 155. Surrounding the stem 154 is one or more O-rings 167*c*, which acts to seal the stem against the lid base 172 when the activator 153 is in the inactivated position. As shown in this figure, the activator 153, including the activator lip 166, is designed to move up and down within the inner wall 174 and the outer wall 175 of the lid base 172. Also, the outer wall 175 of the lid base 172 can be reversibly connected to the lid 121 through a screw-on, threaded type mechanism 168, or can be snapped on, or can be secured permanently or reversibly by any other means known in the art.

Figure 34:
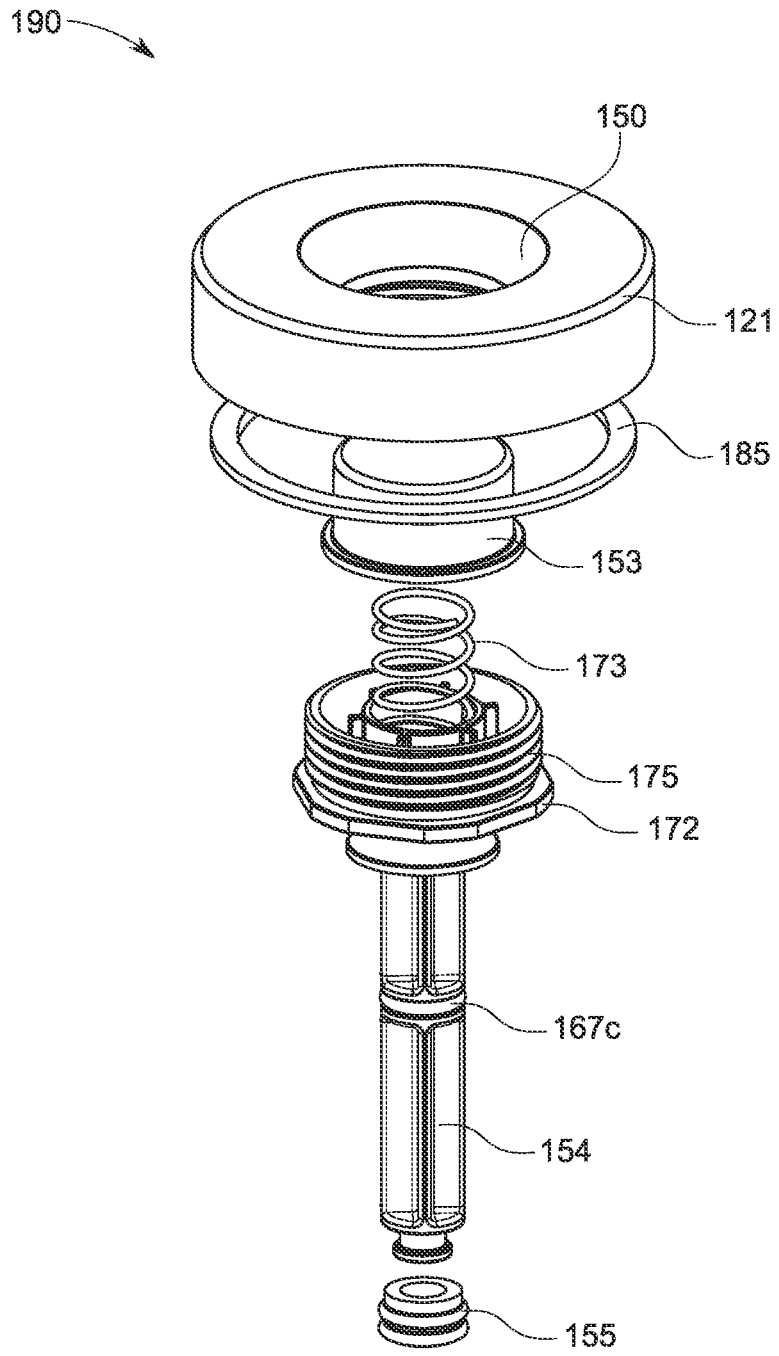
FIG. 34 illustrates an embodiment of an exploded view of the lid assembly for the reservoir dispenser with a bottom check valve and a side check valve.

FIG. 34 illustrates an embodiment of an exploded view of the lid assembly 190. As shown in this figure, assembly 190 includes the lid 121 and opening 150, a gasket 185, the activator 153, spring 173, lid base 172, stem 154, O-ring 167*c*, and the stem endpiece 155.

Figure 35:
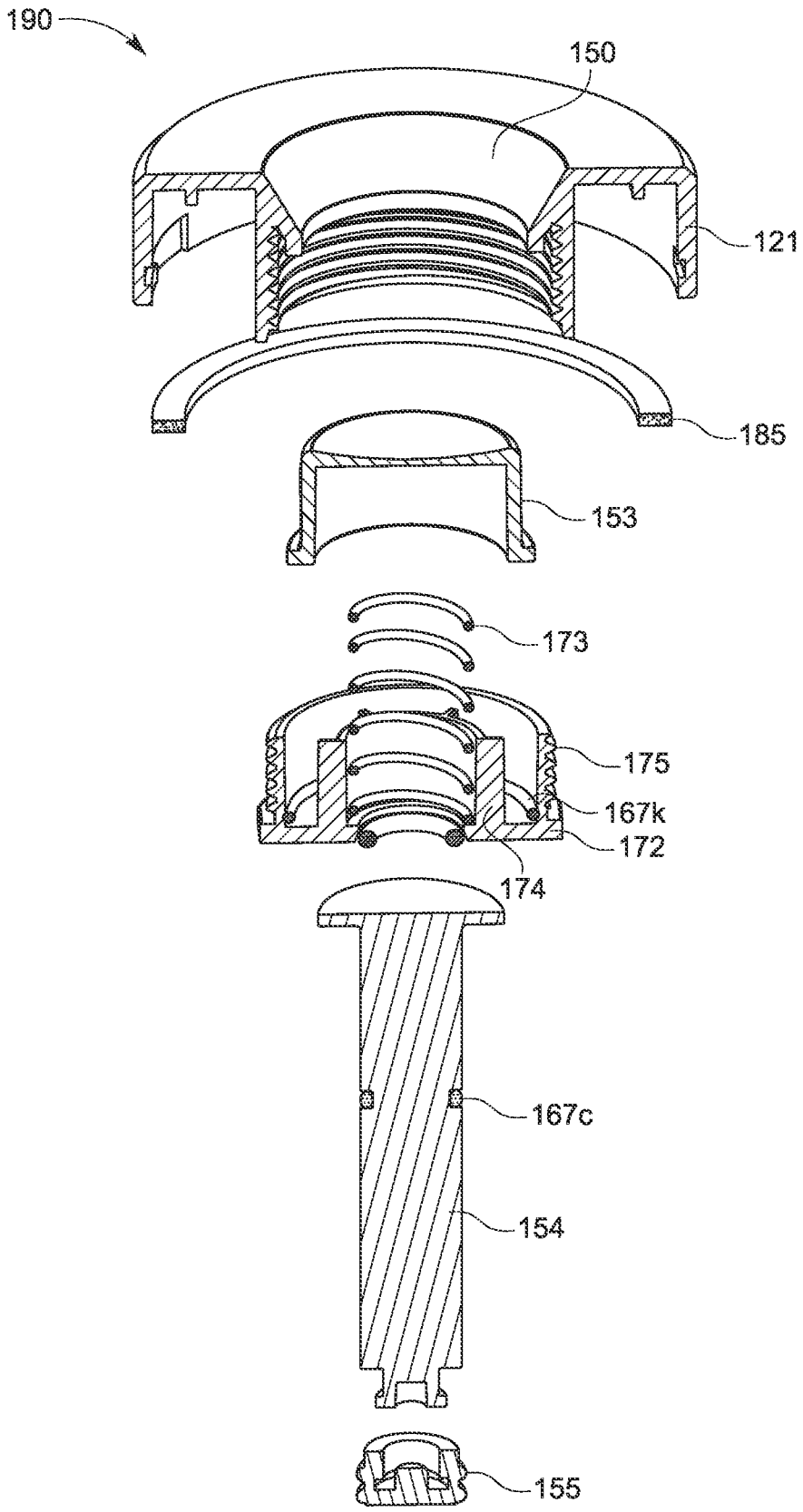
FIG. 35 illustrates an embodiment of an exploded cut-away side view of the lid assembly for the reservoir dispenser with a bottom check valve and a side check valve.

FIG. 35 illustrates an embodiment of an exploded cut-away side view of the lid assembly 190. As shown in this figure, the assembly 190 includes the lid 121 and opening 150, the gasket 185, the activator 153, spring 173, lid base 172 with the inner wall 174 and outer wall 175 of the lid base 172, the stem 154, O-ring 167*c*, and the stem endpiece 155.

Figure 36:
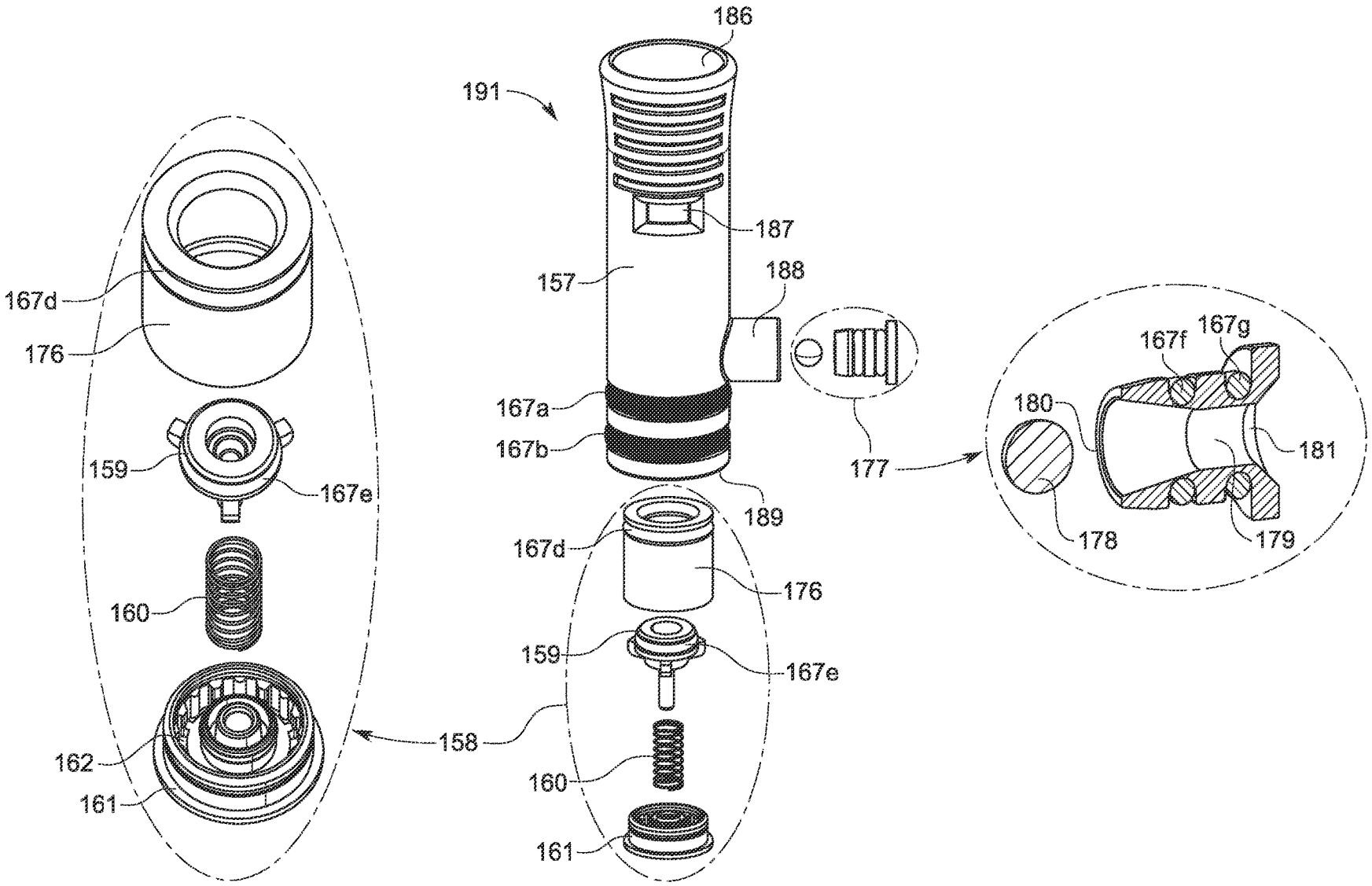
FIG. 36 illustrates an embodiment of an exploded side view of the barrel assembly for the reservoir dispenser with a bottom check valve and a side check valve.

FIG. 36 illustrates an embodiment of an exploded side view of the barrel assembly 191. As shown in this figure, assembly 191 includes the hollow barrel 157 with the top opening 186, the side opening 187, the sidearm 188 for the side check valve 177, the bottom opening 189, and the O-rings 167*a* and 167*b*. The bottom check valve 158 includes the check valve housing 176 and O-ring 167*d*, which prevents leakage of the liquid wash solution in the first chamber into the second chamber. The additional components of the bottom check valve 158 are made up of the check valve disc 159, check valve spring 160, check valve guide 161 and openings 162 therethrough, and the stem endpiece 155 and inner sidewalls 163 of the barrel 157 as described above. Also shown in this figure is the side check valve 177, which includes the sidearm 188, a ball 178, a seat 179, an opening 180 into the barrel 157, and an opening 181 to the first chamber 151 (not shown).

Figure 37:
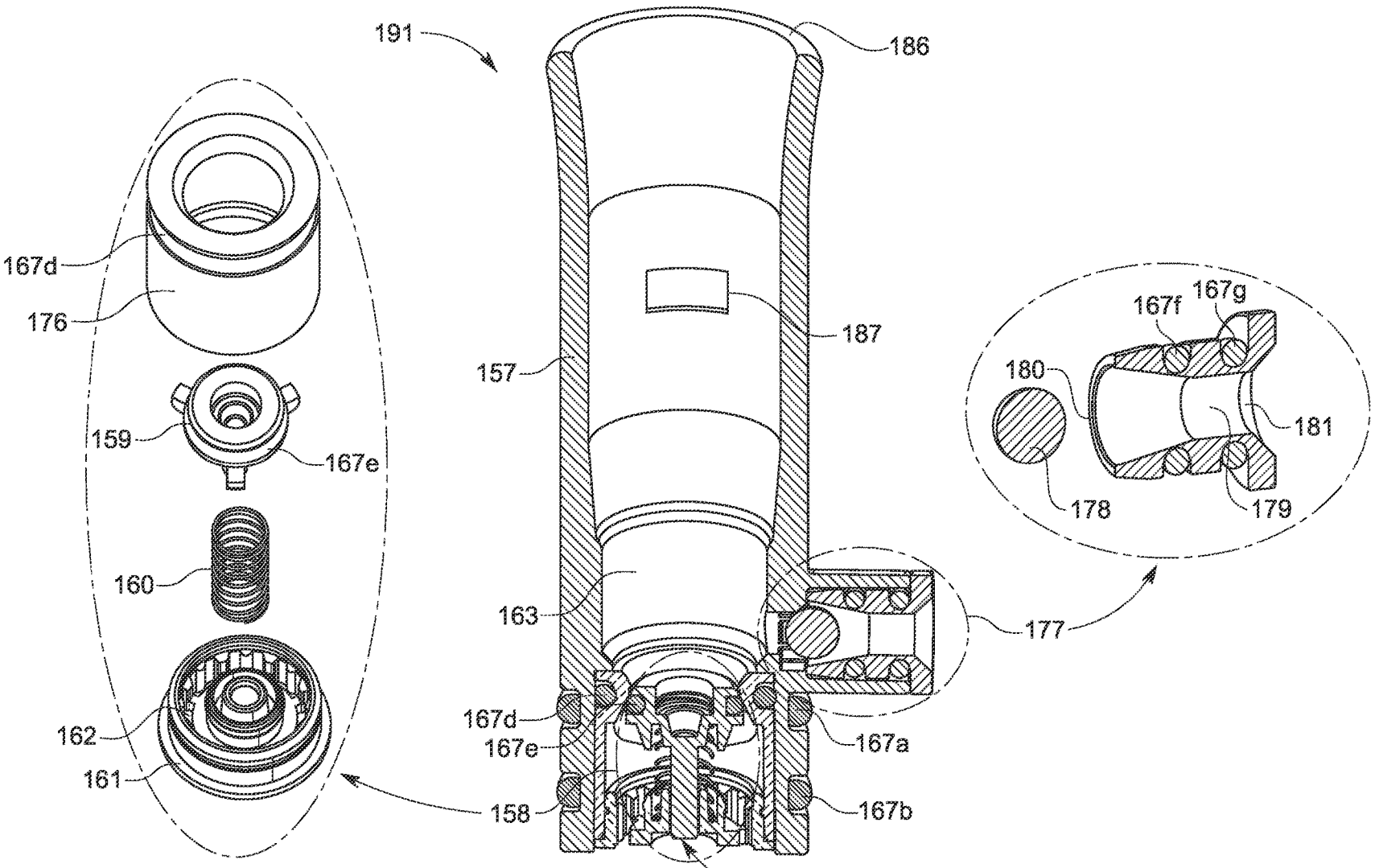
FIG. 37 illustrates an embodiment of an exploded side cut-away view of the barrel assembly for the reservoir dispenser with a bottom check valve and a side check valve.

FIG. 37 illustrates an embodiment of an exploded side cut-away view of the barrel assembly 191. As shown in this figure, assembly 191 includes the hollow barrel 157 with the top opening 186, the side opening 187, the sidearm 188 for the side check valve 177, the bottom opening 189, and the O-rings 167*a* and 167*b*. The bottom check valve 158 includes the check valve housing 176 and O-ring 167*d*. The additional components of the bottom check valve 158 are made up of the check valve disc 159, check valve spring 160, check valve guide 161 and openings 162 therethrough, and the stem endpiece 155 and inner sidewalls 163 of the barrel 157 as described above. Also shown in this figure is the side check valve 177, which includes the sidearm 188, the ball 178, the seat 179, the opening 180 into the barrel 157, and the opening 181 to the first chamber 151 (not shown).

Figure 38:
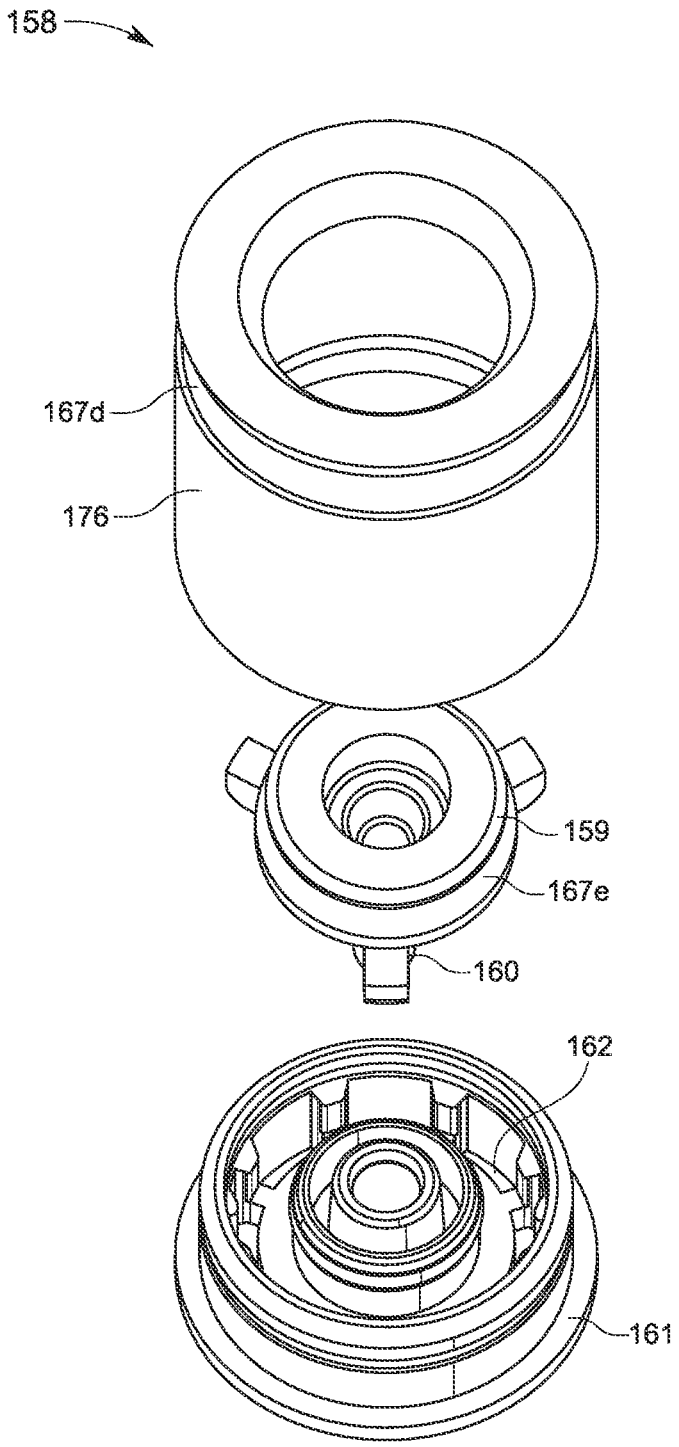
FIG. 38 illustrates an embodiment of an exploded top side view of the bottom check valve for the reservoir dispenser with a bottom check valve and a side check valve.

FIG. 38 illustrates an embodiment of an exploded top side view of the bottom check valve 158. As shown in this figure, check valve 158 includes housing 176, disc 159, spring 160, and guide 161 with openings 162.

Figure 39:
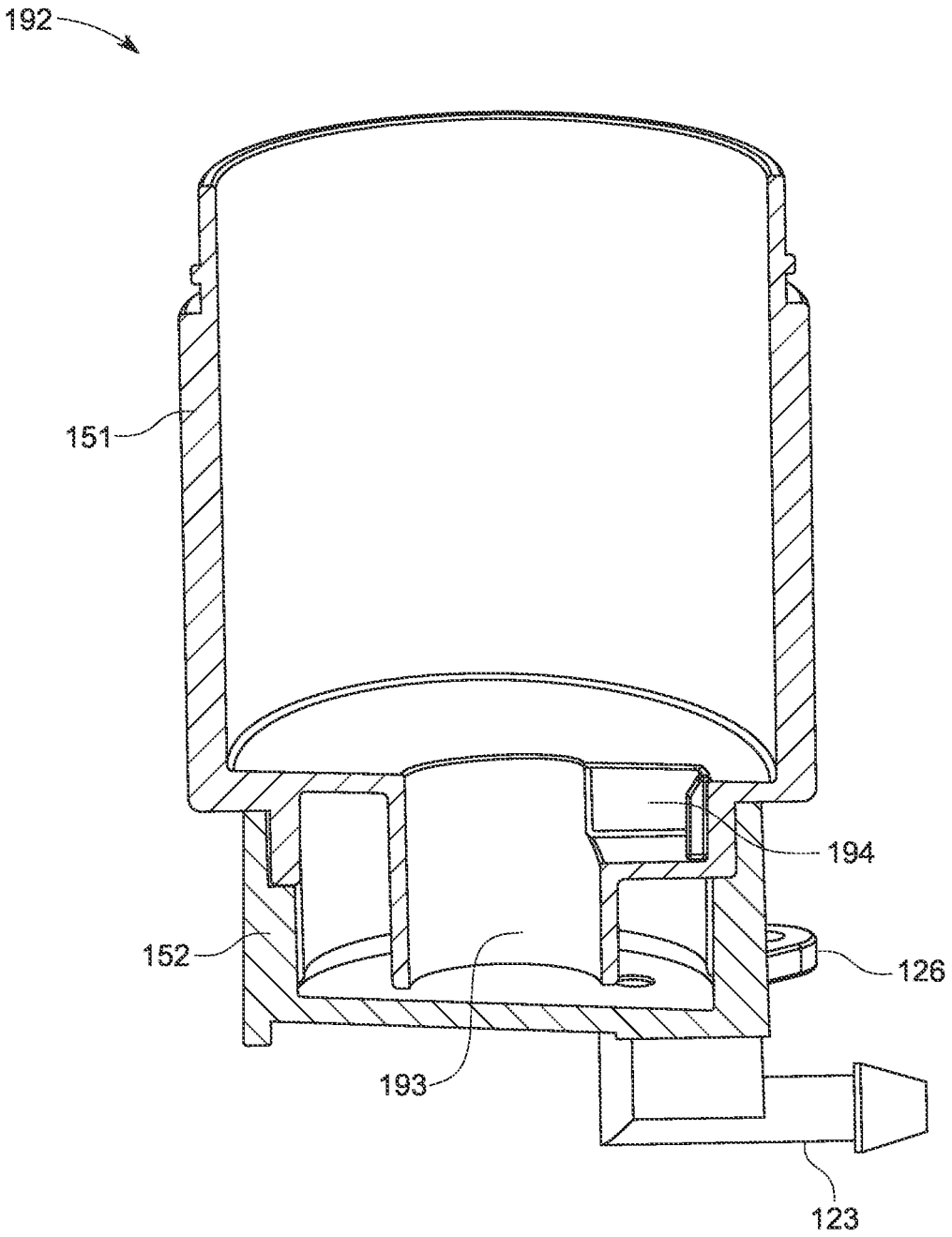
FIG. 39 illustrates an embodiment of a cut-away side view of the housing assembly for the reservoir dispenser with a bottom check valve and a side check valve.

FIG. 39 illustrates an embodiment of a cut-away side view of the housing assembly 192. As shown in this figure, assembly 192 includes the first chamber 151, which extends down into the second chamber 152 with space and support 193 for the bottom check valve 158 including the housing 176, and space and support 194 for the side check valve 177 and sidearm 188 of the barrel 157.

A check valve allows the flow of liquid in one direction. Typically, a check valve has two openings: a check valve input side, and a check valve output side. Since a check valve only allows fluid to flow in one direction, they are commonly referred to as 'one-way valves or 'nonreturn valves.' The main purpose of a check valve is to prevent backflow into the system.

A check valve device relies on a pressure differential to work. They require a higher pressure (cracking pressure) on the input side than the output side to open the valve. When the pressure is higher on the outlet side, the valve will close. Depending on the valve type, the closing mechanism can be different. In short, the back pressure can push a gate, ball, diaphragm, or disc against an orifice and seal it. Depending on the design, the closing process can be assisted by a spring or gravity. Common types of check valves include but are not limited to spring-loaded check valves, diaphragm check valves, umbrella check valves, duckbill check valves, and others.

Figure 40:
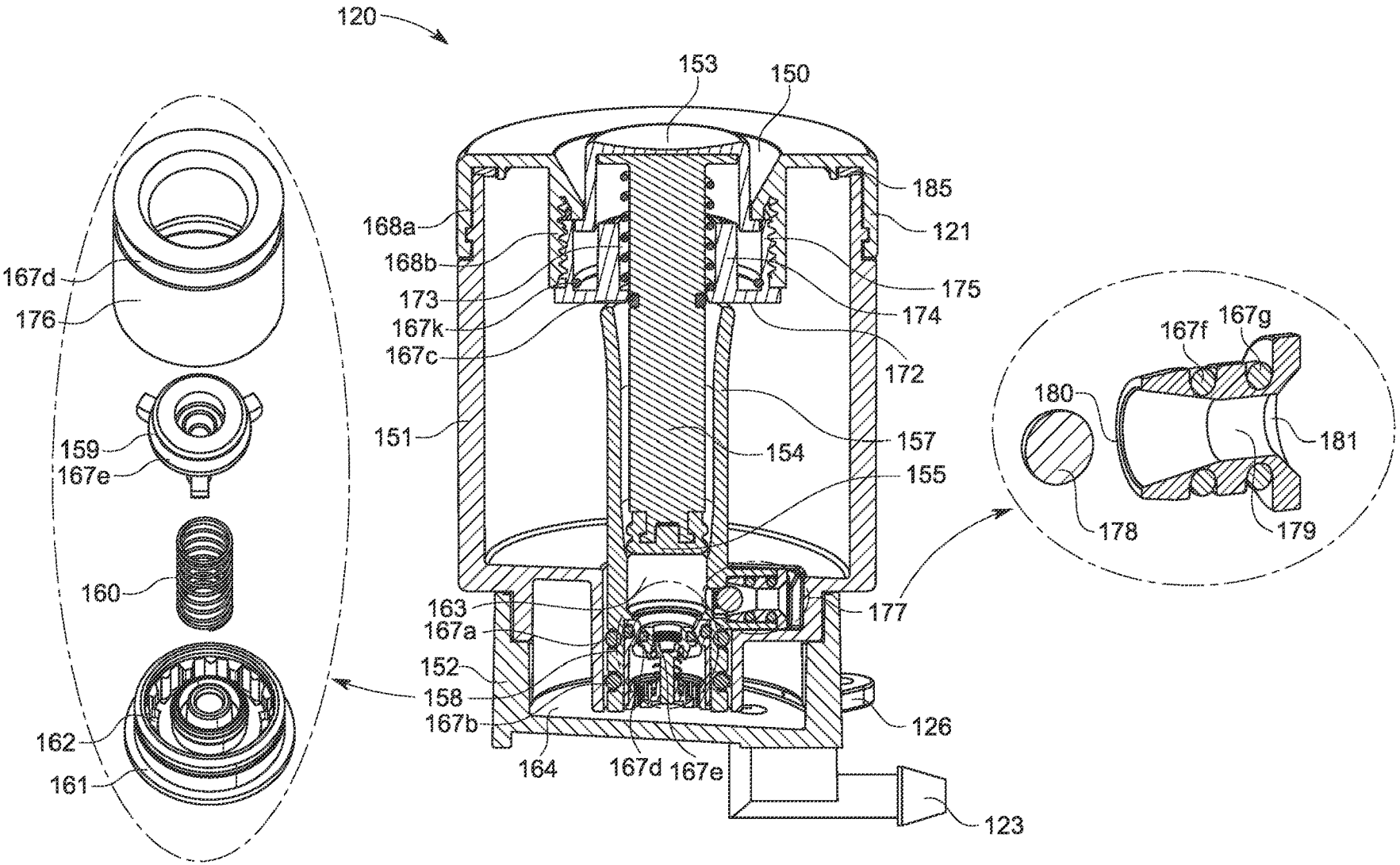
FIG. 40 illustrates an embodiment of a side cut-away view of the reservoir dispenser having a bottom check valve and a side check valve.

FIG. 40 illustrates an embodiment of a side cut-away view of a reservoir dispenser 120 having a bottom check valve 158 and a side check valve 177 in action.

As shown in this figure, initially the liquid wash solution present in the first chamber 151 remains separated from the water in the second chamber 152 by the action of the check valve 158. The check valve 158 includes the check valve disc 159, which remains pressed against the sidewalls 163 of the barrel 157 by the action of the check valve spring 160 and check valve guide 161. The liquid wash solution present in the first chamber 151 can enter the barrel 157 through the openings 187 present in barrel 157 and the openings 180 and 181 through the side check valve 177 but is stopped from entering the second chamber 152 by the check valve disc 159 pressing against the sidewalls 163 of the barrel.

Figure 41:
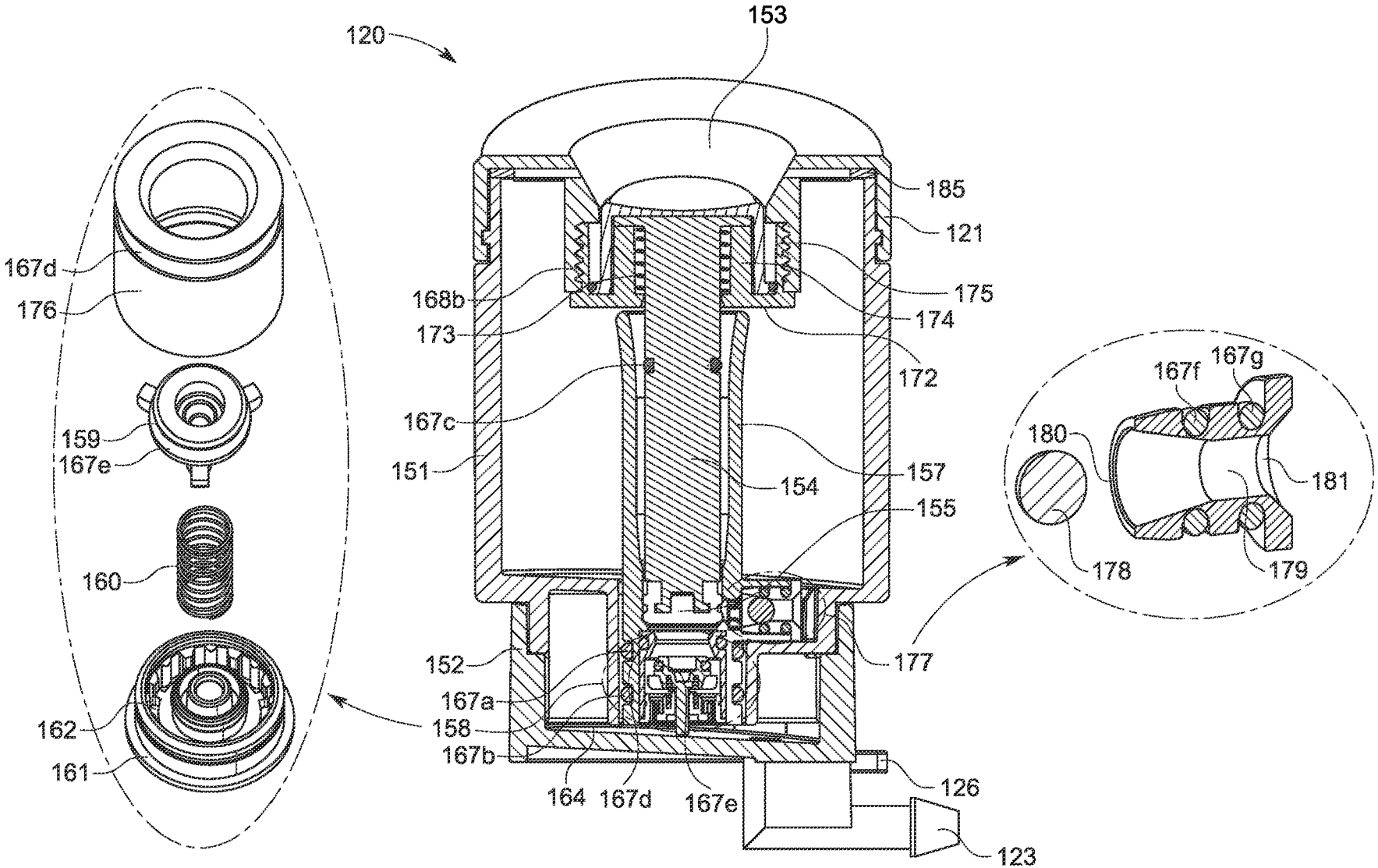
FIG. 41 illustrates an embodiment of the reservoir dispenser having a bottom check valve and a side check valve.

As shown in FIG. 41, downward movement on the activator 153 causes an aliquot of the liquid wash solution in the first chamber 151 to be trapped between the stem endpiece 155, the sidewalls 163 of the barrel 157, and the check valve disc 159.

Further downward movement on the activator 153 results in sufficient force or pressure to overcome the cracking pressure of the check valve 158 and forces the check valve disc 159 and check valve spring 160 downwards, which allows the trapped aliquot of the liquid wash solution to flow through the check valve guide 161 and its' openings 162 and into the second chamber 152, whereupon the aliquot of liquid wash solution is mixed with the water present in this chamber. In addition, the downward pressure causes the ball 178 to press against the seat 179 and close the opening 180 of the side check valve 177, which closes off the first chamber 151 from the barrel 157. Finally, stem 154 can physically cut off the opening 181 of the side check valve 177.

When the input pressure is no longer high enough on the check valve due to upwards motion or release of the activator 153, then the backpressure and/or the check valve spring 160 pushes the check valve disc 159 upwards and against the sidewalls 163 of the barrel and seals and separates the contents of the first chamber 151 from the contents of the second chamber 152. The check valve spring 160, along with the short travel distance for the check valve disc 159, allows for quick reaction times for opening and closing. Also, the reduced pressure in barrel 157 causes the ball 178 to release its position against the seat 179 in the side check valve 177, which allows openings 180 and 181 to allow the flow of liquid wash solution in the first chamber 151 to enter into the barrel 157.

In other embodiments, the disclosure provides another reservoir dispenser for a bidet washing apparatus having a plurality of chambers, wherein a first chamber holds a liquid wash solution, and a second chamber holds water for flow through the apparatus. Similarly, in these embodiments, the liquid wash solution from the first chamber can be added to the water present in the second chamber and mixed therein, in a controlled, measured manner without backflow of water into the first chamber.

Figure 42:
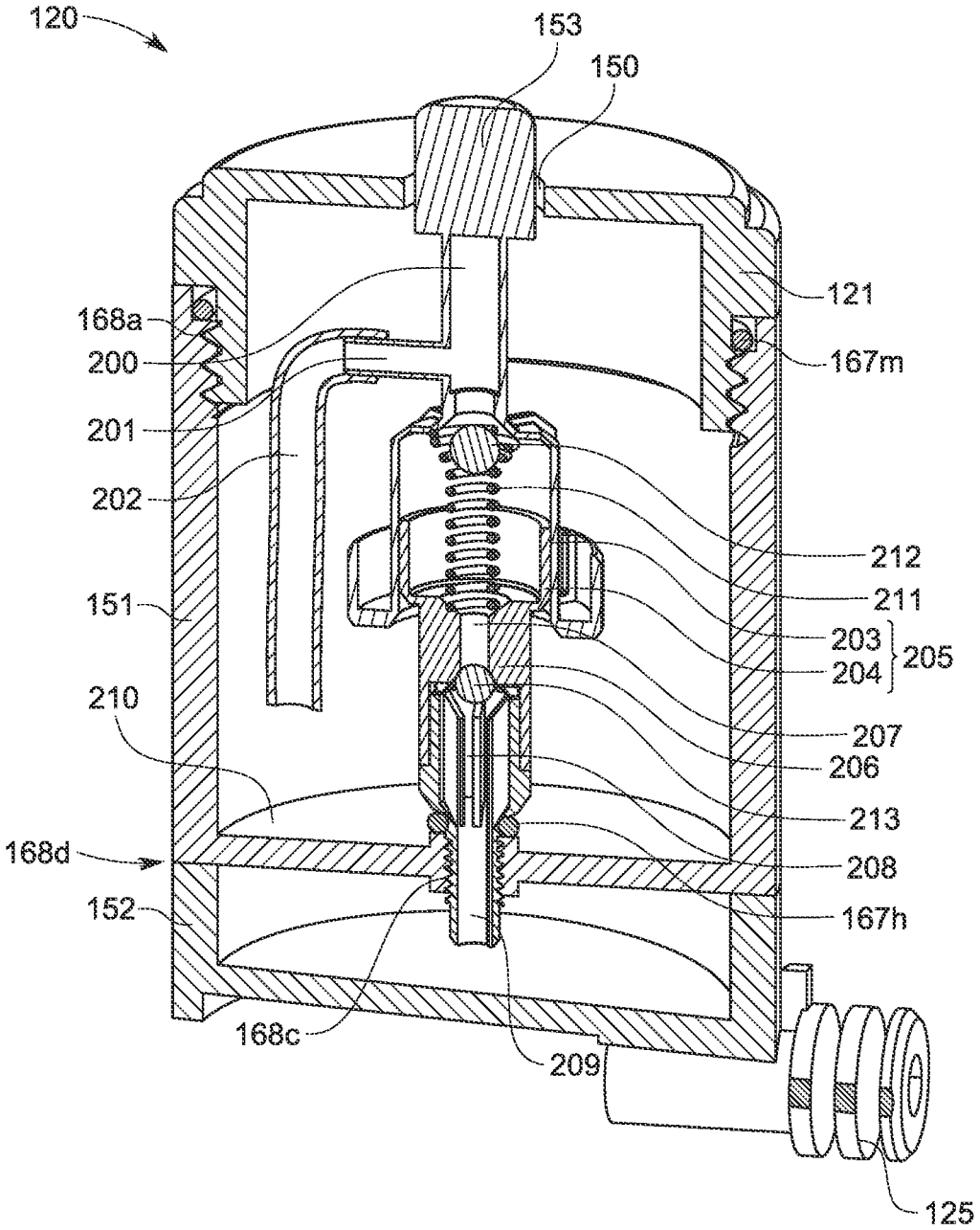
FIG. 42 illustrates another embodiment of a side cut-away view of a reservoir dispenser with a pump mechanism in an inactivated position.

FIG. 42 illustrates another embodiment of a side cut-away view of the reservoir dispenser 120 in an inactivated position. As shown in this figure, reservoir dispenser 120 includes a first chamber 151 and a second chamber 152. An activator 153 is present within an opening 150 of the lid 121 and extends into the first chamber 151 through a hollow upper tube 200. The upper tube 200 includes a side arm 201 that is connected to a supply tube inlet 202 that runs into the first chamber 151 where a liquid wash solution can be stored.

The first chamber 151 can be reversibly connected to the lid 121 through a screw-on, threaded type mechanism 168*a*, or can be snapped on, or can be secured permanently or reversibly or by any other means known in the art. In addition, an O-ring (not shown) can be used between the first chamber 151 and the lid 121, which prevents leakage of the liquid wash solution present in the first chamber 151. In addition, the first chamber 151 can be reversibly connected to the second chamber 152 through a similar mechanism 168*d* and O-ring 167*k*.

As shown, the upper tube 200 expands into a pump chamber lid 203 below the sidearm 201. Directly beneath the pump chamber lid 203, lies a pump chamber receptacle 204. Together, the pump chamber lid 203 and the pump chamber receptacle 204 can together form a pump chamber 205. In some embodiments, the pump chamber lid 203 can encompass and slide upon the pump chamber receptacle 204, whereas in other embodiments, the pump chamber receptacle 204 can encompass and slide upon the pump chamber lid 203. In either event, the pump chamber lid 203 and the pump chamber receptacle 204 form the pump chamber 205.

As shown, the pump chamber receptacle 204 extends downwards through a support base 206 which encircles a hollow upper first tube 207. Below the support base 206 lies an outlet chamber 208 and a hollow lower second tube 209, which can be secured to the base 210 of the first chamber 151. As shown, the upper first tube 207, outlet chamber 208, and the lower second tube 209 are in communication with each other.

Within the pump chamber 205 is a spring 211 and first ball 212, which can be located between the support base 206 and an inside top of the pump chamber lid 203. Within the outlet chamber 208, which is wider than the upper first tube 207 and the lower second tube 209, is a second ball 213, which can toggle between the support base 206 and the lower second tube 209.

The lower second tube 209 can be reversibly connected to the base 210 of the first chamber through a screw-on, threaded type mechanism 168*c*, or can be snapped on, or can be secured permanently or reversibly or by any other means known in the art. In addition, an O-ring 167*h* can be used between the outlet and the base, which prevents leakage of the liquid wash solution present in the first chamber.

Figure 43:
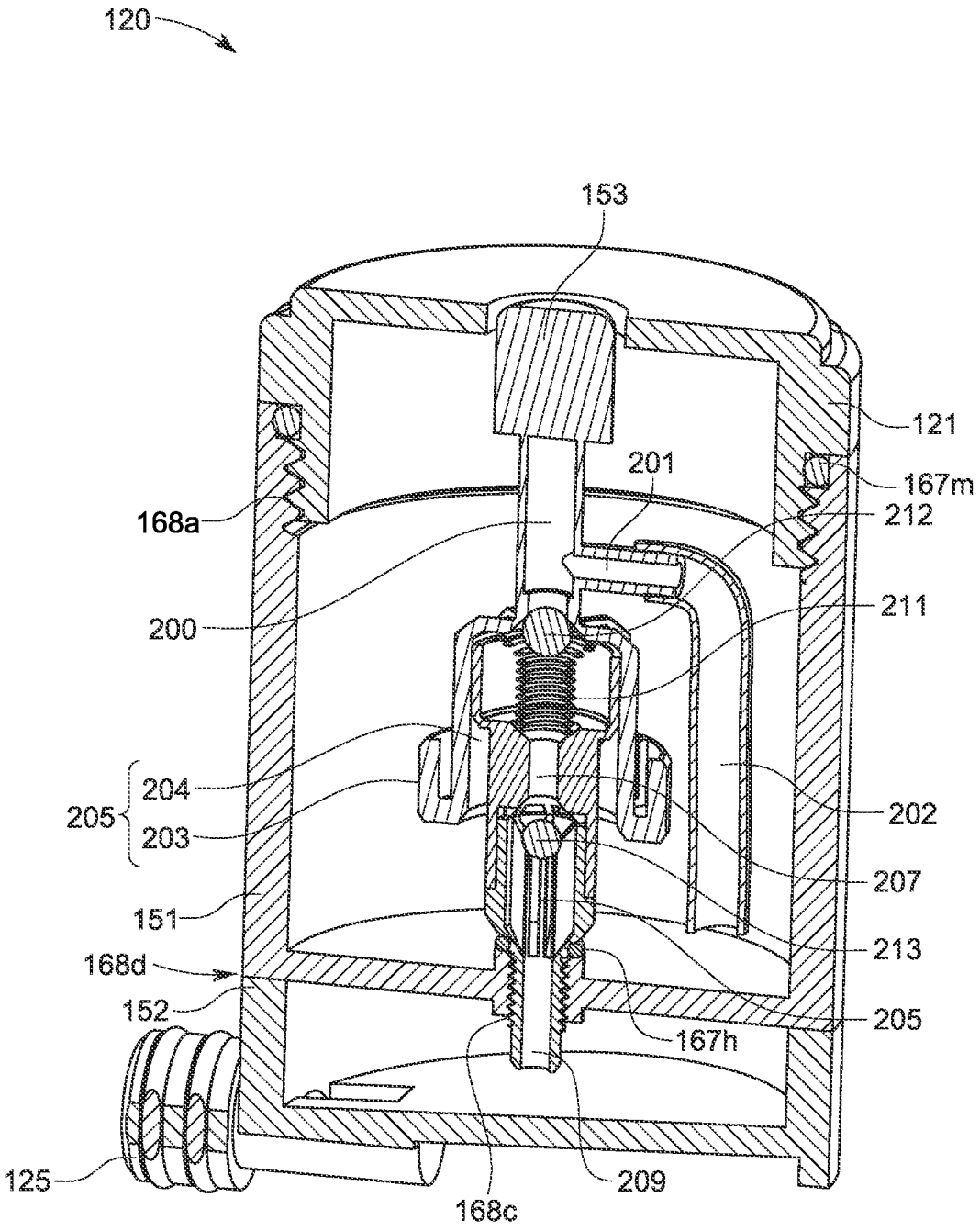
FIG. 43 illustrates an embodiment of a side cut-away view of the pump mechanism with a pump mechanism in an activated position.

FIG. 43 illustrates another embodiment of a side cut-away view of the pump mechanism present in the first chamber in an activated position. The pump mechanism includes the activator 153, upper tube 200, sidearm 201, supply tube inlet 202, pump chamber lid 203, pump chamber receptacle, pump chamber 205, spring 211, first ball 212, support base 206, upper first tube 207, outlet chamber 208, second ball 213, and the lower second tube 209.

FIGS. 42 and 43 also illustrate an embodiment of a side cut-away view of a reservoir dispenser 120 having a pump chamber 205 in action.

As shown in FIG. 42, initially the liquid wash solution present in the first chamber 151 remains separate from the water in the second chamber 152 by the action of the pump mechanism. That is, before engaging the activator 153, the higher pressure in the outlet chamber 208 due to the running water in the second chamber 152, forces the second ball 213 upwards against the support base 206, which closes off the outlet chamber 208 (and second chamber) from the pump chamber 205 (and first chamber).

As shown in FIG. 43, when the activator 153 is engaged by pushing it downwards, the pump chamber lid 203 slides down the pump chamber receptacle 204, and the pump chamber 205, holding the liquid wash solution decreases in volume. This decrease in volume gives rise to a corresponding increase in pressure in the pump chamber 205. The spring 211 present in the pump chamber 205, compresses against the support base 206 and the first ball 212 is forced against the opening to the upper tube 200. This effectively seals off the pump chamber 205 from the hollow upper tube 200 and first chamber, which prevents the liquid soap solution present in the pump chamber from returning to the first chamber 151. Furthermore, the increased pressure in the pump chamber 205 forces the second ball 213 downwards in the outlet chamber 208, which allows the liquid wash solution present in the pump chamber 205 to travel down the upper first tube 207 into the outlet chamber 208, the lower second tube 209, and into the second chamber 152.

Figure 46:
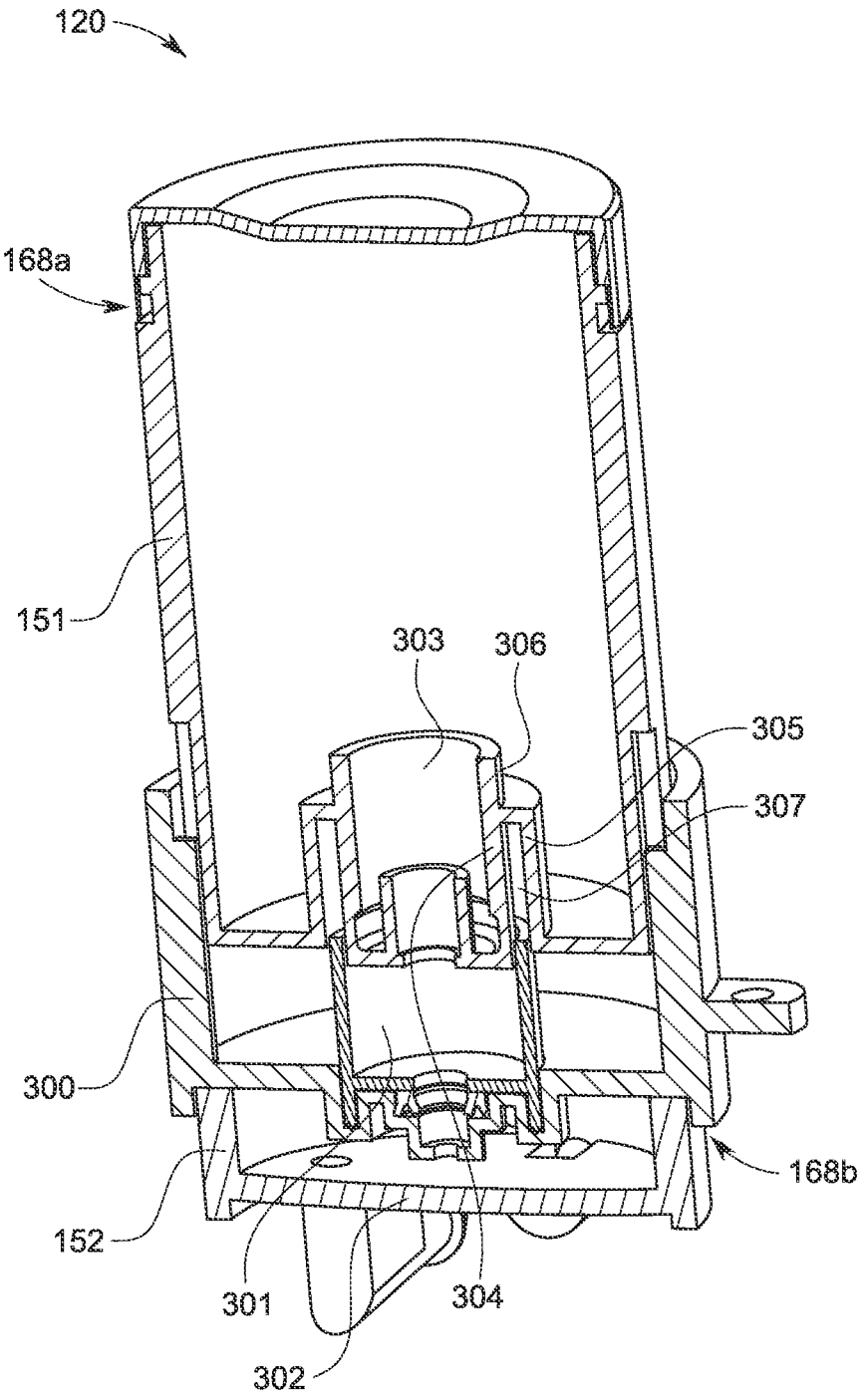
FIG. 46 illustrates an embodiment of a side cut-away view of the reservoir dispenser without a pump mechanism.

Upon release of the activator 153, the pump chamber lid 203 slides up the pump chamber receptacle 204, and the pump chamber 205 increases in volume (see FIG. 46). This increase in volume decreases the pressure in the pump chamber 205. As such, the spring 211 present in the pump chamber 205, elongates against the support base 206 and the first ball 212 is released from the inside top of the pump chamber lid 203, thereby opening the pump chamber 205 to the hollow upper tube 200 and first chamber. This allows the liquid wash solution present in the first chamber 151 to travel through the supply tube inlet 202 through the sidearm 201 and into the pump chamber 205 due to the reduced pressure in the pump chamber 205. Furthermore, the greater pressure in the outlet chamber 208 forces the second ball 213 upwards against the support base 206, which closes off the outlet chamber (and second chamber) from the pump chamber 205 (and first chamber).

In yet more embodiments, the disclosure provides a reservoir dispenser for a bidet washing apparatus having a plurality of chambers, wherein a first chamber holds a liquid wash solution, and a second chamber holds water for flow through the apparatus. Similarly, in these embodiments, the liquid wash solution from the first chamber can be added to the water present in the second chamber and mixed therein, in a controlled, measured manner without backflow of water into the first chamber.

Figure 44:
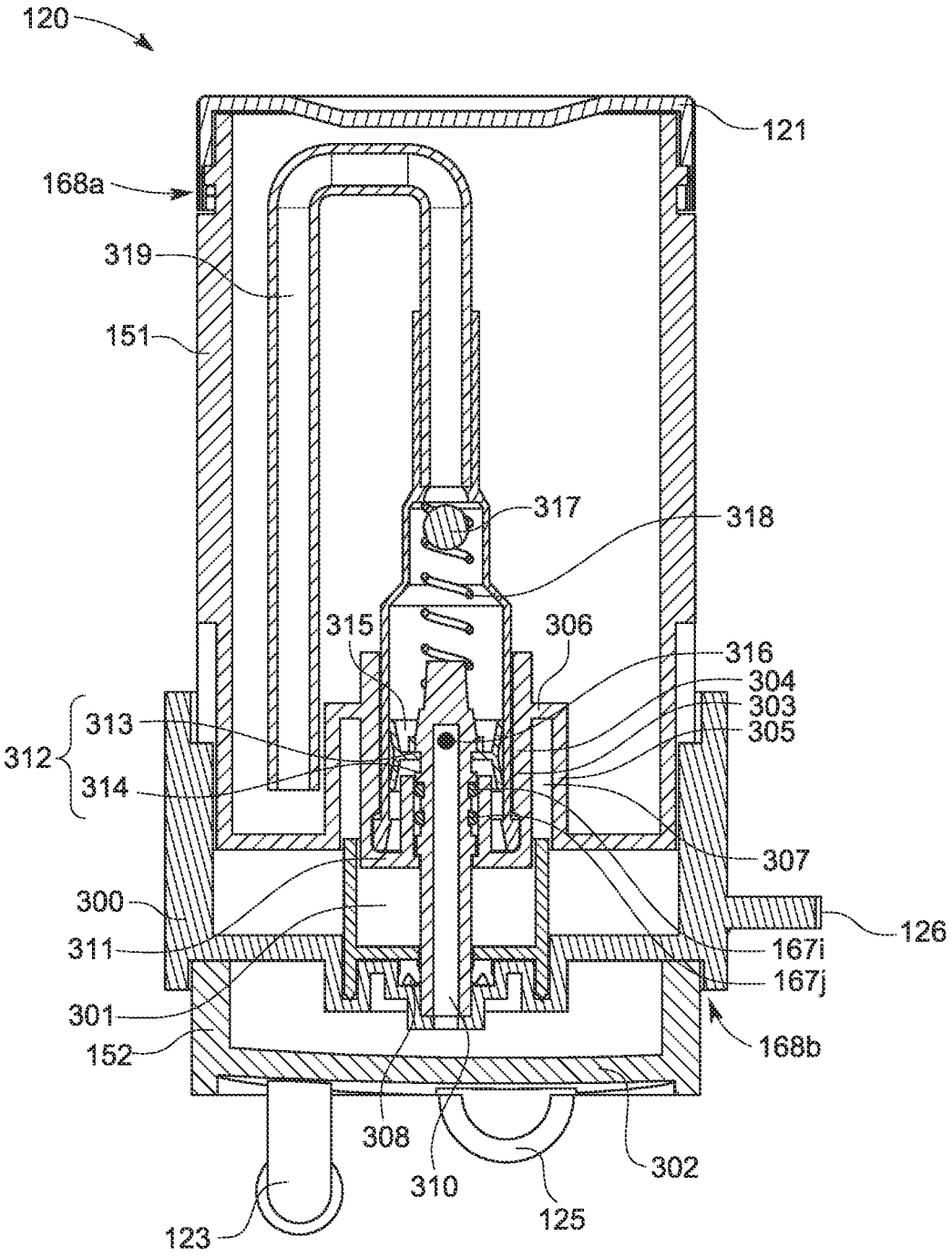
FIG. 44 illustrates an embodiment of a side cut-away view of a reservoir dispenser having a pump chamber in an inactivated position.
Figure 45:
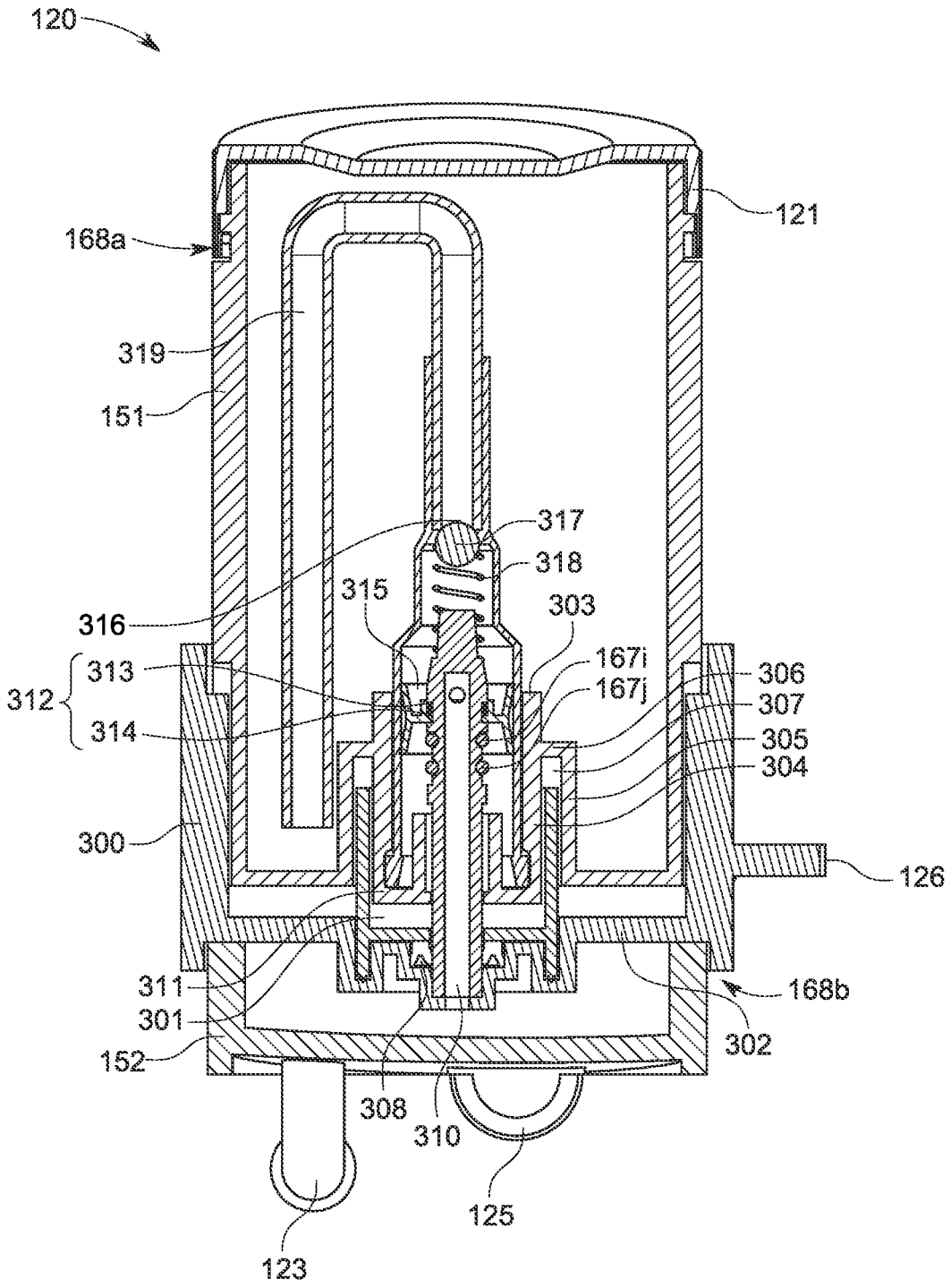
FIG. 45 illustrates an embodiment of a side cut-away view of a reservoir dispenser having a pump chamber in an activated position.

FIGS. 44 and 45 illustrate an embodiment of a side cut-away view of the reservoir dispenser 120 when in the inactivated and activated position, respectively. As shown in this figure, the reservoir dispenser includes a first chamber 151 and a second chamber 152, and a lid 121, which is attachable to the first chamber.

Between the first chamber 151 and the second chamber 152 is a support holder 300, in which the first chamber is supported by and tracks or slides up and down upon. As described herein, the sliding action of the first chamber 151 into the support holder 300 serves to activate the pump mechanism, i.e., it's an activator. The support holder 300 includes a support holder chamber 301, which is attached to the support holder base 302. The first chamber 151 includes a pump holder 303, which is encapsulated and surrounded by an inner wall 304, an outer wall 305, and a top wall or ceiling 306 between these walls. The space 307 between the inner and outer walls can act as a track for the support holder chamber 301 to track or slide upon. The second chamber 152 acts to secure the support holder 300. A seal 308 underneath the support holder base 302 prevents backflow of water from the second chamber.

The support holder base 302 can secure a closed-ended outlet tube 310, which can run up from the second chamber 152, through the support holder base 302 through the support holder chamber 301 and the pump holder 303. Surrounding the outlet tube 310 is a pump housing unit 311, which is secured to the pump holder 303 and surrounds the hollow tube. The outlet tube 310 includes a grooved region 312 having a proximal end 313 and a distal end 314, in which a piston 315 can be attached to and allowed to travel along this grooved region. The closed-ended outlet tube 310 also includes one or more holes or openings 316 located in the proximity of the groove 312 and piston 315, such that the piston can slide along the groove to uncover (at the distal end 314) and cover (at the proximal end 313) the holes or openings in the hollow tube, for example, when the activator 153 is pushed down and when the activator is released upwards, respectively. The outlet tube 310 can include two O-rings 167*i* and 167*j*, which acts to prevent leakage of the liquid wash solution from the first chamber 151, the support holder 300, and/or the second chamber 152. Also included within the pump housing unit 311 is a ball 317 and a spring 318, which together with the outlet tube 310 can act as a check valve as described herein. Above the ball 317 and spring 318, the pump housing unit 311 is attached to a hollow U-shaped inlet tube 319, which travels from the pump housing unit 311 into the first chamber 151 to access the liquid wash solution contained therein.

FIG. 46 illustrates an embodiment of a cut-away view of the reservoir dispenser 121 showing the first chamber 151, support holder 300, and the second chamber 151 without the pump mechanism 320. Also shown are the lid 121, pump holder 303, inner wall 304, outer wall 305, ceiling 306, space 307, support holder chamber 301, and the support holder base 302.

Figure 47:
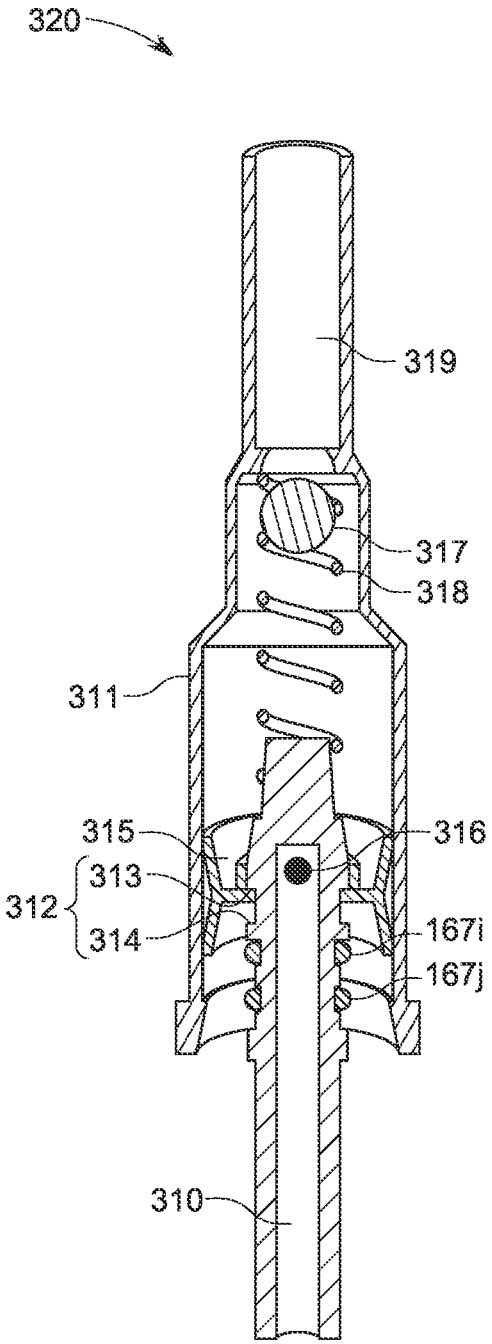
FIG. 47 illustrates an embodiment of a side cut-away view of the pump mechanism in an inactivated position.
Figure 48:
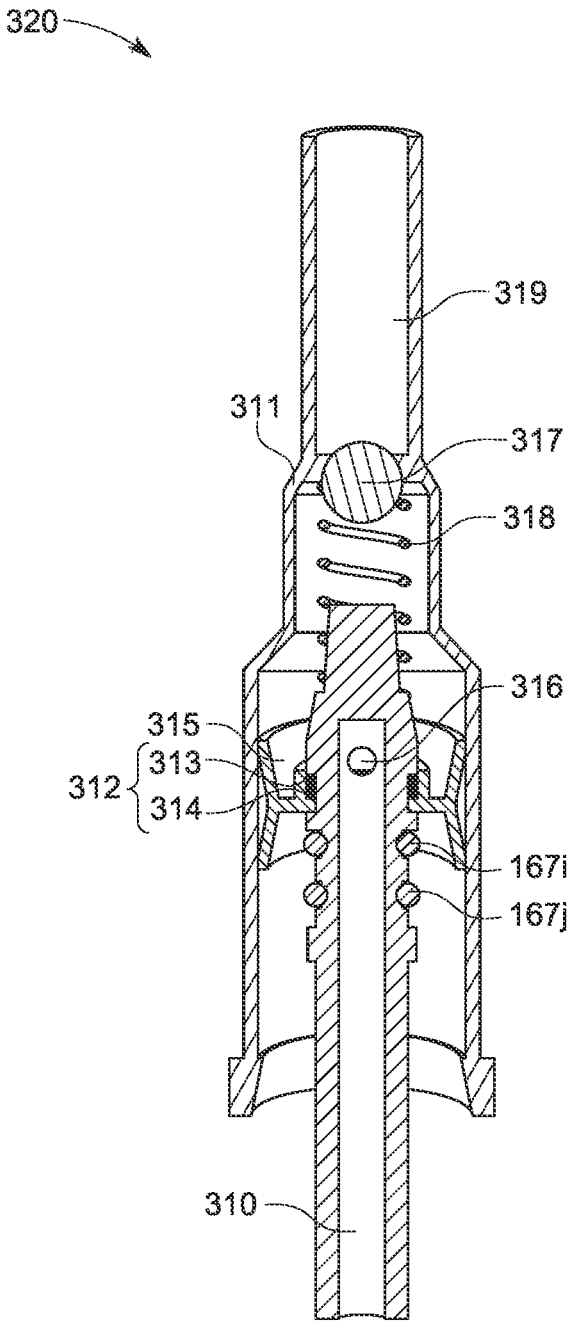
FIG. 48 illustrates an embodiment of a side cut-away view of the pump mechanism in an activated position.

FIGS. 47 and 48 illustrate an embodiment of a view of the pump mechanism 320, showing the piston 315 in the proximal end 313 of the groove 312, which covers the holes or openings 316 in the outlet tube 310; and the piston 315 in the distal end 314 of the groove 312, which uncovers the holes or openings 316 in the outlet tube 310. Also shown in these figures are the pump housing unit 311, spring 318, ball 317, O-rings 167*i* and 167*j*, and the U-shaped inlet tube 319.

FIGS. 44 and 45 illustrate an embodiment of a side cut-away view of a reservoir dispenser 120 having a pump chamber 205 in action.

As shown in FIG. 44, initially the liquid wash solution present in the first chamber 151 remains separate from the water in the second chamber 152 by the action of the pump mechanism. That is, before engaging the pump mechanism by pushing down on the lid 121 and first chamber 151, i.e., the activator 153, the piston 315 surrounding the outlet tube 310 is located at the proximal end 313 of the groove 312, which covers the holes or openings 316 in the outlet tube 310. As such, there is no connection between the first chamber 151 and the second chamber 152.

When the activator 153 is pressed, i.e., the lid 121 and first chamber 151 as explained above, the pump holder 303 is forced down upon the inner cup chamber holder 304 by sliding or tracking down into the space 307 between the inner wall 304 and outer wall 305 of the pump holder 303. The spring 318 on top of the outlet tube 310 is compressed, which forces the ball 317 against the upper walls 321 of the pump housing unit 311, which closes access between the pump holder 303 and the first chamber 151. At the same time, the piston 315 moves from a proximal end 313 to a distal end 314 of the groove 312, which uncovers the holes or openings 316 present in the outlet tube 310 and allows the pressurized liquid wash solution present in the pump housing unit 311 to enter the outlet tube 310 through the holes or openings 316 and pass into the second chamber 152.

As shown in FIG. 45, conversely when the activator 153 is released, i.e., the lid 121 and first chamber 151 as explained above, the pump holder 303 moves up on the support holder chamber 301. The spring 318 on top of the outlet tube 310 is allowed to elongate, which allows the ball 317 to be released from the upper walls 321 of the pump housing unit 311. This allows access between the pump holder 303 and the first chamber 151. At the same time, the piston 315 moves from the distal end 314 to the proximal end 313 of the groove 312, which covers the holes or openings in the outlet tube 310 and prevents the liquid wash solution present in the pump housing unit 311 from entering the outlet tube 310 and pass into the second chamber 152.

While the inventive natures have been particularly shown and described concerning preferred embodiments thereof, it will be understood by those in the art that the foregoing and other changes can be made therein without departing from the spirit and the scope of the disclosure. Likewise, the various diagrams may depict an example architectural or other configuration for the disclosure, which is done to aid in understanding the features and functionality that can be included in the disclosure. The disclosure is not restricted to the illustrated example architectures or configurations but can be implemented using a variety of alternative architectures and configurations. Additionally, although the disclosure is described above in terms of various exemplary embodiments and implementations, it should be understood that the various features and functionality described in one or more of the individual embodiments are not limited in their applicability to the particular embodiment with which they are described. They instead can be applied alone or in some combination, to one or more of the other embodiments of the disclosure, whether or not such embodiments are described, and whether or not such features are presented as being a part of a described embodiment. Thus, the breadth and scope of the disclosure should not be limited by any of the above-described exemplary embodiments.

What is claimed is:

1. A reservoir dispenser for a bidet apparatus, comprising:

a housing unit having a first chamber and a second chamber, wherein the first chamber is capable of holding a liquid wash solution separate from the second chamber;

a water inlet and a water outlet connectable to the second chamber;

a lid attachable to the first chamber;

an activator having a stem and a stem endpiece;

a hollow barrel surrounding the stem and stem endpiece;

a side check valve between the hollow barrel and the first chamber; and a bottom check valve between the first chamber and the second chamber.

2. The reservoir dispenser of claim 1, wherein the lid includes an opening therein, and the activator is within the opening of the lid.

3. The reservoir dispenser of claim 1, wherein the activator is a push-button, a twist-button, a pull up and push down button, a slide button, a plunger button, a lever, or a knob.

4. The reservoir dispenser of claim 1, wherein the side check valve and the bottom check valve are each independently a spring-loaded check valve, a ball and seat check valve, a diaphragm check valve, an umbrella check valve, or a duckbill check valve.

5. The reservoir dispenser of claim 1, wherein the lid includes a lid base having an inner wall, and outer wall, and a space therebetween in which the activator can move down and up within when engaging and disengaging the activator, respectively.

6. The reservoir dispenser of claim 1, wherein the side check valve includes:

a side check valve body including a check valve seat;

a ball for engaging within the seat;

an inner opening into the barrel;

an outer opening into the first chamber; and one or more O-rings encircling the side check valve body.

7. The reservoir dispenser of claim 1, wherein the bottom check valve includes:

a bottom check valve body including sidewalls of the middle region and/or lower region of the barrel;

a check valve disc;

a check valve spring; and a check valve guide having one or more openings there through.

8. The reservoir dispenser of claim 1, wherein engaging the activator blocks transfer of liquid wash solution from the first chamber to the hollow barrel through the side check valve; and allows transfer of the liquid wash solution from the first chamber to the second chamber through the bottom check valve.

9. The reservoir dispenser of claim 1, wherein disengaging the activator allows transfer of liquid wash solution from the first chamber to the hollow barrel through the side check valve; and blocks transfer of the liquid wash solution from the first chamber to the second chamber through the bottom check valve.

10. A reservoir dispenser for a bidet apparatus, comprising:

a housing unit having a first chamber and a second chamber, wherein the first chamber is capable of holding a liquid wash solution separate from the second chamber;

a water inlet and a water outlet connectable to the second chamber;

a lid attachable to the first chamber;

an activator having an upper tube and an inlet tube, wherein the activator, the upper tube, and the inlet tube are within the first chamber;

an outlet chamber having an upper first tube and a lower second tube, wherein the outlet chamber and upper first chamber are within the first chamber, and wherein the lower second tube is secured at a base of the first chamber and is connectable to the second chamber;

a pump chamber having a pump chamber lid and a pump chamber receptacle, wherein the pump chamber, the pump chamber lid and the pump chamber receptacle are within the first chamber, wherein the pump chamber lid is connectable to the upper tube of the activator, wherein the pump chamber receptacle is connectable to the upper first tube of the outlet chamber, and wherein the pump chamber lid and the pump chamber receptacle form a reversibly compressible pump chamber.

11. The reservoir dispenser of claim 10, wherein the lid includes an opening therein, and the activator is within the opening of the lid.

12. The reservoir dispenser of claim 10, wherein the activator is a push-button, a twist-button, a pull up and push down button, a slide button, a plunger button, a lever, or a knob.

13. The reservoir dispenser of claim 10, wherein the pump chamber includes a spring and a first ball between a support base of the pump chamber receptacle and the pump chamber lid, respectively; and wherein the outlet chamber includes a second ball between the upper first tube and the lower second tube.

14. The reservoir dispenser of claim 10, wherein engaging the activator allows transfer of the liquid wash solution from the first chamber to the second chamber by compressing the pump chamber and forcing any liquid wash solution present in the pump chamber through the outlet chamber and into the second chamber.

15. The reservoir dispenser of claim 14, wherein engaging the activator compresses the pump chamber and spring, thereby forcing the first ball against the upper tube of the activator closing off the first chamber to the pump chamber; and forcing the second ball downwards away from the lower second tube of the outlet chamber and forcing any liquid wash solution present in the pump chamber through the upper first tube, the outlet chamber, the lower second tube and into the second chamber.

16. The reservoir dispenser of claim 10, wherein disengaging the activator blocks transfer of liquid wash solution from the first chamber to the second chamber by elongating the pump chamber and relieving the pressure on the liquid wash solution present in the pump chamber.

17. The reservoir dispenser of claim 16, wherein disengaging the activator elongates the pump chamber and spring, thereby releasing the first ball against the upper tube of the activator and opening the first chamber to the pump chamber; and forcing the second ball upwards against the upper first tube and closing off the second chamber to the pump chamber.

18. A reservoir dispenser for a bidet apparatus, comprising:

a housing unit having a first chamber and a second chamber, wherein the first chamber is capable of holding a liquid wash solution separate from the second chamber;

a water inlet and a water outlet connectable to the second chamber;

a lid attachable to the first chamber;

a support holder between the first chamber and the second chamber, wherein the support holder includes a support holder base and a support holder chamber;

a pump holder on a base of the first chamber, wherein the pump holder includes an inner wall, an outer wall, and a space therebetween for tracking upon the support holder chamber;

an activator including the lid and the first chamber, wherein the activator tracks upon the support holder and support holder chamber; and a pump housing unit having an inlet tube and an outlet tube, wherein the inlet tube is in the first chamber, and the outlet tube enters the second chamber, wherein the outlet tube is closed at one end and includes a grooved region having a proximal end with at least one opening and a distal end; and a piston surrounding the grooved region of the outlet tube, wherein the piston can travel between the proximal end to cover the at least one opening in the grooved region, to the distal end to uncover the at least one opening in the grooved region.

19. The reservoir dispenser of claim 18, wherein the activator is a push-button, a twist-button, a pull up and push down button, a slide button, a plunger button, a lever, or a knob.

20. The reservoir dispenser of claim 18, wherein the pump housing unit further includes a spring and a ball between the outlet tube and the inlet tube.

21. The reservoir dispenser of claim 18, wherein engaging the activator allows transfer of the liquid wash solution from the first chamber to the second chamber by compressing the pump housing unit and moving the piston from the proximal end to the distal end of the outlet tube thereby uncovering the opening in the proximal end and forcing any liquid wash solution present in the pump housing unit through the opening and into the second chamber.

22. The reservoir dispenser of claim 18, wherein disengaging the activator blocks the transfer of the liquid wash solution from the first chamber to the second chamber by elongating the pump housing unit and moving the piston from the distal end to the proximal end of the outlet tube thereby covering the opening in the proximal end and blocking any liquid wash solution present in the pump housing unit from entering the second chamber.

* * * * *